US011391038B2

(12) United States Patent
LeBlang

(10) Patent No.: US 11,391,038 B2
(45) Date of Patent: Jul. 19, 2022

(54) SPACER BRACES FOR WALLS, JOISTS AND TRUSSES

(71) Applicant: Dennis LeBlang, Palm Desert, CA (US)

(72) Inventor: Dennis LeBlang, Palm Desert, CA (US)

( * ) Notice: Subject to any disclaimer, the term of this patent is extended or adjusted under 35 U.S.C. 154(b) by 0 days.

(21) Appl. No.: 14/946,378

(22) Filed: Nov. 19, 2015

(65) Prior Publication Data

US 2019/0242112 A1 Aug. 8, 2019
US 2020/0157797 A9 May 21, 2020

Related U.S. Application Data

(63) Continuation-in-part of application No. 13/398,243, filed on Feb. 16, 2012, now abandoned, which is a continuation-in-part of application No. 12/456,707, filed on Jun. 22, 2009, now Pat. No. 8,164,699.

(60) Provisional application No. 62/175,191, filed on Jun. 12, 2015, provisional application No. 62/170,269, filed on Jun. 3, 2015, provisional application No.
(Continued)

(51) Int. Cl.

| | |
|---|---|
| ***E04B 1/41*** | (2006.01) |
| ***E04B 1/24*** | (2006.01) |
| ***E04B 1/26*** | (2006.01) |
| ***E04C 3/07*** | (2006.01) |
| ***E04C 3/09*** | (2006.01) |
| ***E04C 3/32*** | (2006.01) |

(Continued)

(52) U.S. Cl.

CPC ..... *E04B 1/40* (2013.01); *E04B 1/2403* (2013.01); *E04B 1/2604* (2013.01); *E04C 3/07* (2013.01); *E04C 3/09* (2013.01); *E04C 3/32* (2013.01); *E04B 2001/2415* (2013.01); *E04B 2001/2457* (2013.01); *E04B 2001/2469* (2013.01); *E04B 2001/2644* (2013.01); *E04C 2003/026* (2013.01); *E04C 2003/0473* (2013.01)

(58) Field of Classification Search

CPC ..... E04B 1/40; E04B 1/2604; E04B 1/2403; E04B 2001/2457; E04B 2001/2415; E04B 2001/2469; E04B 2001/2644; E04C 2003/026; E04C 3/07; E04C 3/09; E04C 3/32

USPC ..... 52/317, 481.1, 655.1, 692, 693, 696

See application file for complete search history.

(56) References Cited

U.S. PATENT DOCUMENTS 651,139 A * 6/1900 Gays ..... B61D 17/12 52/47
885,439 A * 4/1908 Collins ..... E04C 3/02 52/696

(Continued)

OTHER PUBLICATIONS

US 7,836,667 B1, 11/2010, diGirolamo (withdrawn)
Simpson Strong-Tie Company INC.—Pleasanton,CA Title of Catalog BBR & DBR Spacer Bracers Jan. 1, 2017.

*Primary Examiner* — Brian E Glessner
*Assistant Examiner* — Adam G Barlow

(57) ABSTRACT

The present invention relates to using interlocking spacer braces between support members to construct wood and metal framed walls, floors and building trusses. Spacer braces have indentations, extensions, fingers that interlock horizontally, vertically or diagonally between support members. The spacer braces can form diagonal and lateral wall bracing, diagonal and vertical chords within building truss with either horizontally or vertical orientations, beams, hold-downs and shear walls. The spacer braces can be installed between wood or metal framing members.

16 Claims, 35 Drawing Sheets

Related U.S. Application Data

62/139,916, filed on Mar. 30, 2015, provisional application No. 62/083,276, filed on Nov. 23, 2014, provisional application No. 61/629,552, filed on Nov. 22, 2011, provisional application No. 61/628,044, filed on Oct. 24, 2011.

(51) Int. Cl.
*E04C 3/02* (2006.01)
*E04C 3/04* (2006.01)

(56) References Cited

U.S. PATENT DOCUMENTS 1,455,712 A * 5/1923 Collins ..... E04B 2/62 52/696
1,867,449 A * 7/1932 Ecket et al. ..... 52/100
2,963,127 A 12/1957 Manville
2,964,807 A * 12/1960 Kennedy ..... E04C 3/02 52/696
2,994,114 A * 8/1961 Black ..... E04B 1/941 52/317
3,343,329 A 9/1967 Pohutsky
3,778,952 A 12/1973 Soucy
3,959,945 A 6/1976 Alien
4,333,293 A 6/1982 Jackson
4,490,956 A * 1/1985 Palacio ..... E04C 3/02 411/466
4,525,972 A 7/1985 Palacio
4,561,230 A * 12/1985 Rionda ..... F16B 9/05 52/289
4,637,195 A * 1/1987 Davis ..... E04C 3/38 52/657
4,704,829 A 11/1987 Baumker
D293,416 S * 12/1987 Krueger ..... 52/696
4,840,005 A * 6/1989 Cochrane ..... E04B 7/024 52/667
4,878,323 A 11/1989 Nelson
RE34,022 E * 8/1992 Davis ..... E04C 3/02 52/657
5,152,114 A 10/1992 Beazley
5,189,857 A 3/1993 Herren
5,218,803 A 6/1993 Wright
5,467,570 A * 11/1995 Leek ..... E04B 1/2608 52/712
5,596,859 A 1/1997 Horton
5,606,837 A * 3/1997 Holizlander ..... E04C 3/02 52/639
5,784,850 A 6/1998 Elderson
5,884,448 A * 3/1999 Pellock ..... E04B 7/022 52/643
5,899,042 A * 5/1999 Pellock ..... E04C 3/02 52/696
5,937,608 A * 8/1999 Kucirka ..... E04C 3/02 52/695
6,073,413 A 6/2000 Tongiatama
6,164,028 A 12/2000 Hughes
6,170,218 B1 * 1/2001 Shahnazarian ..... E04B 5/12 52/693
6,199,336 B1 3/2001 Poliquin
6,260,318 B1 * 7/2001 Herren ..... E04B 2/7453 52/317
6,354,055 B1 * 3/2002 Shaw ..... E04B 7/022 52/696
6,393,794 B1 * 5/2002 Pellock ..... E04B 7/024 52/203
6,412,233 B1 7/2002 Jones
6,418,695 B1 * 7/2002 Daudet ..... E04B 7/022 52/639
6,484,980 B2 11/2002 Medlin
6,578,335 B2 7/2003 Poliquin
6,761,005 B1 7/2004 Daudet
6,837,019 B2 * 1/2005 Collie ..... E04B 7/063 52/489.1
7,178,304 B2 * 2/2007 Brady ..... E04B 2/7457
7,216,465 B2 * 5/2007 Saldana ..... E04B 1/2403 52/655.1
7,231,742 B2 * 6/2007 Majlessi ..... E04B 1/24 52/167.3
7,273,210 B2 * 9/2007 Thurston ..... B25B 5/068
7,299,593 B1 11/2007 diGirolamo
7,428,804 B2 9/2008 Surowiecki
7,520,100 B1 * 4/2009 Herrman ..... E04B 2/7457 52/238.1
7,596,921 B1 * 10/2009 diGirolamo ..... E04C 3/07 52/696
7,607,269 B2 * 10/2009 Klein ..... E04B 2/7854
7,681,324 B2 3/2010 Hooks
7,730,695 B2 6/2010 Brady
7,739,852 B2 * 6/2010 Brady ..... E04B 2/7457 52/696
7,770,348 B2 * 8/2010 Tollenaar ..... E04B 2/767
7,788,878 B1 9/2010 diGirolamo
7,797,901 B2 * 9/2010 Near ..... E04B 2/7433 52/481.1
8,141,319 B2 3/2012 Brady
8,234,826 B1 8/2012 Proffitt
8,281,540 B2 10/2012 Strickland
8,443,568 B2 * 5/2013 Lin ..... E04D 12/004 52/690
D702,533 S 4/2014 Noturno
8,683,772 B2 4/2014 Friis
8,689,508 B2 4/2014 Orszulak
8,756,895 B1 * 6/2014 Sidhu ..... E04B 7/022 52/696
8,769,887 B2 * 7/2014 Proffitt, Jr. ..... E04B 2/58 52/167.3
8,943,778 B2 2/2015 Belanger
8,966,856 B2 * 3/2015 Groenesteyn ..... E04H 9/0237 52/657
8,997,424 B1 4/2015 Miller
9,010,055 B2 4/2015 Orszulak
9,013,108 B1 4/2015 Tu et al.
9,085,888 B2 7/2015 Fuller
9,085,912 B2 * 7/2015 Brady ..... E04G 23/0222
9,019,361 B2 8/2015 Daudet
9,169,948 B2 * 10/2015 Buttars ..... E03C 1/021
9,200,446 B1 * 12/2015 diGirolamo ..... E04B 5/12
9,290,926 B2 * 3/2016 Sidhu ..... E04B 5/12
9,404,257 B2 * 8/2016 Reno ..... E04G 21/1891
2002/0092259 A1 * 7/2002 Crawford ..... E04C 3/02 52/696
2011/0154770 A1 * 6/2011 Friis ..... E04B 7/022 52/696
2012/0180422 A1 * 7/2012 Noturno ..... E04G 21/1891 52/696
2014/0311082 A1 * 10/2014 Sidhu ..... E04B 2/706 52/693
2018/0266109 A1 * 9/2018 Haba ..... E04B 2/58

* cited by examiner

FIGURE 30
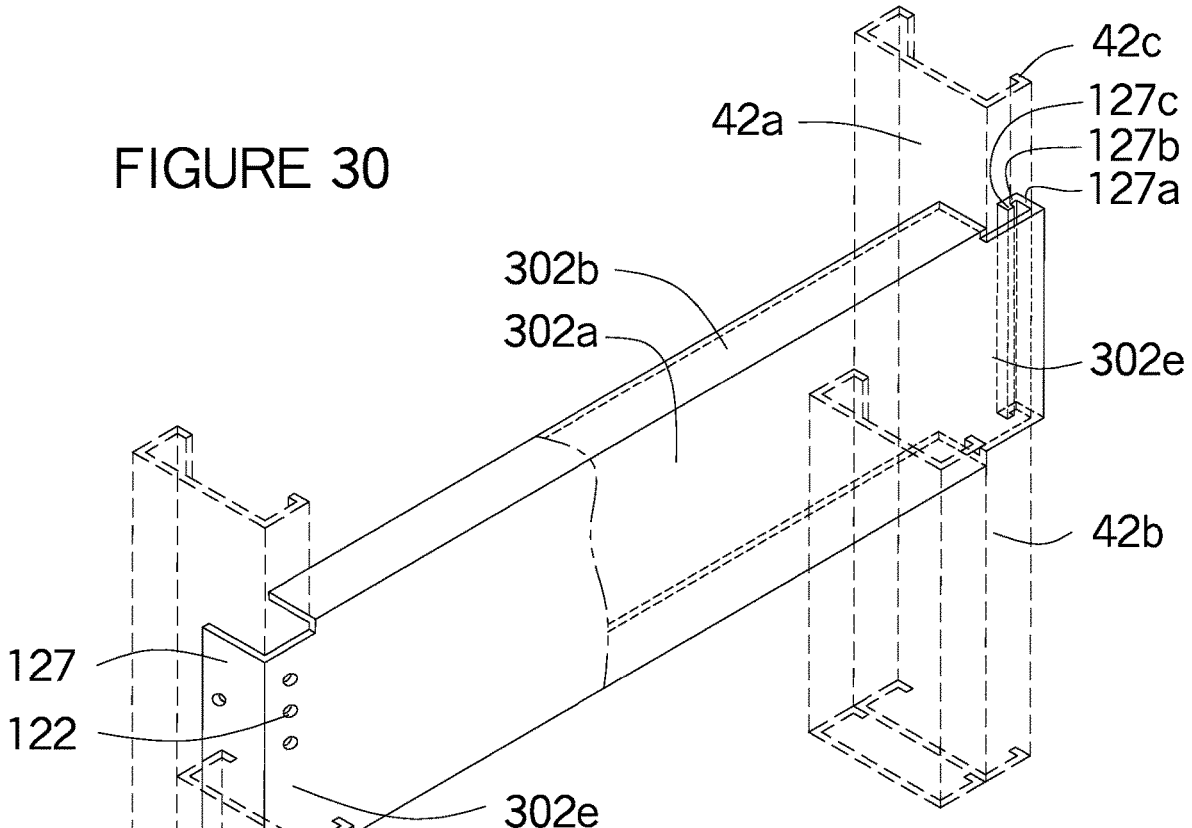
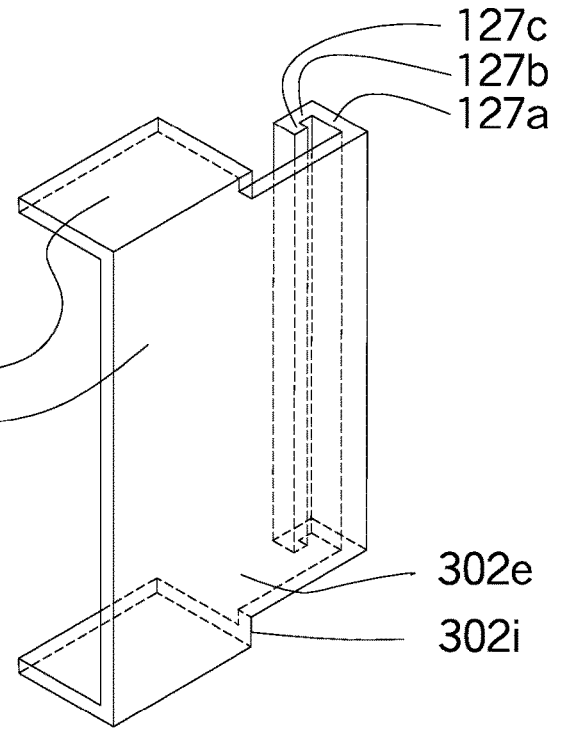
FIGURE 31

FIGURE 32
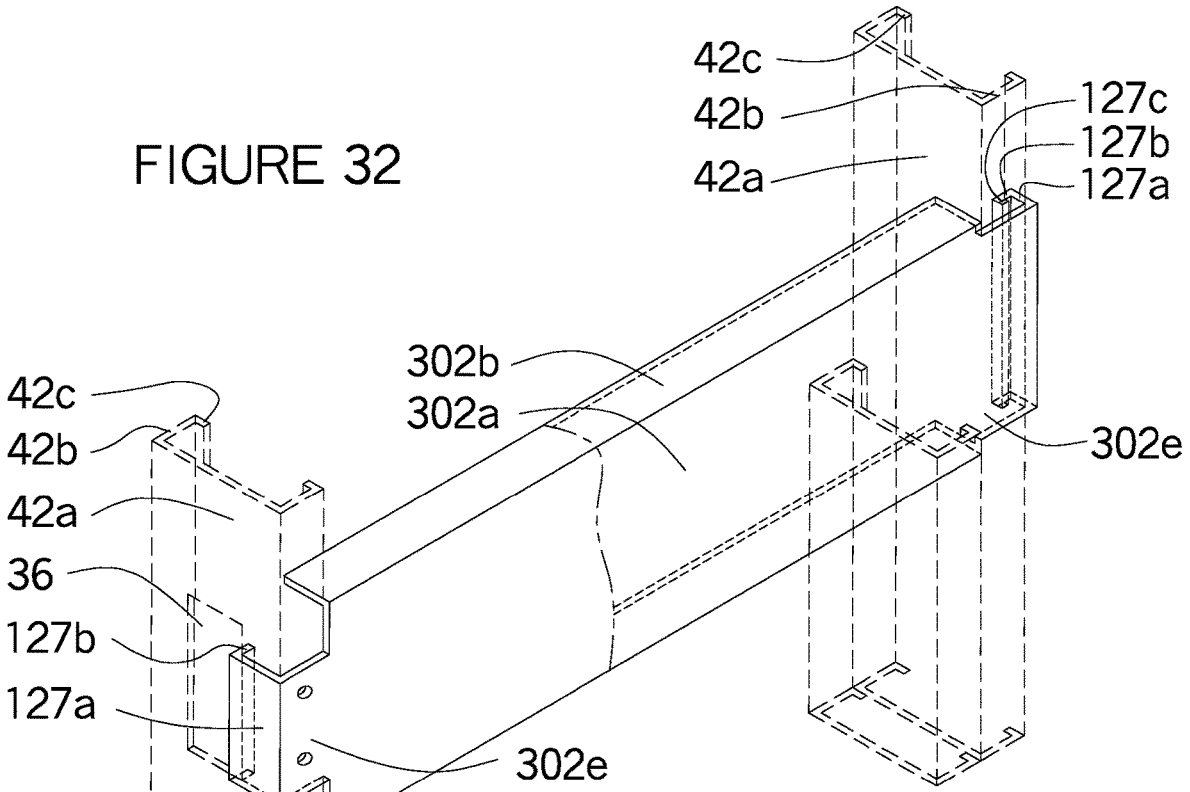
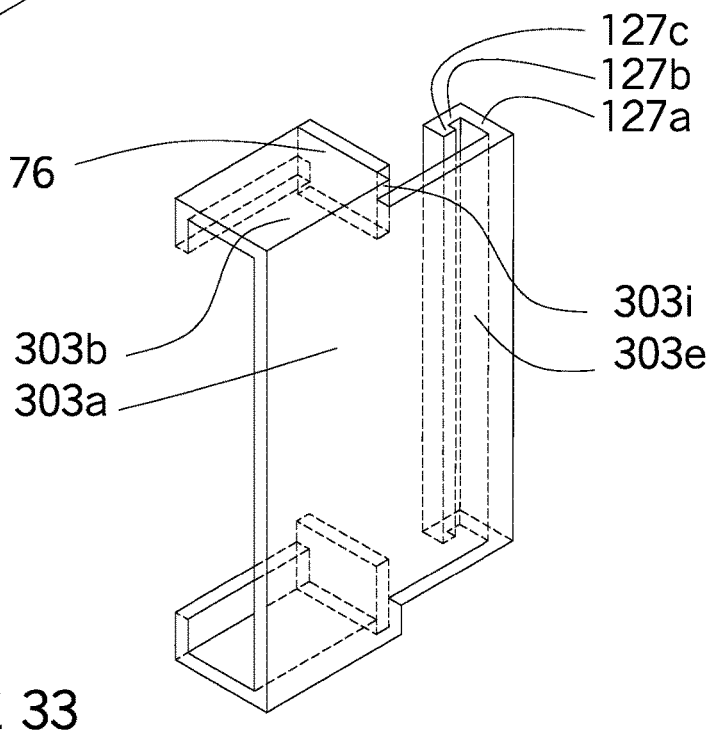
FIGURE 33

SPACER BRACES FOR WALLS, JOISTS AND TRUSSES

CROSS REFERENCED TO RELATED APPLICATION

This application U.S. provisional application Ser. No. 14/946,378 claims priority: from U.S. provisional application No. 62/175,191 filed Jun. 12, 2015 and U.S. provisional application No. 62/170,269, filed Jun. 3, 2015 and U.S. provisional application No. 62/139,916 filed Mar. 30, 2015 and U.S. provisional application No. 62/083,276 filed Nov. 23, 2014 and U.S. Ser. No. 13/398,243 application being a CIP of U.S. Ser. No. 12/456,707, filed Feb. 16, 2012 and U.S. provisional application No. 61/629,552, filed Nov. 22, 2011 and U.S. provisional application No. 61/628,044 filed Oct. 24, 2011 by the inventor hereof, the entire disclosure of which is incorporated herein by reference.

FEDERALLY SPONSORED RESEARCH OR DEVELOPMENT

Not applicable

PARTIES OR JOINT RESEARCH

Not applicable

FIELD OF THE INVENTION

The present invention comprising metal framing spacer brace as an elongated body forming a U shape spacer brace having a web with two the opposed flanges or a reverse lip spacer brace between wood support members and metal support members to engage support members having engagement means at first end and a second end configured with little to no screw fasteners. The spacer braces have cut-outs at the first end and second end to separate the flanges and webs to engage the support member to form the hook finger ends at the web. The spacer brace has wide cut-outs when overlapping at intermediate support members for wood and metal framing support members where the flanges form a U-shape notch with the flange edges engaging both sides of the support member with the web overlapping the intermediate support. On the other hand for metal support member the cut-out will be the thickness web or wider when overlapping the width of said web or said flange. While the lips of the reverse lip spacer brace have notches for the lips notches to engage the side edges of the perimeter of the hole in the intermediate metal framing support member. The spacer braces have punched hole teeth for connection to wood support members. The first end and the second end of the spacer braces can have L-shape or U shape at the hook fingers or can have flap ends to connect to support member or hook shapes that connect between other spacer braces are connected to support members. The metal support member have a web, two opposing flanges with lips forming C-shape with web holes in the web for spacer braces to extend through with flanges or flanges with lips having cut-outs for the web of the cut-out to brace intermediate support members or with lips or the spacer braces having lips with notches abut the hole side edges at the support members with the finger ends connecting to the opposing side of the support member. The flanges of the spacer braces when abutting wood support members have jagged edges while the flange edges for metal supports will have abrasive flanges edges and impressions at the first and second ends forming ribs or other frictional means of preventing movement. The spacer braces can be connected horizontally or diagonally for even spacing between support member and increase structural strength. The spacer braces with the interlocking connections between members can form roof and floor trusses, shear walls, headers above doors and windows and lateral bracing between the truss joists.

BACKGROUND OF THE INVENTION

Light gauge metal framing and wood framing have been used in the construction of buildings for many years, however interior and exterior metal framing has always been difficult to assemble as well as construct horizontal and diagonal bracing between support framing members because of the configuration of the support members like a C channel and poor energy efficient shear wall construction. The lip and flange of the C channel protrudes from the web making it difficult to make connections. When bracing members are installed between support members for additional strength, insulation became even more difficult to install as well as form a well insulated wall.

When assembling wood and metal framed walls the vertical support members are not stiff until the bracing members are added to help stabilize the support members from moving. In the past there have been attempts to stiffen support members by providing lateral bracing or bracing members between vertical or horizontally oriented support members.

The bracing members within the wall forming structure are generally required to tie the support members together. For metal framing bracing members are internal bracing members installed through openings provided in the web of the support channels and solid blocking for wood framing. None of the metal framing bracing members used today has a good quick installation solution for interlocking individual bracing members together between support members. Bracing members are usually long supports connecting many support members together and are not individual members that have the flexibility to be installed individually and at a diagonal within the metal framing wall. In addition the bracing members are not used to form shear walls or diagonal framing with the walls or have the flexibility to form trusses having diagonally framing members.

Exterior and internal metal framing have always been difficult to rapidly connection support members together insulate or sound proof because of the configuration of the support channels like a C channel. The lip and flange of the C channel protrudes from the web making it difficult to insulate. When bracing members are installed between support members for additional strength, insulation became even more difficult to install as well as form a good insulated and sound deadening wall.

DESCRIPTION OF PRIOR ART

Since the spacer braces can be used in so many different ways many different applications were reviewed including metal framing configurations, connections between different types of framing members, various connecting methods including groove, tabs, notches to connect metal framing members together. Some types of connections between support members use bent hooks, bent flanges, adjustable braces or extended tabs to connect trusses. Truss Joists can use different types of metal framing components to form truss framing assemblies including deep horizontal supports, downward edges, split connections, rods to form diagonal bracing or welding of support members. Horizontal floor joists are attached together with a strap having holes. Metal framing members fit together to form headers but are not spacer braces. The shape of the holes in the support members will change the shape of bracing members and their connections. The orientation of the spacer brace whether the flanges face upward or down plus various types of brackets and connectors are used to connect spacer braces to support members.

SUMMARY OF THE INVENTION

The present invention are interlocking spacer braces that connect different building construction components together to form integrated building wall and floor assemblies using wood or light gauge metal framing spacer braces. The spacer braces connect vertical or horizontally oriented support members together individually and installed either horizontally, vertically or diagonally between support members.

The spacer brace with its elongated body that can be U shaped having a web or dorsal side oriented vertically or horizontally with two flanges extending ventrally from the web. The bottom edges of the flanges can be extend inward to form a lip wherein the spacer brace forms a C shape or extend outward where the lip has a reverse lip channel or hat channel shape. The opposing end of the flanges can have jagged edges that engage wood support members, be smooth to abut to the support members, have notches that engage the hole or have bent flaps where the longitudinal side of the bent flap abuts the support members. The spacer braces can have the double-bent flanges, indentations in the webs or flanges or increased thickness in the gauge of the space brace to increase the strength. For quick assembly, teeth can be punched from the dorsal to form teeth that secure the spacer brace to wood support members. The opposing ends of the spacer braces can have the same end or different ends depending on where the ends fit into or over the supporting members.

The present invention allows the spacer braces to connect between support members to form roof and floor trusses, shear walls, headers above doors and windows and lateral bracing between the support members and various types truss joists. The spacer braces can be installed vertically, horizontally or diagonally with the dorsal side of the spacer brace installed vertically between support members between the flanges or over the flanges. The spacer braces can have angular side flanges to fit into large triangular holes within the support members. The hook finger shapes and flanges can brace support members to form truss floors or roof trusses.

The spacer braces can be installed individually in any position including the spacer braces can be installed right side up or upside down and on the top, bottom or side edges of a holes. The holes in the support members can be triangular or rectangular to still perform its function. The spacer braces can function in tandem when installed adjacent to one another or on opposite sides of the flanges or holes in an alternating pattern. The spacer braces can have different configurations, can be connected by screws, nails, jagged edges, punched hole teeth, dimples, nails or U or C-shaped hook fingers.

The spacer braces have notches to engage the holes of the support members and hook shapes that engage the top or bottom edges of the holes in the support members. The hook shape can be bent at an angle for the spacer braces to be installed at an angle to form a truss within a wall structure or as a truss joist. The holes in the support members form predetermined locations for easy installation of the spacer braces. Diagonally oriented spacer braces can be installed above and below the hole in the support member and still allow for a horizontal spacer brace to be installed within the hole. The spacer braces can just be twisted into place at the holes or screwed together between spacer braces.

BRIEF DESCRIPTION OF THE DRAWINGS

FIG. 30 shows the end of the finger as a U-shape being connected to the lip of the support member when being used as a beam.

FIG. 31 shows an enlargement of the connection at the support member.

FIG. 32 shows the spacer brace as a beam for C channels using U-shape or L-shapes at the ends of the fingers supporting the beam.

FIG. 33 shows an enlargement of the connection in FIG. 32.

DESCRIPTION OF THE PREFERRED EMBODIMENTS

Figure 1:
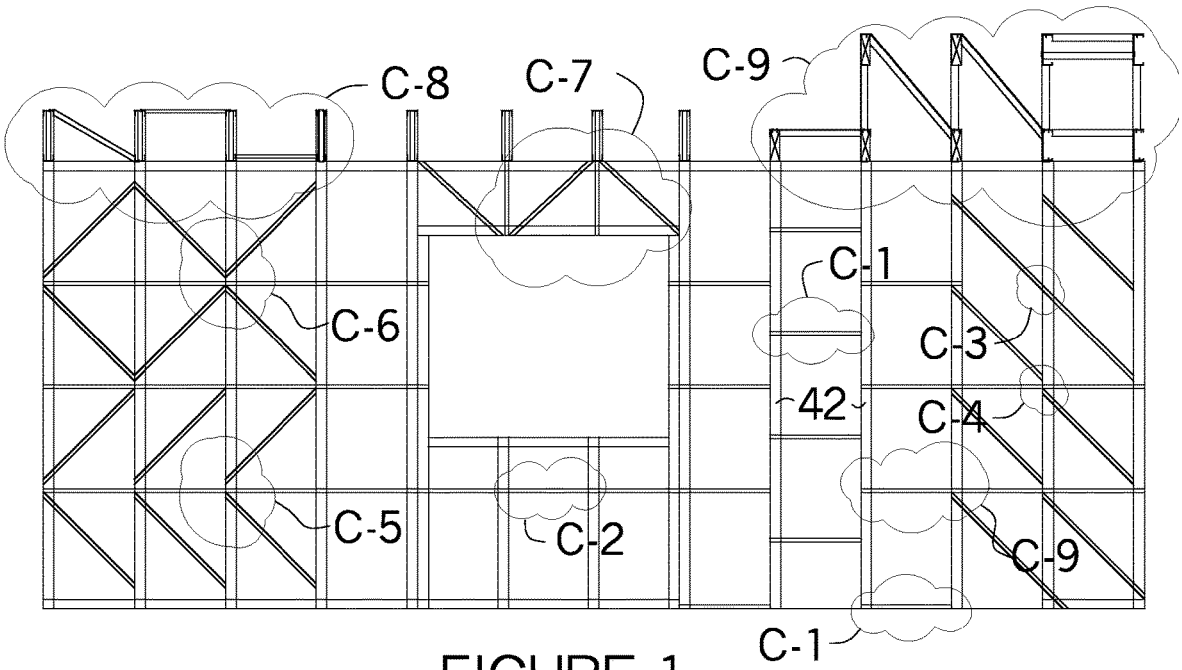
FIG. 1 is an elevation showing the nine clouds formations where each cloud represents a different spacer brace application: individual spacer braces, spacer braces connecting to adjacent spacer braces, diagonal spacer braces, offset diagonal spacer braces, opposite pointing diagonal spacer braces, X framing spacer brace, truss head, floor trusses and a solid fire stop spacer braces.

FIG. 1 shows an elevation of a metal or wood framed wall showing various clouds or cut away areas of the spacer brace configurations explained in the various figures noted in the drawings. C-1 could be a horizontally oriented spacer brace spanning between the holes in metal support member or spacer braces mounted on the flanges of wood or metal framing or hold down spacer braces mounted on the floor. C-2 could be a continuous spacer brace spanning between intermediate support members at the hole or on the flanges, or individual spacer braces installed in a continuous line in the holes or on the flanges between support members or individual spacer braces installed on both side edges of the hole. C-3 could be spacer braces installed over the flanges or through the holes of wood or metal support members to form a continuous diagonally oriented spacer braces. C-4, C-5 & C-6 show spacer braces mounted on the top and bottom edge of the hole and through the middle of the hole in a metal support member or could be spacer braces mounted between support members or over their respective flanges. C-7 is similar to C-4; C-5 & C-6 except here the configuration is forming a beam above a window. In C-8 the horizontal support members could be wood or metal with the spacer braces used as vertical and diagonal cords to form floor joists and shown with lateral bracing at the top, bottom and connects at the lips of the support members. In C-9 wood floor joists are shown as well as truss joists using wood or metal support members having spacer braces as vertical and diagonal chords of truss joists as well as horizontal and diagonal lateral bracing at the top, bottom or through the holes of the support members. The spacer braces have same characteristics but are used in different applications.

Figure 2:
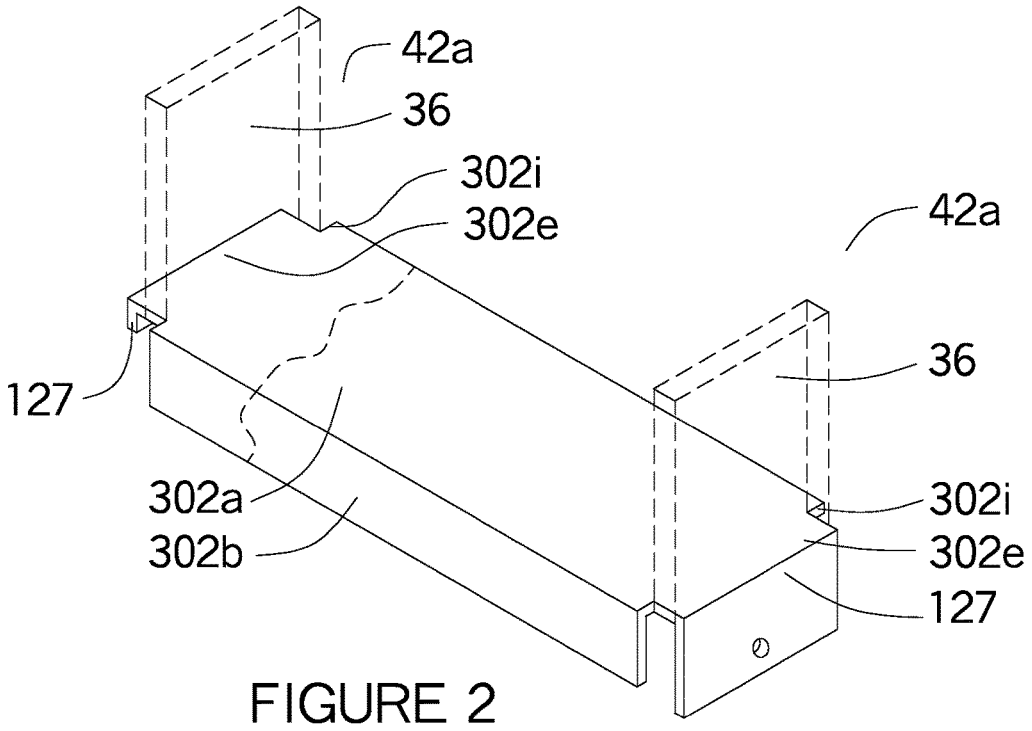
FIG. 2 shows a downward oriented U shaped spacer brace connecting the holes of adjacent spacer braces.
Figure 10:
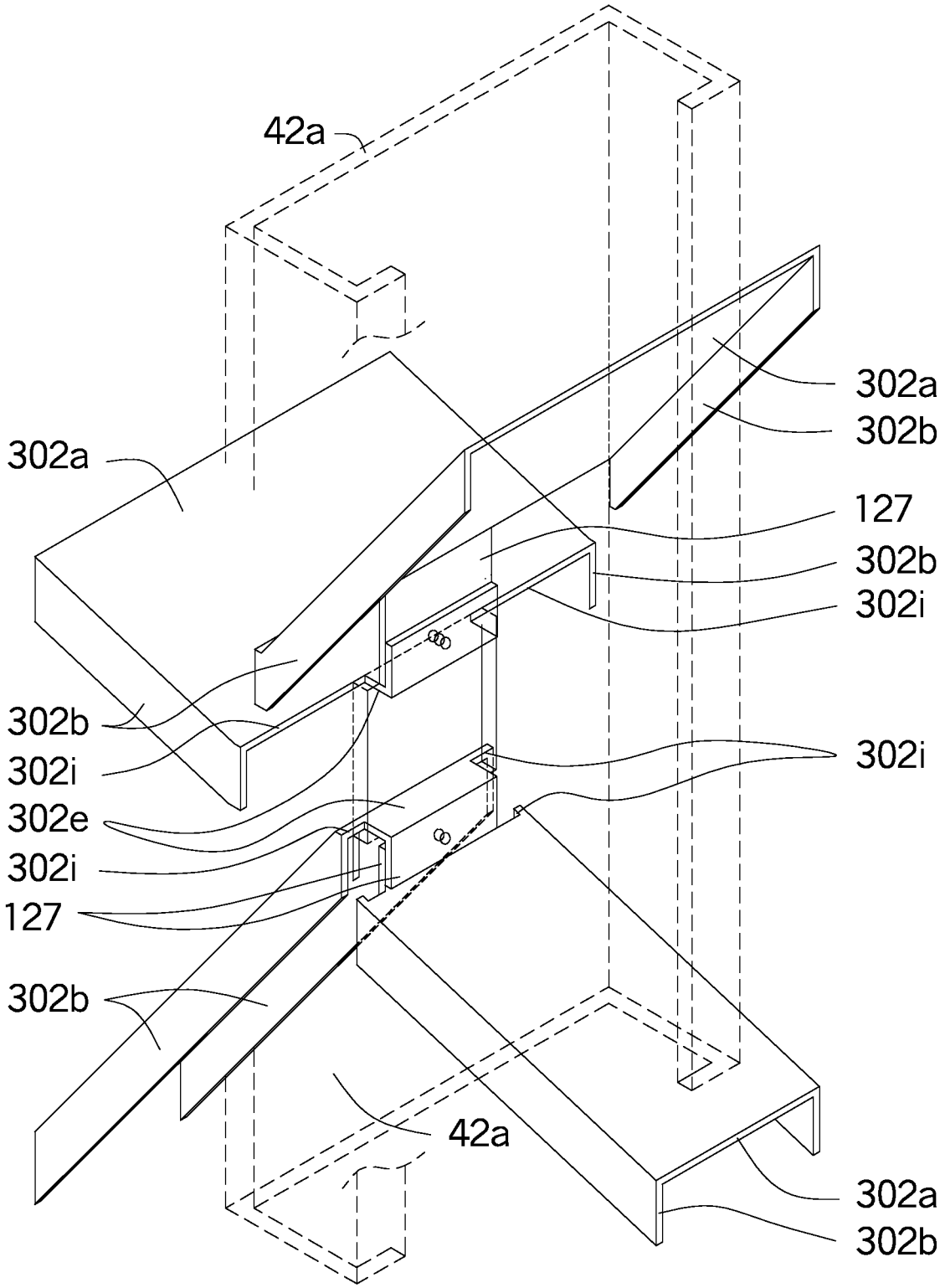
FIG. 10 shows the spacer braces installed diagonally with the hook tongues overlapping each other at the web of the support member.

FIG. 2 shows a single spacer brace as shown as C-1 or C-9 in FIG. 1 of an isometric of a downward oriented U shaped spacer brace 302 with the web 302*a* having the dorsal side at the top side with two parallel flanges 302*b* extending ventrally downward from the web 302*a* and shown installed in a hole 36 (shown in ghost) at the web 42*a* between support channels shown as a C channels 42. In FIG. 1 the cloud formation C-1 has the support member shown vertically and in C-9 the support member is horizontal, but in both cases the U shaped spacer brace 302 is shown passing through a hole 36. The U shaped spacer brace can be equal in width of the hole 36 or wider than the hole 36. The web 302*a* has an indentation 302*i*, with an extension 302*e* so the hook finger 127 fits against the bottom edge of the hole 36 and against the web 42*a* of the support member. The web 302*a* and the parallel flanges 302*b* fit against the opposite edge of the web 42*a* forming an indentation 302*i* securing the U shaped spacer brace 302 to the hole 36. The hook finger 127 can be longer so a fastener can be used to secure the hook finger 127 to the web 42*a* or to another hook finger 127 should one hook finger 127 be installed over another hook finger 127 as shown in FIGS. 7 & 10 when installed at an angle. The single spacer brace can also be used as a base plate at the floor as shown as C-1 in FIG. 1. The U shaped spacer brace 302 can be used as a spacer to evenly space the support members within the wall framing or as a full width base plate typically used in building construction.

Figure 3:
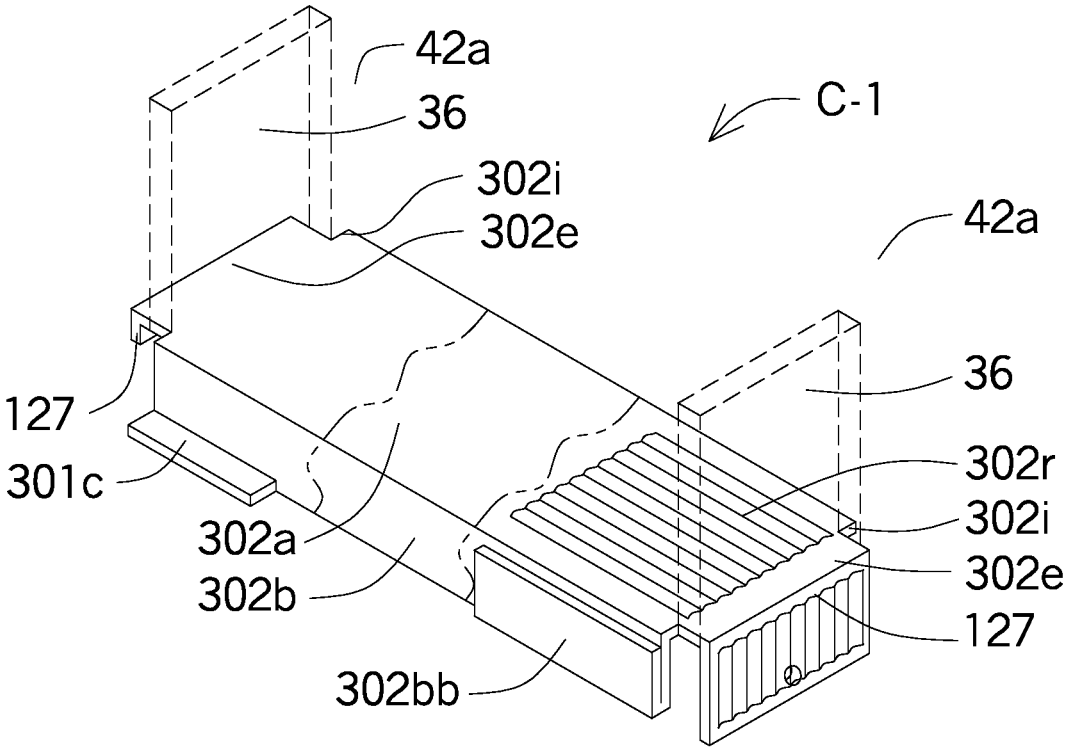
FIG. 3 shows a downward oriented U shaped spacer brace with alternative spacer brace shapes including ridges in the dorsal and hook finger shapes, lips at the ends of the flanges and double thick flange.
Figure 4:
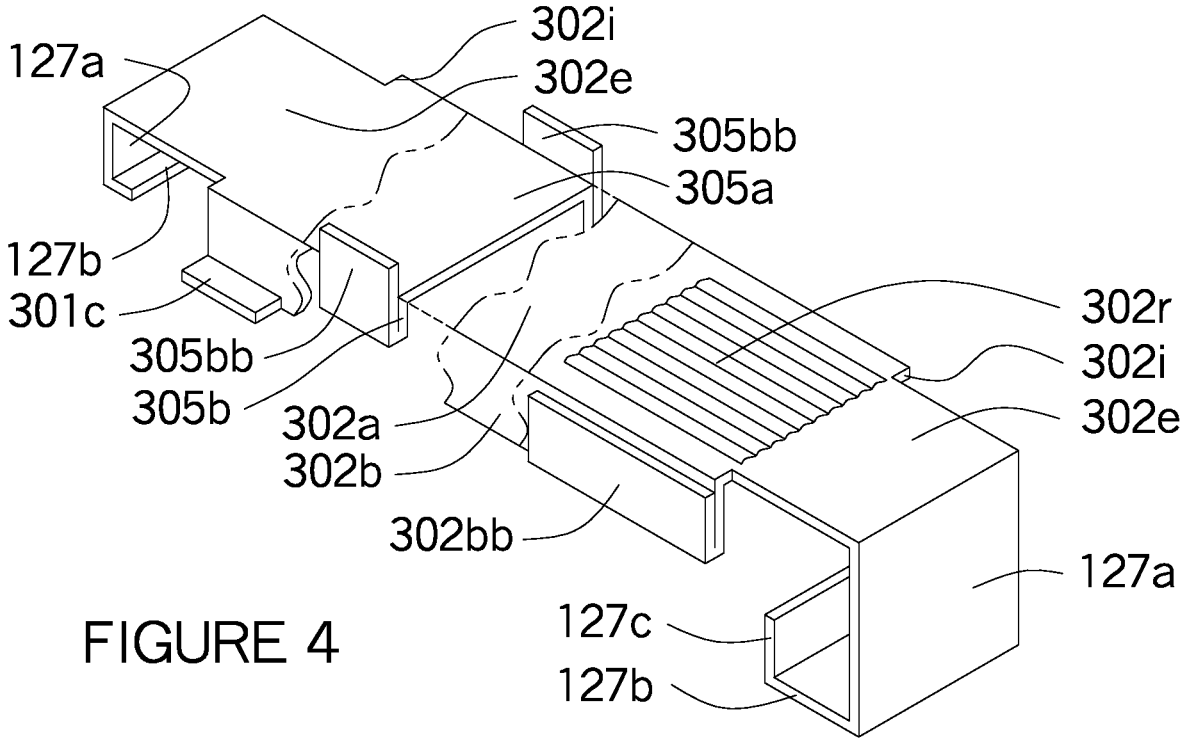
FIG. 4 shows a downward oriented U shaped spacer brace with U shaped finger ends.

FIG. 3 and FIG. 4 show an isometric drawing of a spacer brace having different configurations. One variation shows a downward oriented U shaped spacer brace 302 having an elongated body with a web 302*a* having two flanges 302*b* extending downward from the ventral side of the web 302*a*. The U-shaped spacer brace 302 is shown where the dorsal is oriented horizontally and two flanges 302*b* extend downward from the ventral side. Another variation shows a reverse lip spacer brace 301 having a U shape with a lip 301*c* extending from the bottom edge of the flange 30*bb* in an outward direction away from the web 301*a* and better shown as a reverse lip brace 301 in FIG. 14. Another variation of the U shaped spacer brace 302 has the flange 302*b* shown as a double flange 302*bb* where the flange 302*b* is bent twice to increase the strength. Another variation shows an I shape spacer brace 305 where the flanges 305*b* and 305*bb* are slightly different than the reverse lip brace 301 as the flange 305*b* extends downward from the web 305*a* then bents upward to form flange 305*bb*, but extends above the web 305*a* forming an I shape at the both flanges. By forming grooves, indentations or ribs 302*r* in the direction of the elongated spacer brace the metal surface is broken and the ribs 302*r* will increase the strength of the elongated spacer brace. The thickness of the metal to form the spacer brace can increase in thickness to increase the strength of the spacer brace. The left side shows and an indentation 302*i* extend from the flanges 302*b* and into the web 302*a* where the web 302*a* has an extension 302*e* with a hook finger 127 extending ventrally downward forming an L-shaped hook where the first leg is 127*a* and the second leg 127*b* for an L-shape. The right side shows a U-shape at the end of the hook finger 127 where the first leg is 127*a*, then bent again shown as 127*b*, then bent upwards shown as 127*c*. The L-shape can be used where the hook finger 127 extends into the hole 36 in the web 42*a* of a support member and the U-shape can be used where the hook finger 127 extends around the lip 42*c* of the support member.

Figure 5:
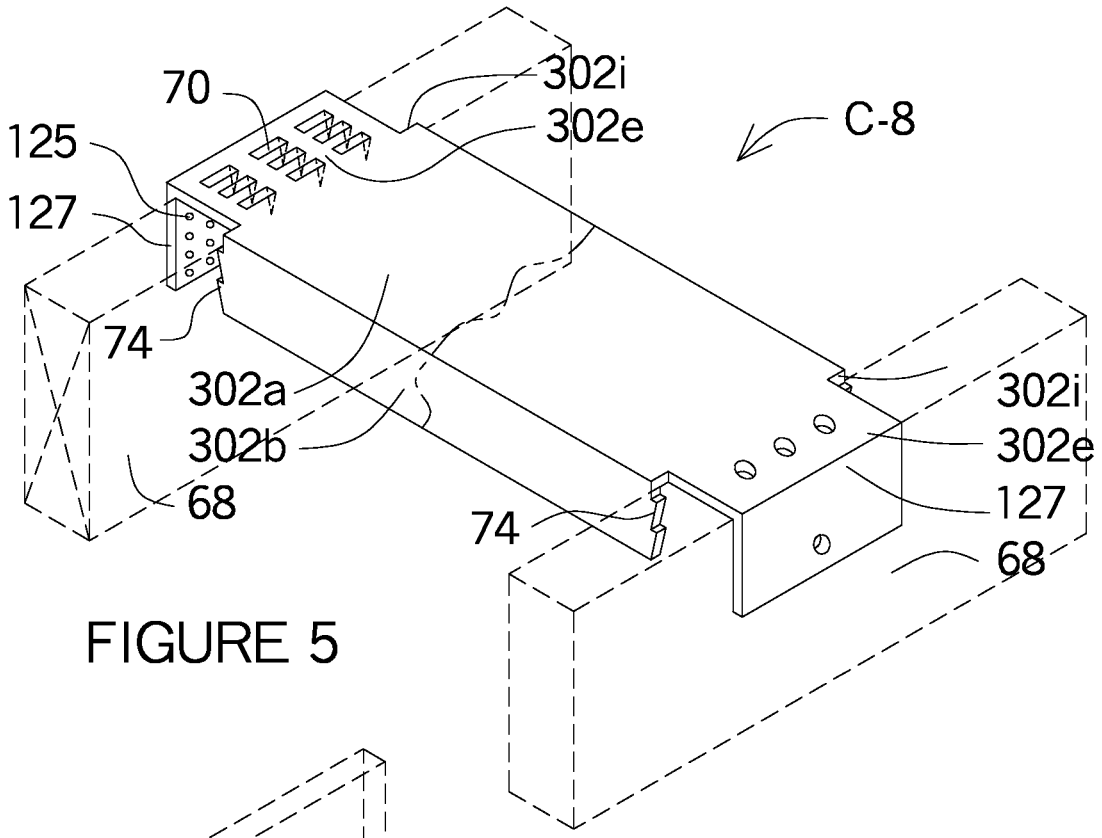
FIG. 5 shows U-shaped spacer brace in a horizontal position with its downward oriented flanges having the jagged edges and the hook fingers having abrasive protrusions on its inside surface.
Figure 22:
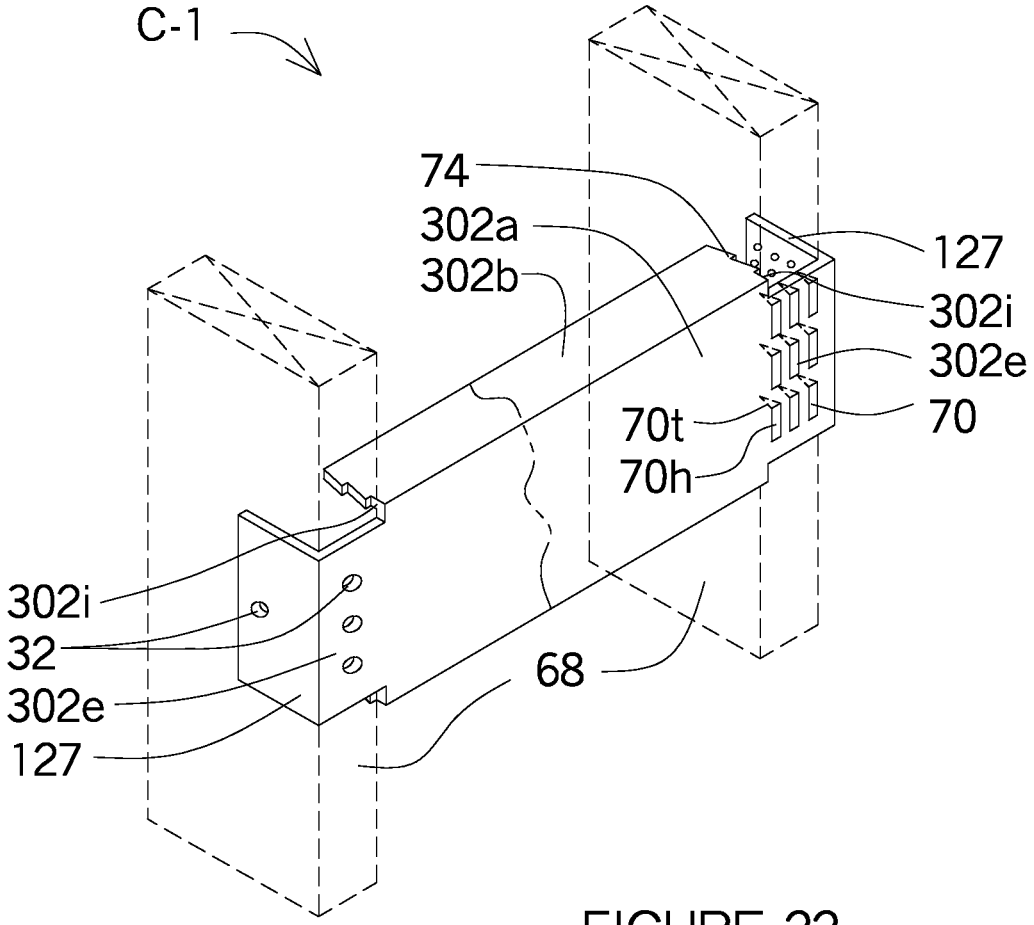
FIG. 22 shows the U-shaped spacer brace in a vertical position with jagged edges at the ends of the flanges and punched teeth extending from the web into the support member.

FIG. 5 is similar to FIG. 22 except the wood framing members 68 are oriented horizontally instead of vertically as shown in FIG. 1 in C-8 at the rafters or truss joists. The U-shaped spacer brace 302 has the dorsal horizontally oriented and the flanges 302*b* extend ventrally downward with the jagged edges 74 penetrating the wood framing members 68. The dorsal side of the web 302*a* can have holes for nails to penetrate the wood framing members 68 or punched hole teeth 70. The ventral side of the hook finger 127 has dimples 125 as an abrasive means for a better connection since wood framing members 68 usually have an uneven surface. Punched hole teeth 70 are shown on the dorsal side of the extension 302*e* in the U-shaped spacer brace 302 so the teeth 70*t* for the punched hole 70*h* can penetrate the wood framing member 68.

Figure 6:
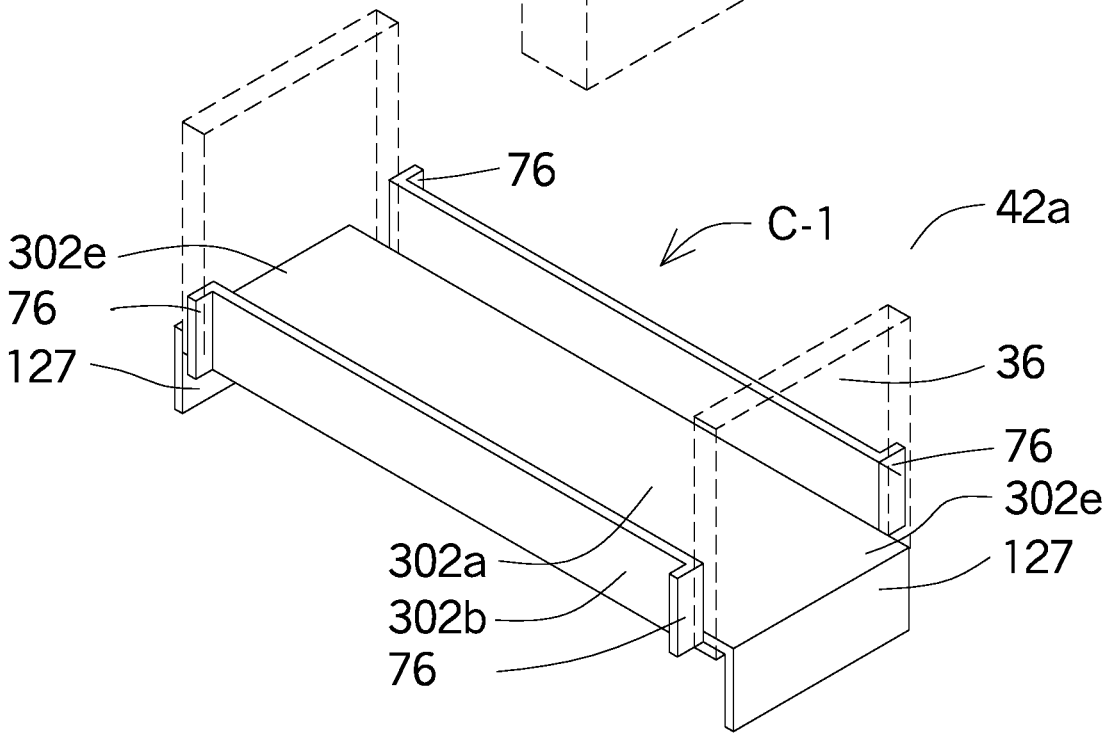
FIG. 6 shows a U-shaped spacer brace in a horizontal position with its flanges oriented upward with bent flaps engaging one surface of the support member and the downward oriented hook finger engaging the opposite side of the support member.

FIG. 6 is similar to FIG. 2, however the U-shaped spacer brace 302 is facing upward and the web 302*a* has the dorsal side on the bottom side. When the width of the U-shaped spacer brace 302 is equal or narrower than the width as the hole 36, the web 302*a* is narrower than the bottom edge of the hole 36 and the extension 302*e* passes through the hole 36 then bent over the bottom edge of the hole to form an hook finger 127. There is no indentation 302*i* since the width of the web 302*a* is smaller than the width of the hole 36. The flanges 302*b* extend upward from the web 302*a* of the U-shaped spacer brace and the ends of the flanges 302*b* have a flap 76 that is bent so the sides of the flaps 76 brace against the web 42*a* of the support members.

Figure 7C:
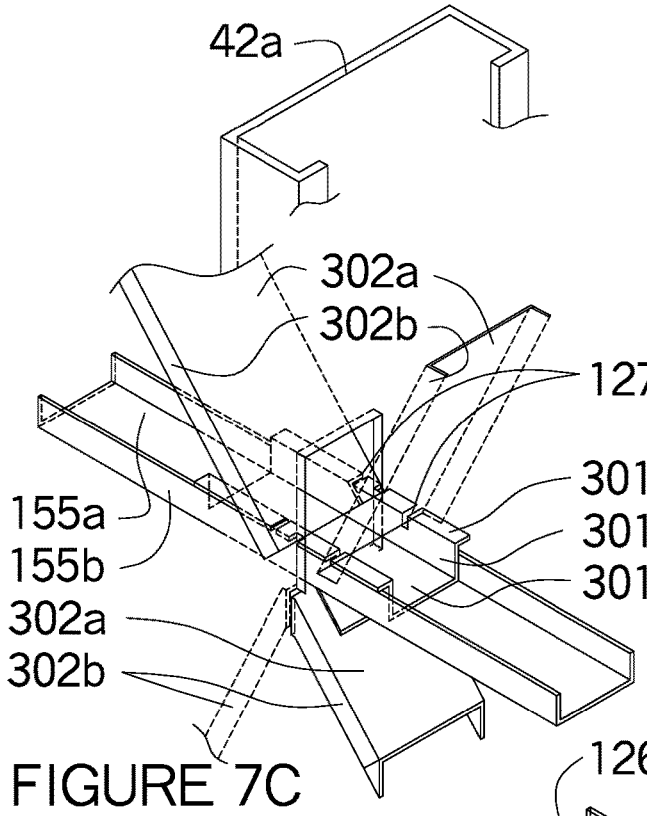
FIGS. 7A, 7B & 7C shows the steps required in order to install six spacer braces intersecting a one hole in the support member.
Figure 7A:
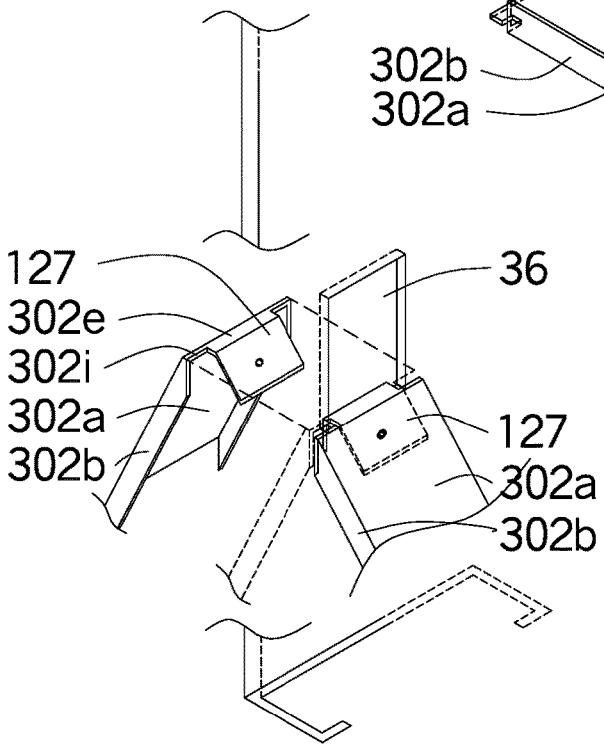
Figure 7B:
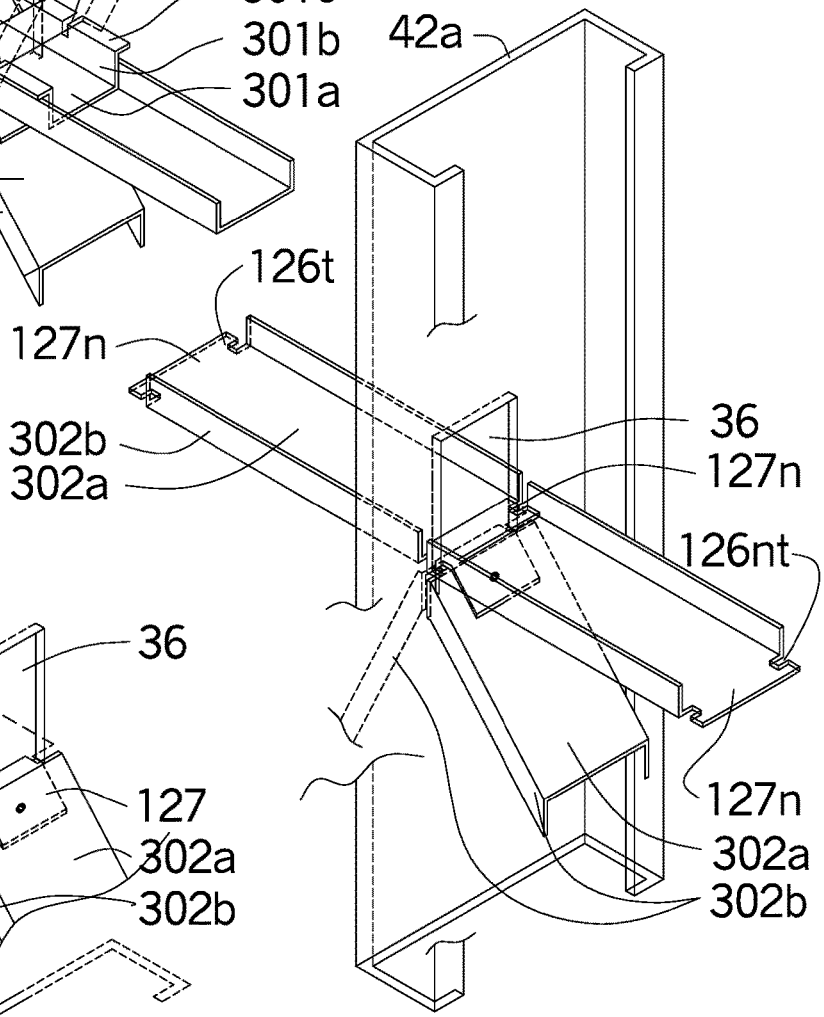
Figure 8:
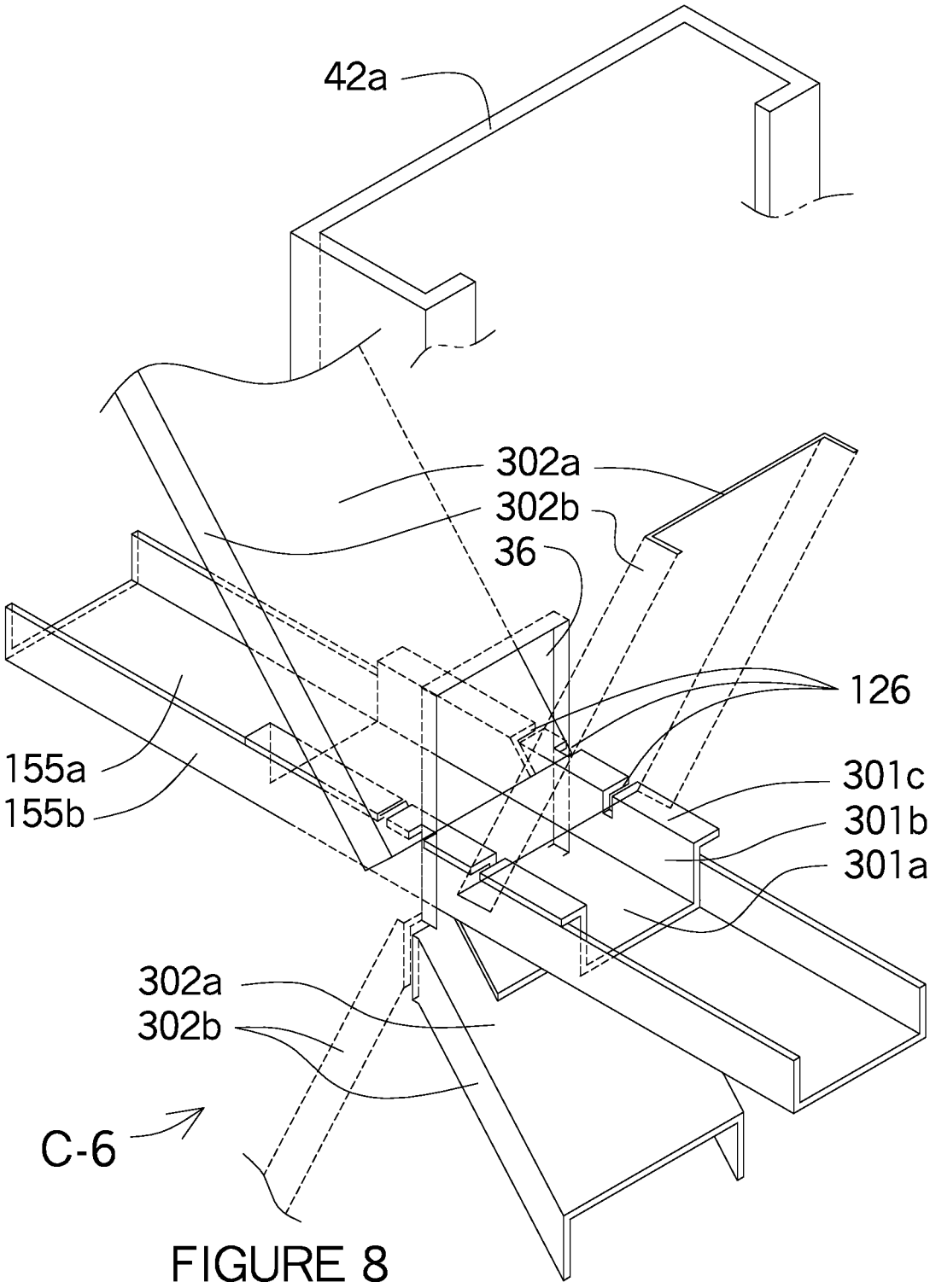
FIG. 8 shows an enlargement of the six spacer braces intersecting in one hole however the horizontal spacer brace is shown as a continuous horizontal bracing channel for clarification and a reverse lip brace with notches in the lips are secured to the sides of the hole and the reverse lip brace has angles notches for the top sides of the diagonal spacer braces could be installed in the angled notches.

FIGS. 7A, 7B & 7C is similar to C-5 & C-6 in FIG. 1 as the spacer braces are shown diagonally installed in the metal framed wall where six intersecting U shaped spacer braces 302 intersect at the same hole 36 and all the U shaped spacer braces 302 are wider than the hole 36. In order to show the U shaped spacer braces 302 being continuous FIGS. 7A, 7B & 7C show an enlargement of three different holes 36 in the support members as additional U shaped spacer braces 302 intersect at the holes 36 in the support member. The diagonally oriented spacer braces 302 are shown having the dorsal side of the web 302*a* with its top side facing upward with the two parallel flanges 302*b* extending ventrally downward along with a horizontally oriented spacer brace 302 having the web 302*a* on the downside with the two parallel flanges 302*b* extending ventrally upward. FIG. 7A shows two diagonally oriented spacer braces where the right U shaped spacer brace 302 has the flange edges cut at an angle with the hook finger extending over the hole bottom edge 36*be* forming a cutout with one diagonal edge with a blunt end at the pointed intersection. The left spacer brace is similar to the right spacer brace; however, the hook finger has an extension 302*e* added to extend over the hole 36 at the hole bottom edge 36*be* in order for the hook finger 127 from the left and right spacer brace to overlap at the hole 36. FIG. 7B shows the two upward facing horizontally oriented U shaped spacer braces 302 having the dorsal side on both ends of the bottom side of the web 302*a* of each U shaped spacer brace 302 having notches 126 at the end or notch-web fingers 127*n*. The notch-web finger 127*n* passes through the hole 36 and the end of the notches 126 has tabs 126*t* at the end that give support to the notches 126 when extending past the hole 36. The notched tab 126*nt* is formed by installing the notched tab 126*nt* at the side edges of the web 302*a* leaving the notched tab 126*nt* having the web 302*a* on one side and the opposite side having a tab 126*t* be the remaining end of the notch-web finger 127*n*. The notch-web finger 127*n* of the adjacent horizontally oriented U shaped spacer brace 302 is placed over the notch-web finger 127*n* of the first horizontally oriented spacer brace 302 with its notched tab 126*nt* and tab 126*t* engaging the hole 36. Since the horizontally oriented U shaped spacer braces 302 are wider than the hole 36 the edges of the web 42*a* and two parallel flanges 302*b* abut the web 42*a* for the support member as well as the tab 126*t* at the end of the notches 126. FIG. 7C and enlarged as FIG. 8 shows a upward orient bracing member shown as a horizontal bracing channel 155 passing through the hole 36 with the dorsal side of the web 155*a* as its bottom side with the two parallel flanges 155*b* extending ventrally upward. A one piece multi-plane brace 301 sometimes referred to as a reverse lip spacer brace having the dorsal side of the web 301*a* and the two flanges 301*b* and lips 301*c* extending from the flanges 301*b* placed within the horizontal bracing channel 155 so the dorsal sides of the web 301*a* and flanges 301*b* abut the top side or ventral side of the web 155*a* and between the flanges 155*b* with lips 301*c* extending over the top edge of the flanges 155*b* for the support member with the hole 36 in the web 42*a* for the multi-place brace 301 can be inserted into said web holes 36 the notches 126 in the lip 301*c* securing the one piece multi-plane brace 301 into place at the hole 36. The upward facing one piece multi-plane brace 301 also has angular oriented notches 126 installed in the lips 301*c* and the upper side of the two parallel flanges 301*b* forming continuous notches 126. Diagonally oriented U shaped spacer braces 302 have their web 302*a* with its dorsal side facing upward on its top side into the diagonally oriented notches 126 and where the opposite end is shown being installed in FIG. 7A. FIG. 8 shows an enlargement of FIG. 7C. Whether the spacer braces is a U shaped spacer brace 302 or a reverse lip shape 301, upward facing or downward facing the spacer braces have angular notches 126 and lip notches 126 being continuous from the lip 301*c* into the flanges 301*b* as well as perpendicular notches 126 to the lip 301*c* are interchangeable shapes as well as most of the interlocking connections at the hole 36.

FIG. 8 is similar an enlargement of FIG. 7C. The support member is shown as a U channel 155 and the web 155*a* has the hole 36. All the horizontal oriented and diagonal spacer braces 302 are shown with the width of the webs 302*a* fit between the parallel flanges 155*b* and the diagonally oriented spacer braces 302 have indentations 302*i*, extensions 302*e* and hook shapes upward or downward oriented connect to the top or bottom edge of the hole 36 or connect to the web 302*a* of the adjacent diagonal spacer brace 302. The horizontal oriented spacer braces 302 have the same notched tab 126*nt* and tab 126*t* configuration as described in FIG. 7C.

Figure 9:
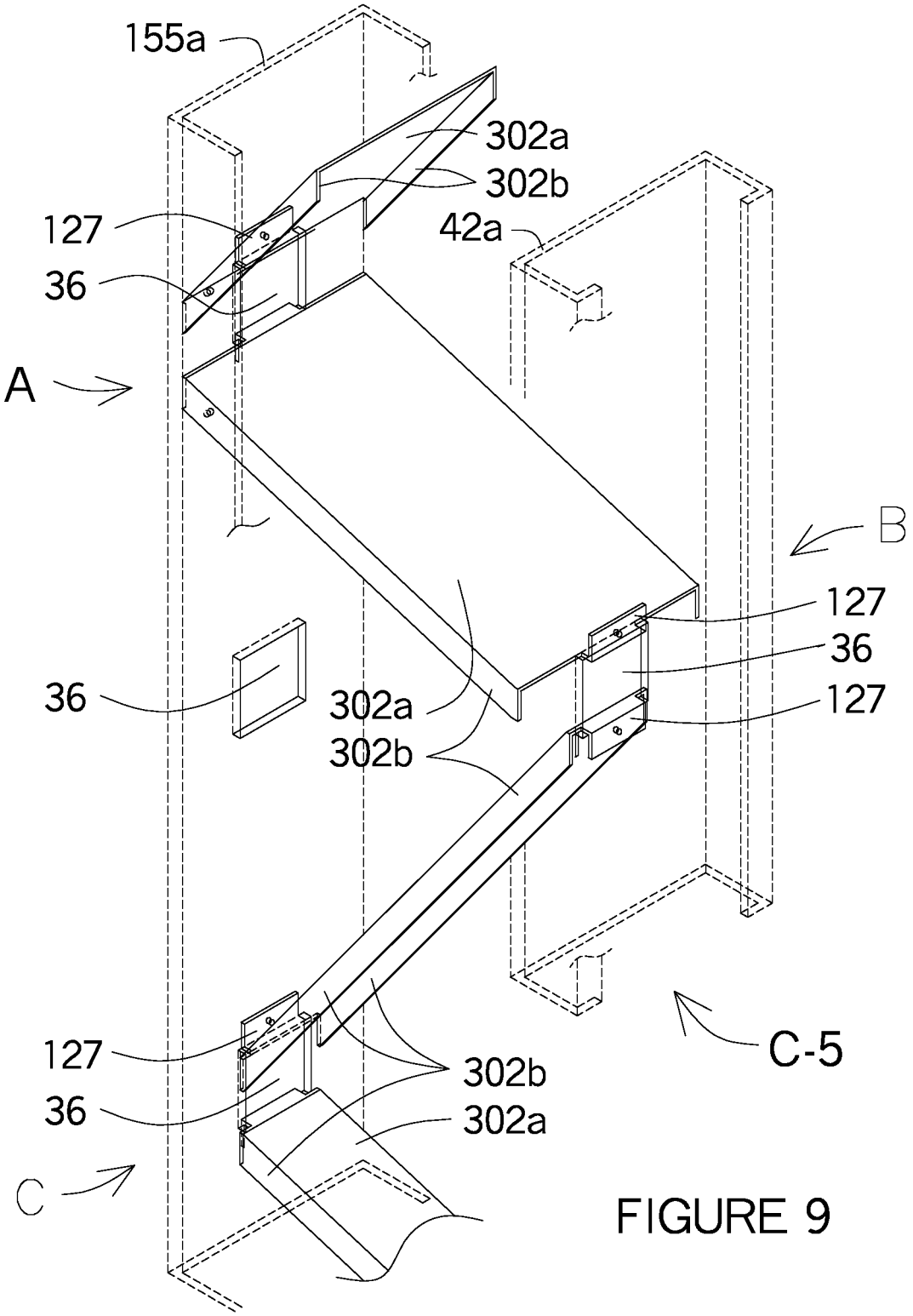
FIG. 9 shows how the spacer braces are oriented horizontally but are installed diagonally between support members where the hook fingers extend through the holes of adjacent support members.

FIG. 9 shows two diagonal spacer braces 302 spanning between the holes 36 of two support members shown as a C channel 42. The U shaped spacer brace 302 face downward with the dorsal side being on the top side with the two flanges 302*b* extending ventrally downward. The end of each U shaped spacer brace 302 has the hook fingers extending through the hole 36 with the extension 302*e* abutting the top or bottom edge of the hole 36 with an indentation 302*i* occurring at the hole 36 where the web 302*a* is wider than the hole 36. The isometric drawing shows two support members as C channels 42 with holes 36 in the web 42*a* with downward facing U shaped spacer braces having the dorsal on the top side shown as web 302*a* and two flanges 302*b* extending outward and spanning between the holes 36 at a diagonal. The hole 36 in Drawing A shows a U shaped spacer brace 302 spanning from the bottom edge of hole 36 to the upper edge of hole 36 in Drawing B. Another U shaped spacer brace 302 spans from the bottom edge of hole 36 in Drawing B to the upper edge of hole 36 in Drawing C. Each of the U shaped spacer braces 302 are wider than the width of the hole 36 and the extension 302*e* with a hook finger 127 pass through the hole 36, that is bent either upward or downward and are fastened to the web 42*a* of the support member. The configuration of the hole 36 allows for a continuous horizontal bracing member or spacer brace to pass through the hole 36 adding additional horizontal structural bracing between support members.

FIG. 10 also shows the diagonally oriented U shaped spacer braces 302 however two additional diagonally oriented U-shaped spacer braces 302 have been add plus the hole 36 could have additional horizontal spacer braces added. The diagonally oriented U-shaped spacer braces 302 have the dorsal on the top side have a web302*a* and two flanges 302*b* extending downward. The upper left U-shaped spacer brace 302 shows the an indentation 302*i* at the flanges 302*b* and at the web 302*a* leaving and extension 302*e* extend through the hole 36 and bent at the hook finger 127 upward and the right U-shaped spacer brace 302 also has the indentation 302*i* and extension 302*e* so the hook finger 127 can be bent downward and fastened together. The lower left U-shaped spacer brace 302 shows the an indentation 302*i* at the flanges 302*b* and at the web 302*a* leaving and extension 302*e* extend through the hole 36 and bent at the L-shaped hook finger 127 downward and the right U-shaped spacer brace 302 also has the indentation 302*i* and extension 302*e* so the L-shape hook finger 127 can be bent upward and fastened together. Since the L-shape hook finger 127 aligns with the flange 302*b* an indentation 302*i* occurs at the web 302*a*. Since both U shaped spacer braces 302 intersect at the same top or bottom edges of the hole 36 the extensions 302*e* and the ends of the hook finger 127 overlap each other and will become fastened together after being installed.

Figure 11:
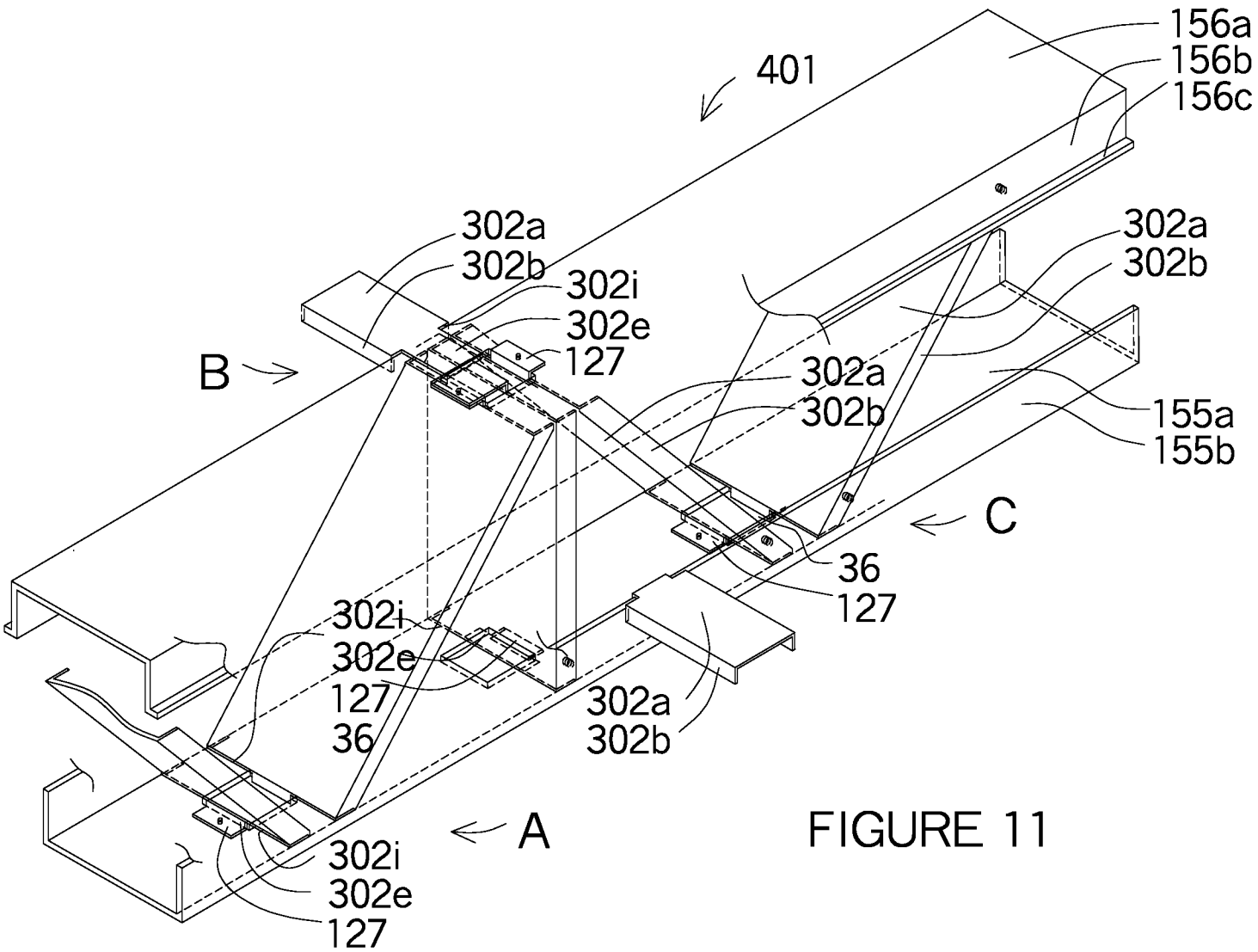
FIG. 11 shows the horizontal, diagonal spacer braces installed together to form a truss joist.

FIG. 11 is an isometric view of a horizontally oriented truss joist 401 which can be used as a window or door header shown as vertical wall framing in FIG. 10 and shown in the elevation of FIG. 1. The horizontally oriented truss joist 401 is shown having diagonally oriented U shaped spacer braces 302 span between holes 36 in the horizontally oriented support members shown as a C shaped channel 42 having a horizontally oriented web 42*a* with two vertically oriented parallel sides 42*b* with lips 42*c* extending inwardly from the parallel sides for additional strength if required. The width of the U shaped spacer braces 302 are wider than the width of the hole 36 and only the extension 302*e* and the hook shape extend through the hole 36 where the hook finger 127 braces the web 42*a* on one side and the ends of the top side 302*a* or bottom side 302*d* of the U shaped spacer brace 302 plus the ends of the two parallel sides secures the U shaped spacer brace 302 to the horizontally oriented support member. A vertically oriented U shaped spacer brace 302 (shown in ghost) are required to be wider than the diagonally oriented U shaped spacer braces 302 in order to fit around the two parallel sides 302*b* with the extensions 302*e* and the hook finger 127 fitting through the holes 36 and engaging the hole 36 at the hook finger 127 and the edges of the top sides 302*a* or bottom side 302*d* and the two parallel sides fitting against the web 42*a*. The vertical spacer brace is sometimes required to distribute the structural load forces within the truss joist.

Figure 12:
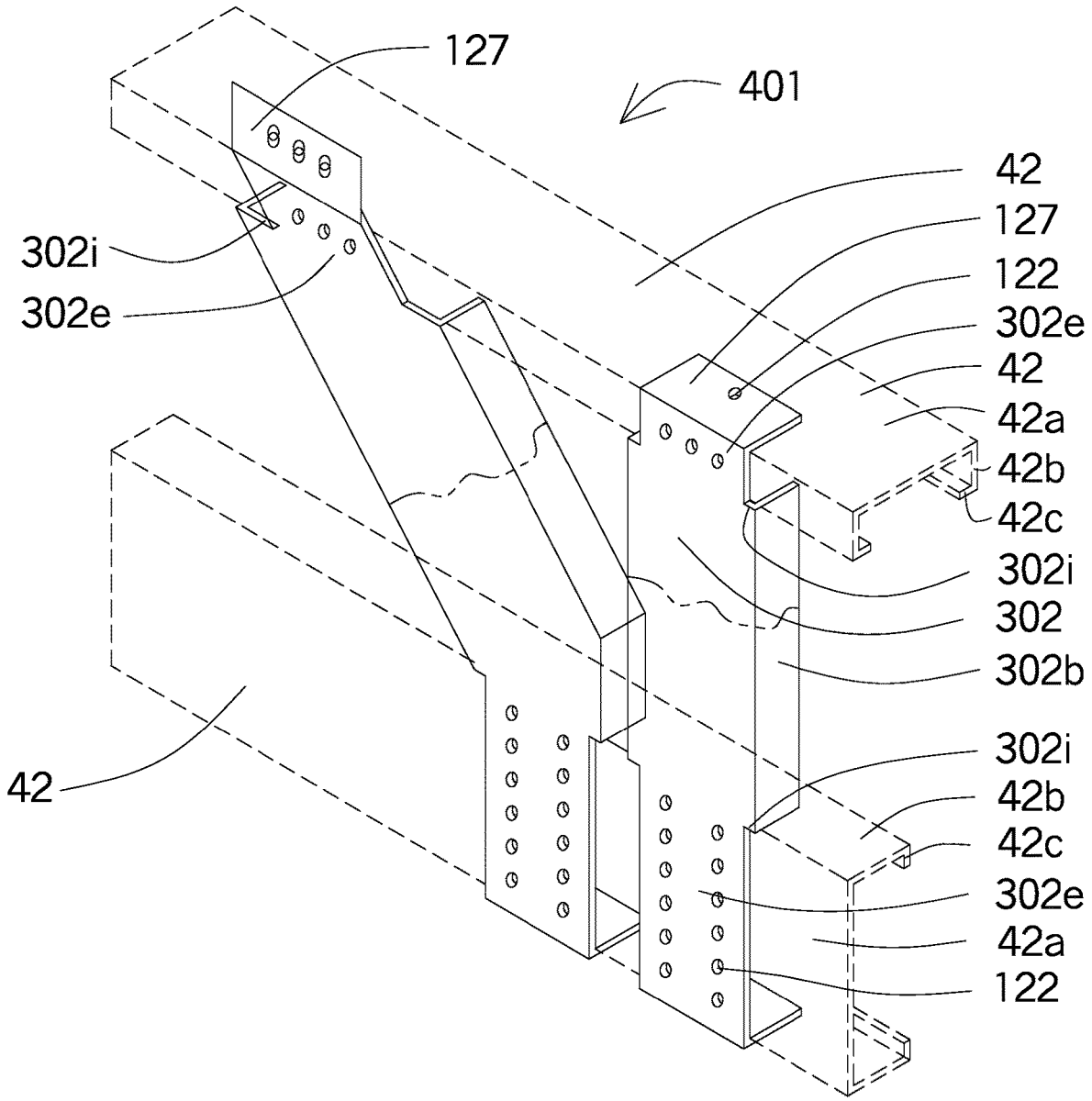
FIG. 12 shows a truss joist using metal framing where the top cord has a horizontal web and the bottom chord having a vertical web connected by spacer braces.
Figure 24:
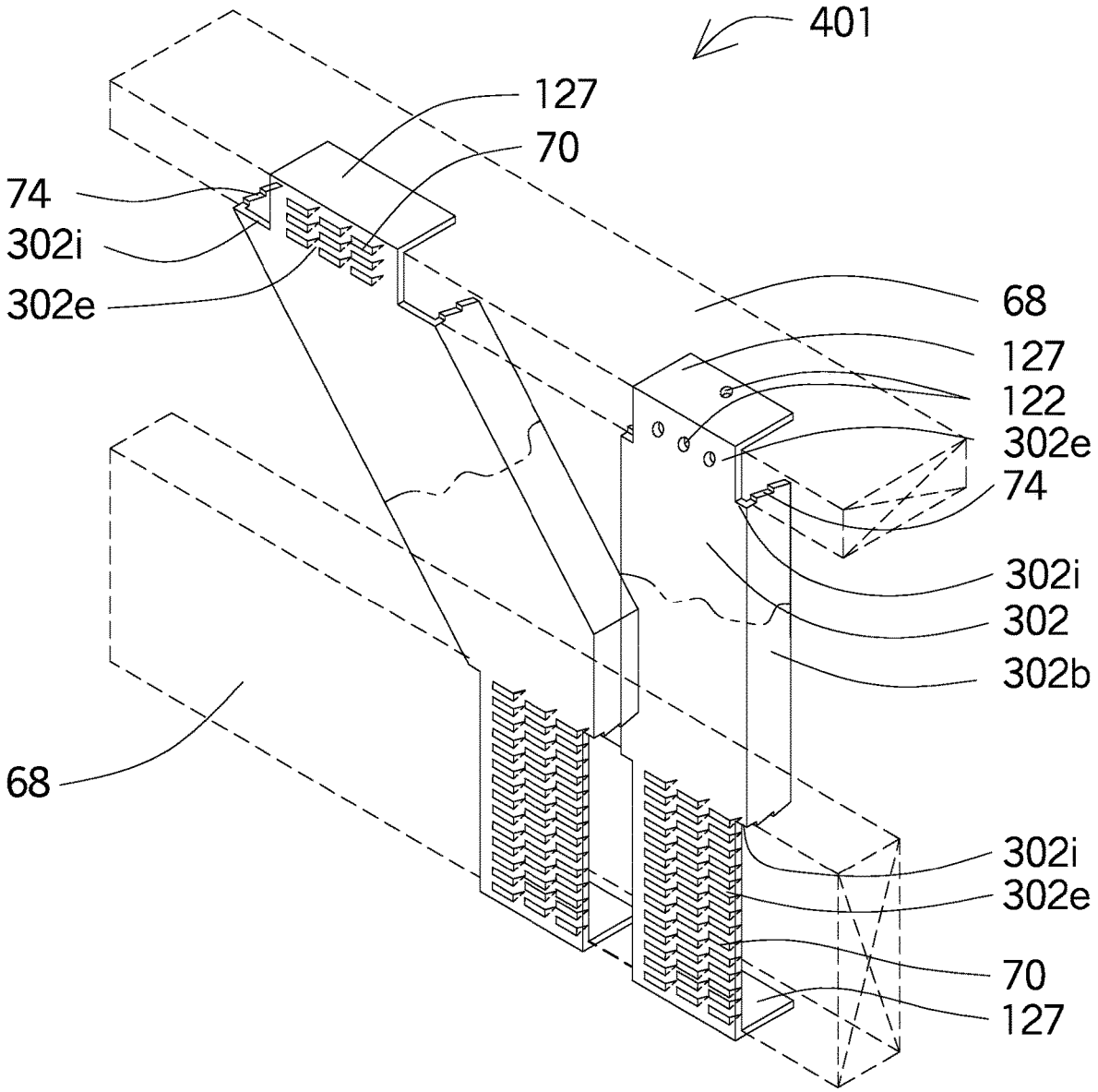
FIG. 24 shows a truss joist where the horizontal support members are wood with one spacer brace oriented vertically and the other diagonally both having jagged edges at the flanges and the punched teeth extending into the support members.

FIG. 12 is similar to FIG. 24 as they are both truss joist 401; however the FIG. 12 uses metal framing member as the support members. The top chord (shown in ghost) shows a C channel 42 with the dorsal side having a web 42*a* oriented horizontally with two sides extending vertically with lips 42*c* extend horizontally inward to each other and are parallel to the web 42*a*. The lower chord (shown in ghost) of the truss joist 401 shows a C channel with a vertical dorsal having a web 42*a* with two sides extending outwardly connected with lip extending inwardly toward each other. The U-shaped spacer braces 302 connect the top and bottom chords where the dorsal sides are vertical and have a web 302*a* with two extending sides 302*b* that abut the ventral side of the lip 42*c* of the upper chord and the top side of flange 42*b* of the bottom chord. The web 302*a* of the U-shaped spacer brace 302 has an indentation 302*i* and an extension 302*e* that extends over the upper chord flange 42*b* and the web 42*a* of the lower chord and both the hook finger 127 wraps around the chords of the truss joist 401 at the top side 42*a* of the horizontally oriented chord and the bottom side flange 42*b* of the bottom chord. The diagonally oriented spacer braces continually are placed between the top and bottom chords at repeating intervals until the truss joist 401 has reached its designated length. The left diagonally oriented U-shaped spacer brace 302 shows the top chord of the truss joist 401 having the extension 302*e* and the hook finger 127 extended parallel to the direction of the spacer braces rather than perpendicular as previously shown.

Figure 13:
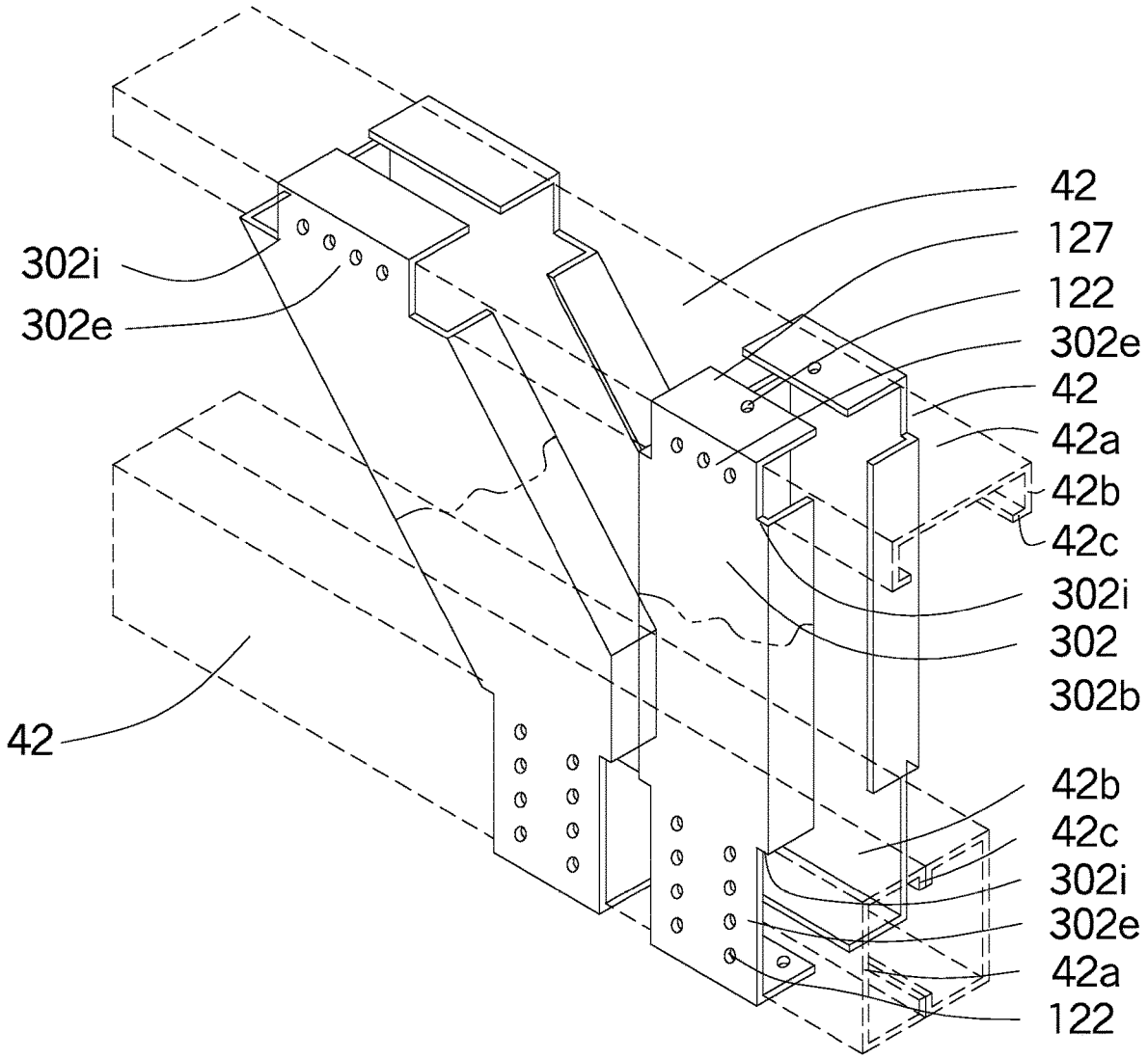
FIG. 13 shows the same configuration as FIG. 12 except two spacer braces are used in lieu of only one.

FIG. 13 is a double of FIG. 12. The lower chord (shown in ghost) has another horizontal C channel 42 adjacent to the first C channel where the lips 42*c* abut each other. Since the top chord (shown in ghost) is orientated horizontally that is the dorsal is horizontal rather than vertical, the second U-shaped spacer braces 302 can be installed as described in FIG. 12.

Figure 14:
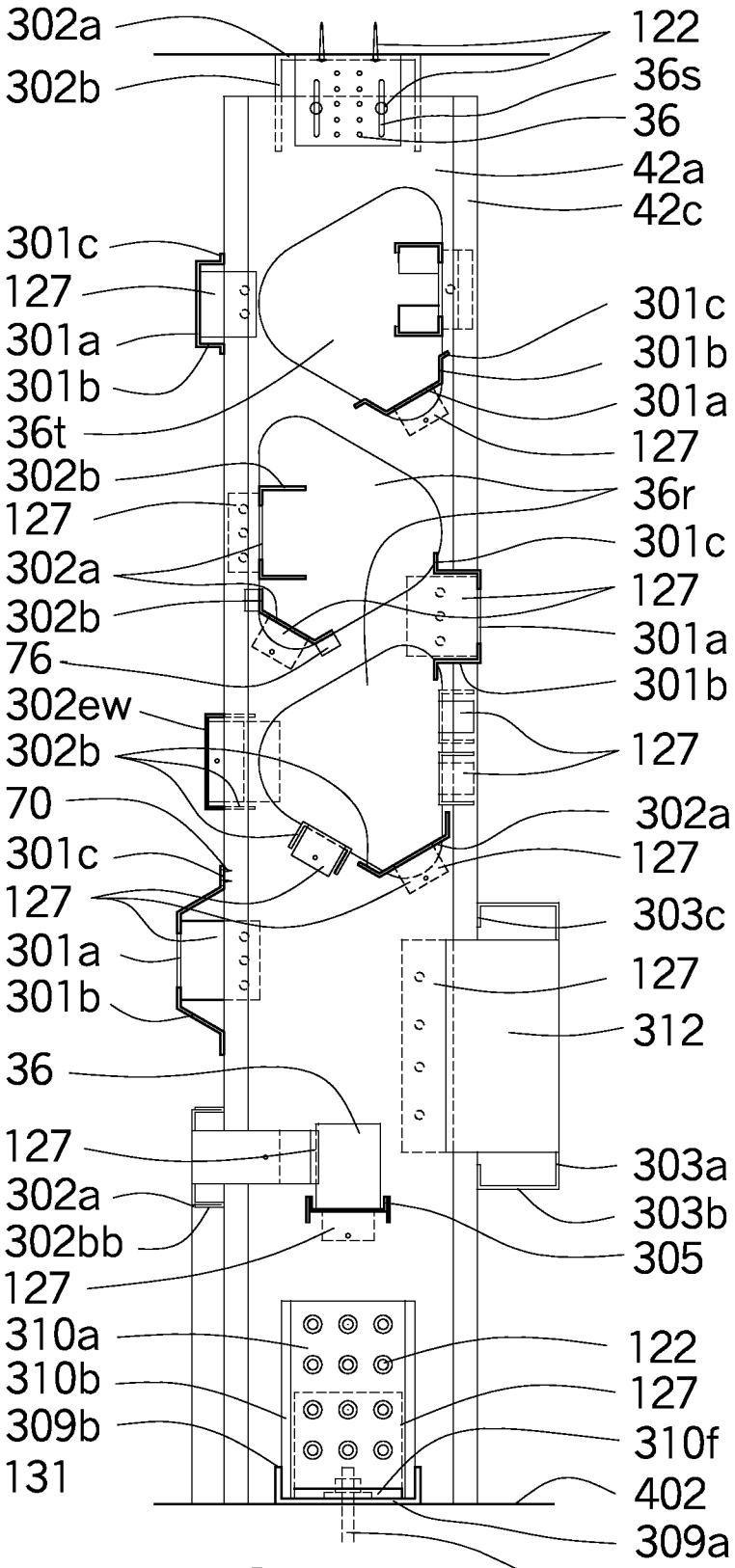
FIG. 14 shows eleven different space brace configurations each oriented differently on the vertical support member with some spacer braces passing through triangular or square shaped holes and others passing over the flanges of the support member.

FIG. 14 is a cross section through a metal framed wall showing numerous sizes and shapes of spacer braces being attached to a C channel 42. The spacer braces are oriented vertically, horizontally or at an angle and can be mounted within the hole or on the exterior surface or flange 42*b* usually secured to the web 42*a* by the hook fingers 127. The holes 36 within the web 42*a* are usually rectangular in shape, however a triangular shape hole 36*t* is also shown showing three various spacer braces in FIGS. 15-17. The U-shaped spacer braces 302 near the bottom show one U-shaped spacer brace 302 where the dorsal is oriented on the top side and the sides are extending downward while the other U-shaped spacer brace 302 the dorsal is oriented on the bottom side and the sides 302*b* are extending upward. The reverse lip spacer brace 301 on the right side of the support member is installed so the extension 301*e* (not shown) at the web 301*a* can extend over the flange 42*b* so the hook finger 127 can be connected to the web 42*a* of the support member. On the left side the reverse lip spacer brace 301 is installed so the lips 301*c* are supported at the flange 42*b*. The reverse lip spacer brace 301 also on the left by further down the wall, shows the side 301*b* at an angle like a hat channel shape. Just below is a U-shape spacer brace 302 that shows a double flange 302*bb* and the edge of the double flange 302*bb* is against the flange 42*b* of the support member. In addition, the U-shape spacer brace 302 shows a light weight line below the U-shape spacer brace 302 which references that the U-shape space brace 302 is shows the spacer brace has been installed diagonally over the support members. The hook finger 127 shown on the U-shape spacer brace 302 with the double flange 302*bb* is a hook finger 127 having an L-shape where the hook portion extends over the edge of the hole 36 as shown in FIGS. 32 & 33. The lower triangular hole 36*t* shows three U shaped spacer braces 302 one shown at an angle and two shown on the right vertical edge where one U shaped spacer brace 302 is spanning away and another is spanning forward. A C-shaped spacer brace 303 has its dorsal vertical where the lips 303*c* are installed on the flange 42*b* of the C-channel 42 with a hook finger 127 having three sides wrapped around the lip 42*c* and the flange 42*b*. The extension 303*e* does not need to be connected to the flange 42*b* of the C channel 42 since the hook finger 127 connects this end of the C-shaped spacer brace 303. The end of the hook finger 127 can have an additional two or three side add at the end of the hook finger 127 so the C-shaped spacer brace 303 must first connect the C-shape to the lip 42*c* then rotate the C shaped spacer brace 303 almost 180 degrees until the extension 303*e* is at the flange 42*b* of the adjacent support member. Also see FIGS. 30-36 where the hook finger 127 forms an L or C shape. The metal framed wall has a U-shape spacer brace 302 with its dorsal side anchored to the floor 401 with an anchor bolt assembly 354 that is connected through a hole 36 in the web 302*a*. The U-shaped space brace 302 shows the flanges 302*b* abutting the web 42*a* of the support member shown as a C channel 42. The opposing side of web 42*a* has the ventral side of the hook finger 127 mounted with fasteners to the web 42*a*. If the support member were wood framing members 68 the web 302*a* and flanges 302*b* would be similar to other previously described connections for wood construction. The floor mounted U-shaped spacer brace 302 also referred to as a hold-down spacer brace 309 can also be mounted at the top of the wall making the same connections to the support members and the horizontal plate at the top of the wall as shown in FIGS. 18-21. Some building codes require that the support members should have a gap between the top plate and the end of the top edge of the web 42*a* & flange 42*b* of the support member in order for floor joists above to deflect. When this occurs the fasteners 122 are installed in the slot holes 36*s* and the spacer brace 302 is allowed to move in an up and down motion as the web 302*a* is secured to the support member above.

Figure 15:
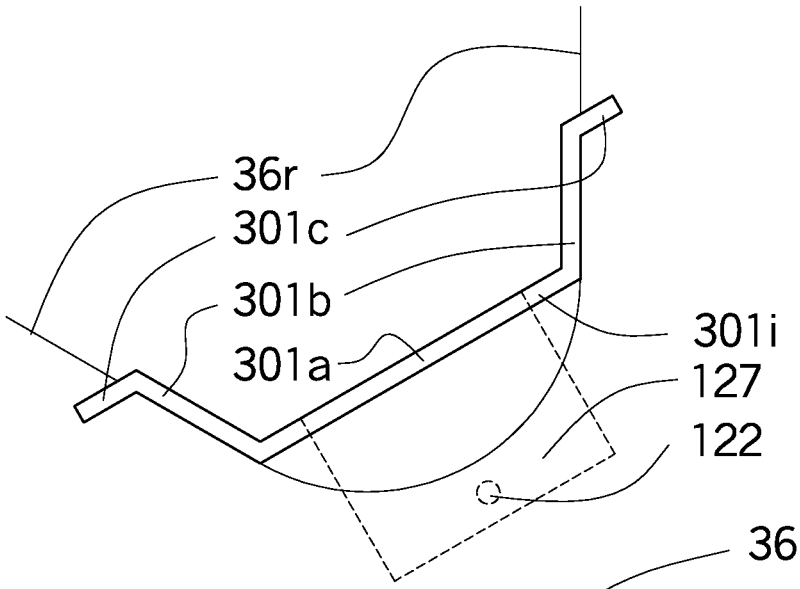
FIG. 15-17 show three different spacer brace configurations passing through the triangular shaped hole shown in FIG. 14.
Figure 16:
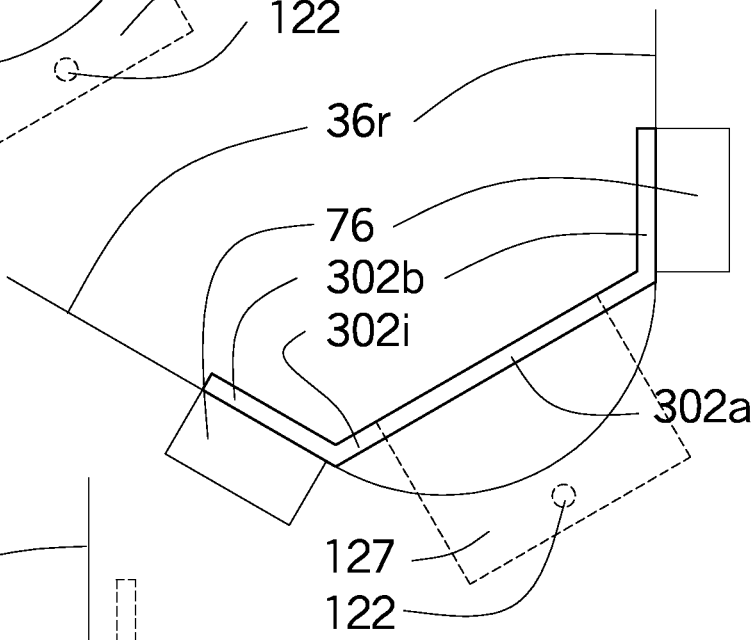
Figure 17:
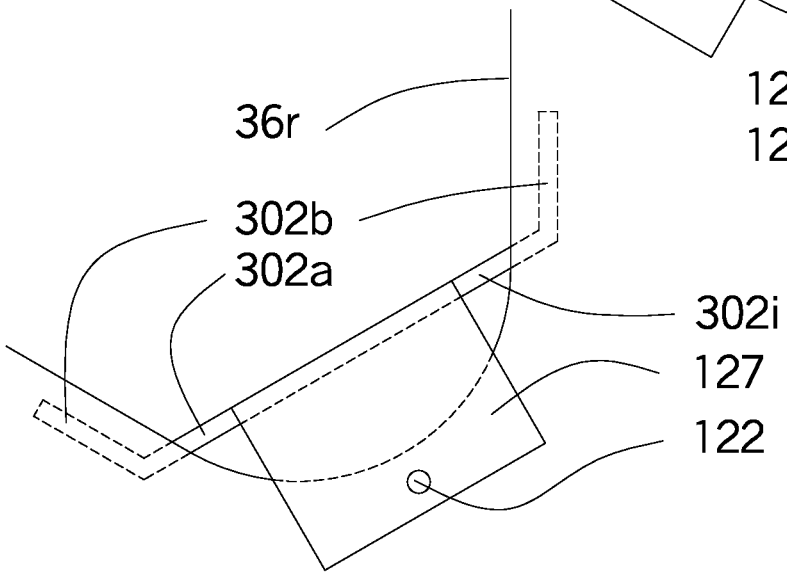

FIGS. 15-17 show three different spacer braces being connected at a triangular shape hole 36*t* shown at the web 42*a* of a C channel 42. The reverse lip spacer brace 201 shows the dorsal side at an angle so the web 301*a* and sides 301*b* can fit into the triangular shape hole 36*r*, however the lips 301*c* act as a flap 76 as shown in FIG. 16 where the ends of the lips 301*c* abut the web 42*a* on one side and the web 301*a* has an indentation 301*i* and then an extension 301*e* so the hook finger 127 can extend over to the opposite side of the web 42*a* and the ventral side of the hook tongue 128 can abut the web 42*a* and fastened by a screw 122 into the web 42*a*. FIG. 16 shows the web 302*a* and the side 302*b* extending through the triangular shape hole 36*t* and flaps 76 that extend away the angular oriented sides 302*b*. The flaps 76 are rectilinear in shape and are perpendicular to the sides 302*b*. FIG. 17 shows an elevation of the U-shaped spacer brace 302 where the hook finger 127 is fastened with screws 122 on the viewers side of the web 42*a*, the extension 302*e* is the thickness of web 42*a* of the support member and the indentation 302*i*, web 302*a* and the side 302*b* is on the opposite side of the web 42*a*. Some spacer braces are attached to the web 42*a* or by the hook finger 127. None of the holes 36 show a lip or also described as a rim (not shown) at the edge of a hole 36 in the web 302*a*. Some metal framing manufacturers leave a rim at the edge of a hole 36. The rims, holes 36, or lips 302*c* of C-shaped channels 42 can have L-shaped or U-shaped fingers on the various spacer braces as shown in FIG. 33.

Figure 18:
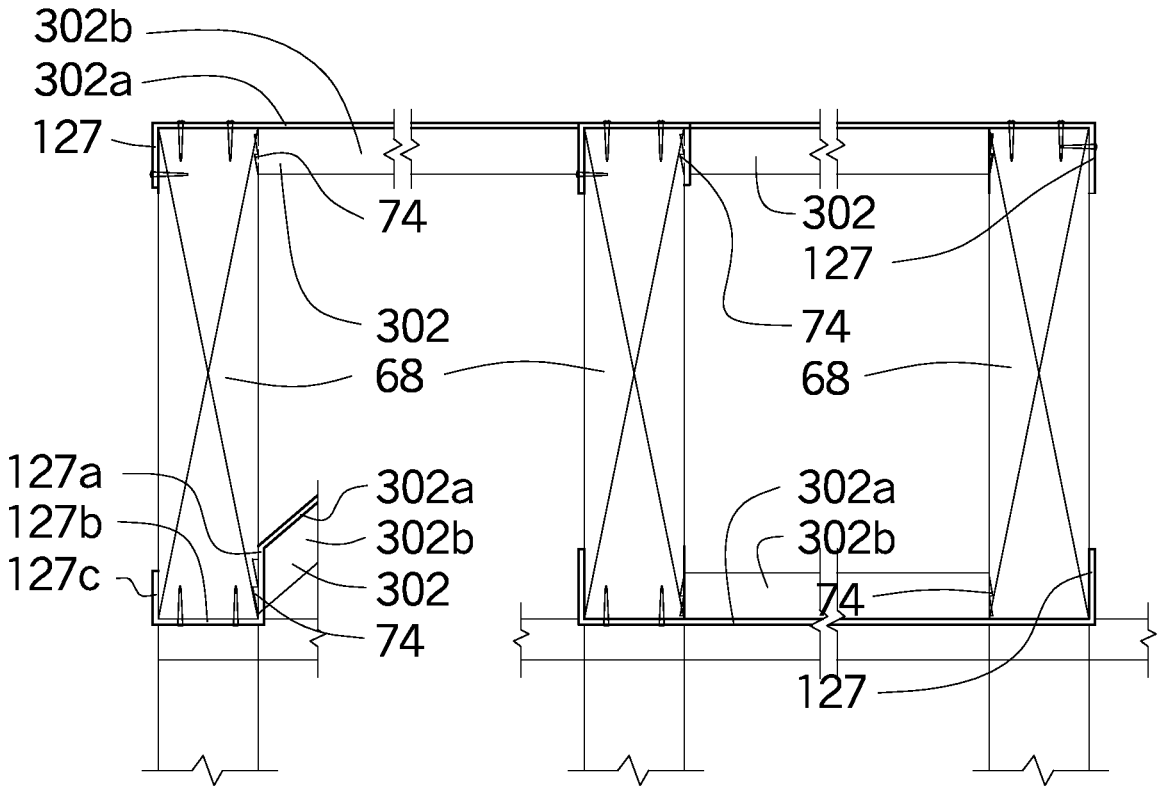
FIG. 18 shows three wood horizontal joists or the bottom chord of the truss joist where the spacer braces connect the horizontally oriented support members together either horizontally at the top or bottom edges or as a diagonal between support members.

FIG. 18 shows three wood joists as wood framing members 68 (shown with light weight lines) where the top surface of the wood framing members 68 show a U-shaped spacer brace 302 (in section) being connected together. The dorsal side is on the top side of the U-shaped spacer brace 302 and the sides 302*b* extend downwardly from the web 302*a*. The U-shaped spacer braces 302 are staggered next to each other and therefore look like the U-shaped spacer braces 302 are over lapping. The end of each side has engagement means of a hook finger 127 that engage on side of the wood framing member and the edges of the sides 302*b* abut the wood framing member on the opposing side. The edges of the sides 302*b* are shown with jagged edges 74. At the bottom of the left wood framing member 68 shows a U-shaped spacer brace 302 at a diagonal where the dorsal is on the top side shown as the web 302*a* with the flanges extending downward. The web 302*a* is shown having a hook finger 127 where side 127*a* is bent down, side 127*b* is horizontal and side 127*c* is vertical encasing the bottom side of the wood framing member 68 on three sides. In addition, the flanges 302 from the U-shaped spacer brace 302 have jagged edges that extend into the wood framing member 68. On the right side shows the same U-shaped spacer brace 302 that is on the top side of the wood framing members 68, however the web 302*a* with its extension 302*e* on the ventral side at the bottom edge of the wood framing members 68 and the flanges 302*b* and hook finger 127 are extending upward.

Figure 19:
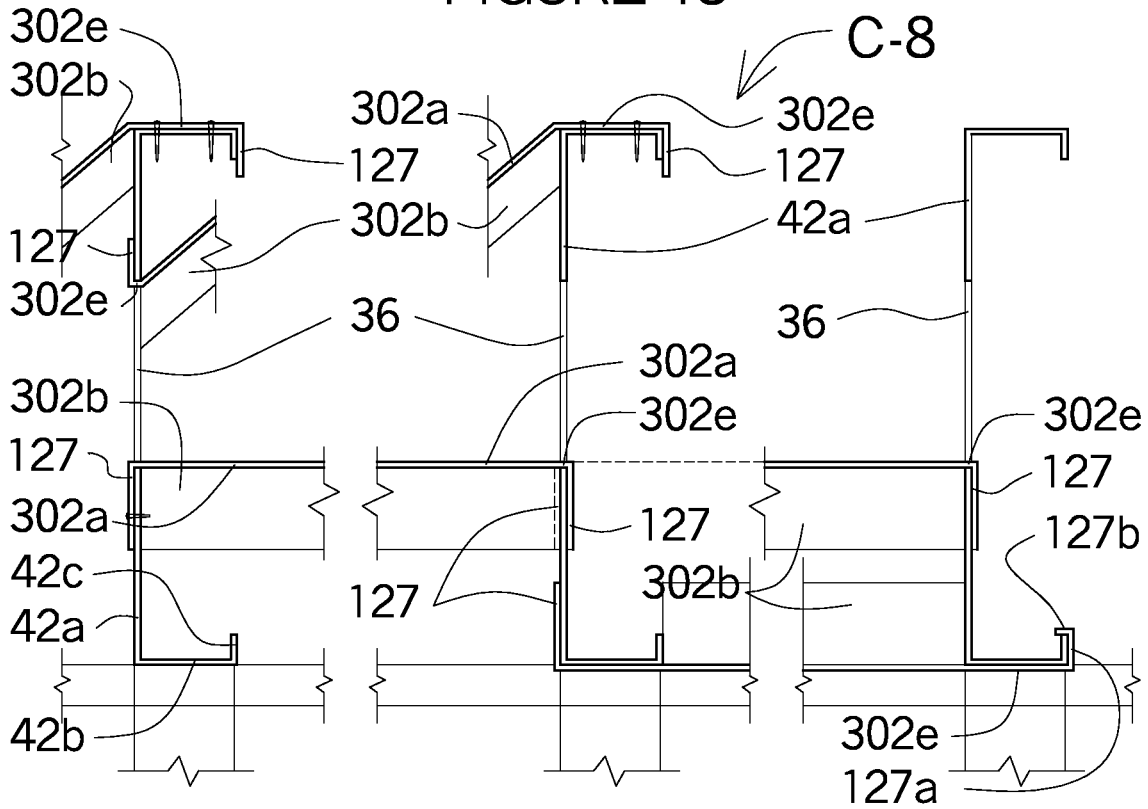
FIG. 19 shows three horizontally oriented metal support members being connected at the top, bottom or through the holes of the support members as well as being connected diagonally.

FIG. 19 shows three horizontal support members as C channels 42 having a vertical dorsal as a web 42*a* with two horizontally extending flanges 42*b* and with lips 42*c*. The left support members shows a diagonally oriented dorsal of U-shaped spacer brace 302 having the top side as a web 302*a* with extending downward flanges 302*b*. The extension 302*e* that extends from the web 302*a* is bent at angle parallel to the flange 42*b* and bent at the hook finger 127 over the lip 42*c*. An diagonally oriented U-shaped spacer brace 302 is shown connecting the left C channel 42 to the middle C channel 42 at the top edge of the hole 36 in the web 42*a* of the C channel 42. The diagonally oriented U-shaped spacer brace 302 has the dorsal on the top side shown as the web 302*a* with the extension 302*e* passing through the upper edge of the hole 36 for the hook finger 127 to be bent upward and secured to the web 42*a* of the support member. The left C channel 42 shows a horizontally oriented U-shaped spacer brace 302 having the dorsal on the bottom side where the web 42*a* is horizontal and the flanges 42*b* are extending upward. The web 302*a* has the extension 302*e* passing through the bottom edge of the hole 36 and the hook finger 127 extends downward over the web 42*a*. The middle and the right horizontal support members have a hole 36 at the bottom edges of the hole 36. A U shaped spacer brace 302 is shown spanning between the adjacent horizontally oriented support members where the web 302*a* has the dorsal side facing upward with the flanges 302*b* extending ventrally downward where the right side has the ends of the flanges 302*b* abut the web 42*a* of the support member with the extension 302*e* extending into and over the hole 36. The hole 36 is large enough so two U shaped spacer braces 302 can pass through the same hole, however the U shaped spacer braces are aligned adjacent to one another and therefore alternate between support members forming a checkerboard pattern. The same is true should the U shaped spacer brace 302 want to be installed diagonally that is one end attached at the bottom edge of the hole 36 and the opposite end attached at the top of the support member. This type of arrangement again requires a larger size hole 36 so two U shaped spacer braces 302 could be installed on the bottom edge of the hole 36. At the bottom of the C channel 42 a U shaped spacer brace 302 where the extension 302*e* passed over the flange 42*b* and the first leg 127*a* of the hook finger 127 is bent over the lip 42*c* with the second leg 127*b* extending over the edge of the lip 42*c* with the flanges 302*b* abutting the web 42*a* of one support member and the lip 42*c* of an adjacent C channel 42 with the opposite end having the extension 302*e* extend under the flange 42*b* and bent upward forming the hook finger 127 abutting the web 42*a* of the second C channel 42.

Figure 20:
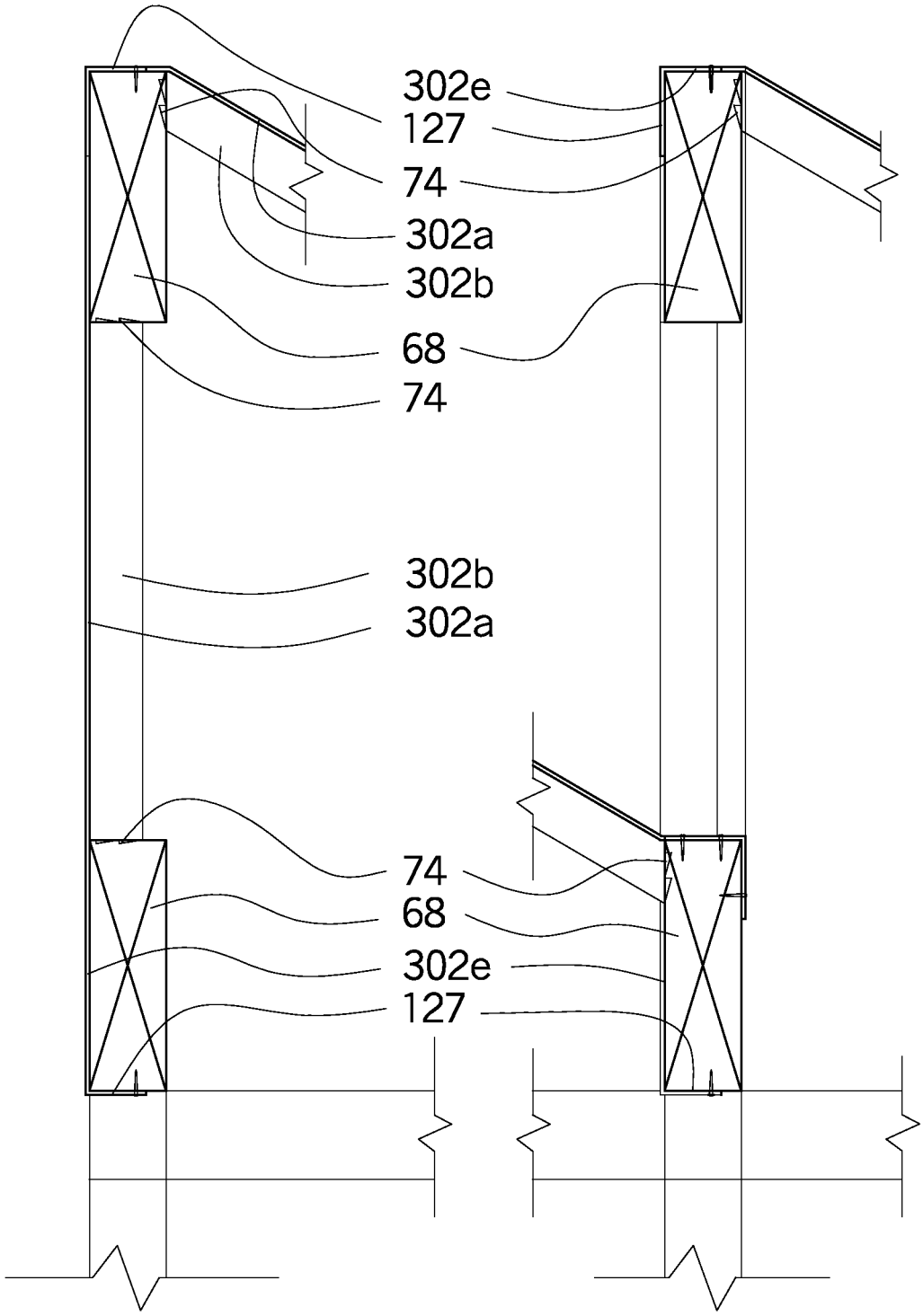
FIG. 20 shows a cross section or a wood truss joist having spacer braces connecting the top and bottom chords of the truss joist and the spacer braces used as horizontal or diagonal lateral bracing between truss joists.

FIG. 20 shows a truss joist where the support members are shown as wood framing members 68. The wood bracing members 68 can be parallel or angular like a scissor truss. The left truss joist shows the U-shaped spacer brace 302 in section where the web 302*a*, extension 302*e* and hook finger 127 are shown darker as well as the wood framing member 68. The U-shaped spacer braces 302 can be angular parallel to the wood framing members 68. The right truss joist shows the U-shaped spacer braces 302 in elevation with the wood framing members 68 shown in section. Diagonal lateral bracing is shown between the two truss joists as the U-shaped spacer brace 302 where the extension 302*e* is bent to form to the angle of the wood framing members 68 and bent again at the hook finger 127. The U-shaped spacer braces 302 shown in FIG. 20 can be used to connect the truss joists.

Figure 21:
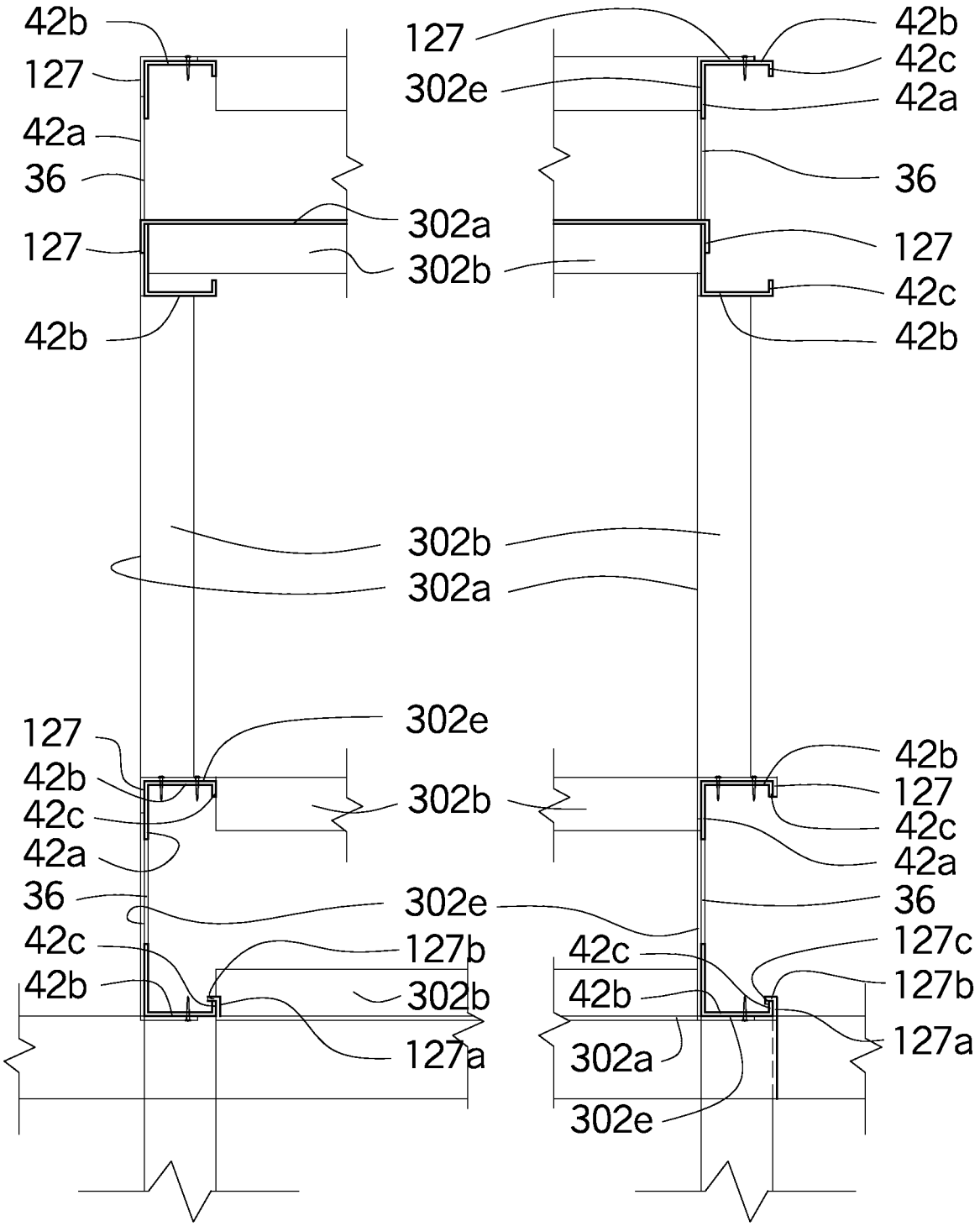
FIG. 21 shows a similar cross section of a truss joist as FIG. 20 however the horizontal support members are vertical oriented metal members with the spacer braces being the vertical or diagonal chords or the lateral bracing between the truss joists.

FIG. 21 shows two truss joists where the support members are C channels 42 where the web 42*a* is oriented vertically with the flanges 42*b* extending horizontally and the lips 42*c* are vertical extending inward to each other. The support members are located on the top and bottom chord of each truss joist with U-shaped spacer braces 302 are installed vertically and diagonally between support members as shown in FIGS. 10, 12, 14 & 15 where the flanges 302*b* abut the flanges 42*b* and the webs 302*a* have an extension 302*e* that extends over the web 42*a* with hook fingers 127 extending over the top and bottom flanges 42*b* of the support member. Three U-shaped spacer braces 302 are shown horizontally between truss joists and are used as lateral bracing between the truss joists. At the top and bottom chords a U-shaped spacer brace 302 is shown where the dorsal is on the top side and the flanges 302*b* extend downward with their vertical edges abutting the lip 42*c* and web 42*a*. The webs 302*a* have an extension 302*e* extend over the top flanges 42*a* some secured directly into the flanges 42*b* while others have the hook finger 127 extend over the webs 42*a* and or lips 42*c*. The U-shaped spacer braces 302 can be installed diagonally between the top and bottom support members or diagonally along the top or bottom chords along the flanges 42*b* when the truss joists are installed in an array. A third U-shaped spacer brace 302 that is oriented downward is installed in the hole 36 at the web 42*a* of the C channel 42 used as the support member. The edges of the flanges 302*b* abut the webs 42*b* with an extension 302*e* passing through the hole 36 and the ventral side of the hook fingers 127 abut the web 42*a* on the opposite side of the web 42*a* from the flanges 302*b*. At the bottom of the truss joists a U-shaped spacer brace 302 also referred to in the building trades as the top plate which connects the vertical support members similar to the U-shaped spacer brace 302 shown at the floor in FIG. 16 to the top end of the support members. Since the U-shaped spacer brace 302 is upside down the dorsal side is abutting the truss joists and the hook fingers 127 are resting on the dorsal side. The right side shows a hook finger 127 with a U-shape having the first leg 127*a* extend from the extension 302*e* ventrally upward against the lip 42*c* extending over the top edge is leg 127*b* then leg 302*c* extends over the back side of the lip 42*c* of the lower horizontal chord of the truss joist while the left hook finger 127 has the first leg 127*a* extend upward from the web 302*a* against the lip 42*c* then extend over the top edge of the lip 42*c* forming an L-shape that is also wrapped around the lip 302*c* of the adjacent lower horizontal chord of the truss joist. The fingers of the top plate can also just be hook finger 127 connecting the webs 42*a* of the bottom horizontal chord. Another option is have one U-shape spacer brace 302 attach to the support members of the wall framing members and another U-shaped spacer brace 302 attach to the truss joist where the webs 302*a* or each U-shaped spacer brace has their dorsal side attached back-to-back where one set of flanges 302*b* extend downward and another set of flanges 302*b* extend upward. A U-shaped spacer brace 302 is shown at the top of the truss joists.

FIG. 22 has a U-shaped spacer brace 302 that is installed with the web 302*a* in a vertical orientation and installed with the ventral side installed over the vertically oriented wood framing members 68. In FIG. 22 the U-shaped spacer brace 302 is shown as an independent spacer brace connected between two support members. The web 302 has two flanges 302*b* extending outwardly with jagged edges 74 at the ends of the flanges 302*b* that penetrate into the wood framing members 68 and the webs 302*a* have indentations 302*i* and an extensions 302*e* that extends over the surface of the extension 302*e* on both wood framing members 68 and the hook finger 127 of the spacer brace 302 is bent parallel to the angle of the wood framing member which is typically 90 degrees. In this figure the web 302*a* is oriented vertically so the ventral side of the U-shaped spacer brace 302 is against the vertically oriented wood framing members 68 and the ventral side of the hook finger 127 abuts the side edges of the wood framing member 68. Fasteners are secured through the extensions 302*e* and the hook fingers 127 to secure the wood framing members 68. Punched hole teeth 70 are shown on the dorsal side of the extension 302*e* in the U-shaped spacer brace 302 so the teeth 70*t* for the punched hole 70*h* can penetrate the wood framing member 68. In addition, the hook finger 127 on the right side of FIG. 22 can have bumps, abrasions or any other means to create friction between the ventral side of the hook finger 127 at the wood framing member 68.

Figure 23:
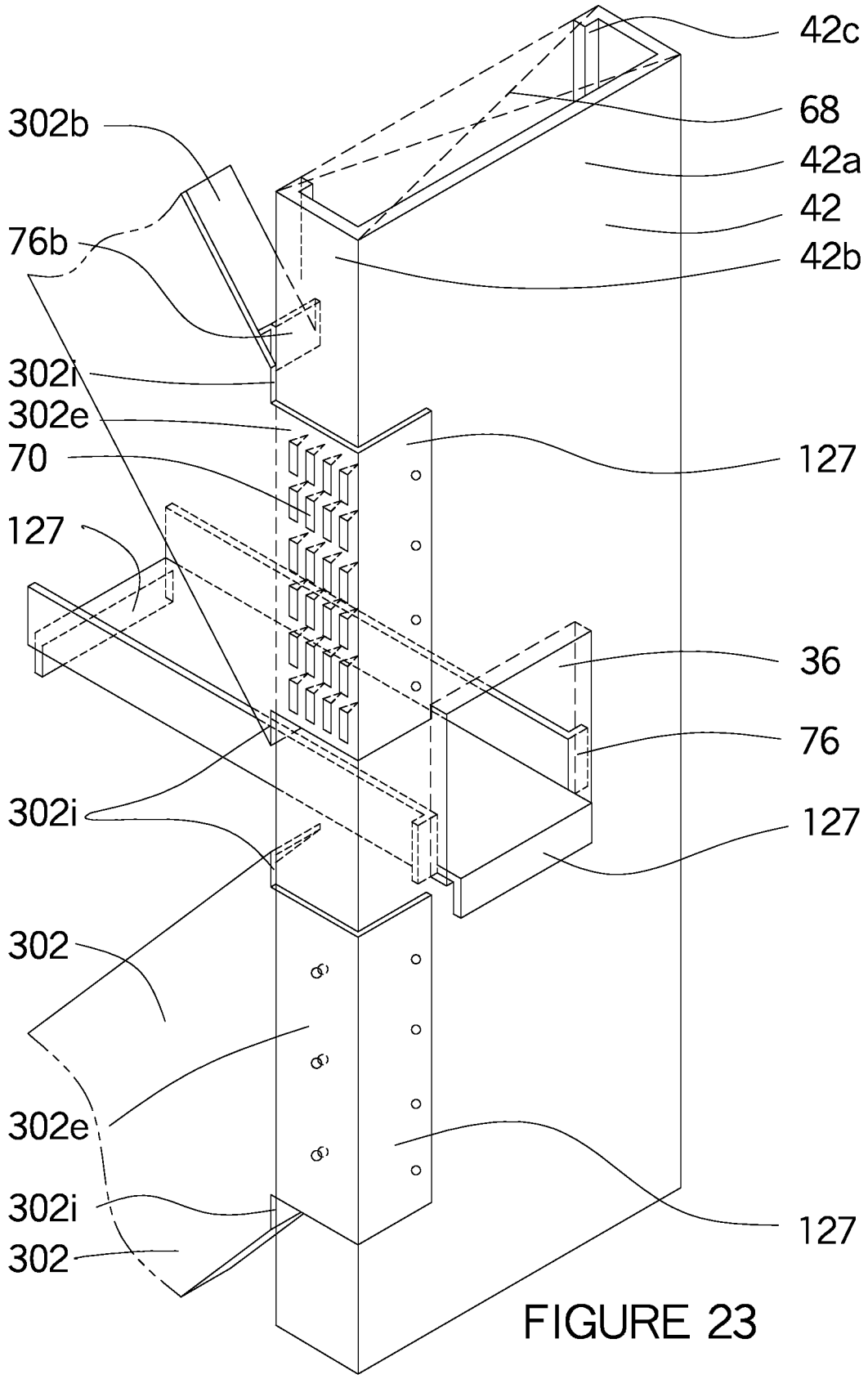
FIG. 23 shows both a wood and C channel as the support member with one diagonal spacer brace being attached by fasteners and other spacer brace with its jagged edges at the flanges and punched teeth extending from the web into the support member along with a horizontally oriented spacer brace passing through the hole of the support member.

FIG. 23 shows an isometric view of a vertical support member either a C channel 42 or a wood framing member 68. Two diagonal framing members both shown as a U-shaped spacer brace 302 where the dorsal side is shown as a vertical orientation with the web 302*a* extending over the flange 42*b* of the C channel 42. The upper U-shaped spacer brace 302 is shown for a wood framing member 68, with the extension 302*e* showing the punch hole teeth 70. The diagonally oriented flanges 302*b* are shown with a bent flap 76*b* that extends longer and reinforces the flanges 302*b* and the extension 302*e* extends onto one side of the wood framing member 68 and the hook finger 127 extending over the opposite side of the wood framing member 68. The downward diagonally oriented U-shaped spacer brace 302 is shown with fasteners extending into the flange 302*b* and web 302*a* of the C channel 42. Between the two diagonal U-shaped spacer braces 302 is a horizontally oriented U-shaped spacer brace 302 shown in FIG. 22.

Figure 25:
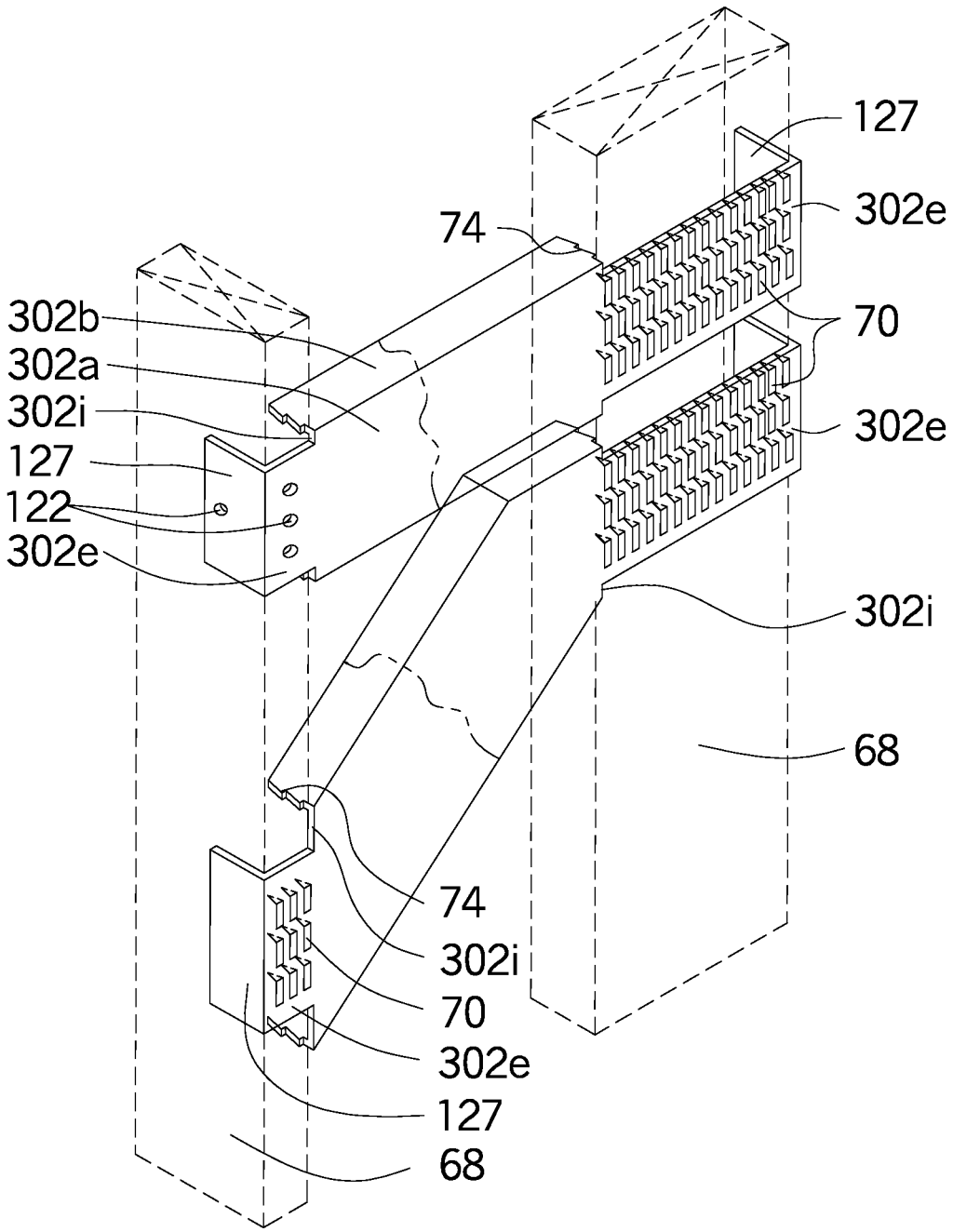
FIG. 25 shows a similar configuration as FIG. 24 except the wood support members are oriented vertically and the diagonal spacer brace is bent so the hook finger is perpendicular to the support member.

FIG. 24-25 are similar except in FIG. 24 the wood framing members 68 are shown as horizontal support members to form truss joists 401 that are shown in C-8 in FIG. 1. Truss joists 401 are typically joists that have a horizontal top and bottom chord (shown in ghost) shown as wood framing members 68 and diagonal chords connect the top and bottom chords shown in FIGS. 24 & 20 as U-shaped spacer braces 302. In FIG. 25 the wood framing members 68 (shown in ghost) are vertical support members for a wood framed wall and the U-shaped spacer braces 302 are used as lateral and diagonal bracing between the support members. The wood support members 68 in FIG. 24 are shown parallel to each other for a floor joist, however if the top member was at an angle a triangular truss could be formed using different length U-shaped spacer brace 302. Since the truss joist 401 are designed to have only one top and bottom chord, the U-shaped spacer braces 302 are independent braces where the dorsal side of the hook finger 127 is vertical and the sides 302*b* extend outwardly from the web 302*a* where the top and bottom ragged edges 74 engage to wood framing members and the web 302*a* is indented 302*i* and the extension 302*e* with the punched hole teeth 70 penetrate the wood framing member 68 and the hook finger 127 wraps around the top or bottom side of the wood framing members 68. Screws 122, nails or the punched hole teeth 70 can be used to connect the spacer braces to the wood framing members 68. FIG. 25 shows the same configuration as FIG. 24 except the wood framing members 68 are oriented vertically. The web 302*a* is oriented vertically and the sides 302*b* extend ventrally horizontally or diagonally away from the web 302*a*.

When the wall construction is oriented vertically the diagonal oriented U-shaped spacer braces 302 are now typically referred to in the building industry and diagonal bracing which is used to reduce horizontal forces such as wind against a building and the horizontal oriented spacer braces are referred to as lateral bracing. These spacer braces or any of the spacer braces described can be U-shaped, C-shaped or C-shaped where the lips extend outward on the dorsal side of a U-shaped spacer brace 302. When the spacer braces are installed diagonally above a door or window the spacer braces are referred to as beams. These beams can have a truss like construction as shown in FIG. 1 can act like a truss as shown in C-7.

Figure 26:
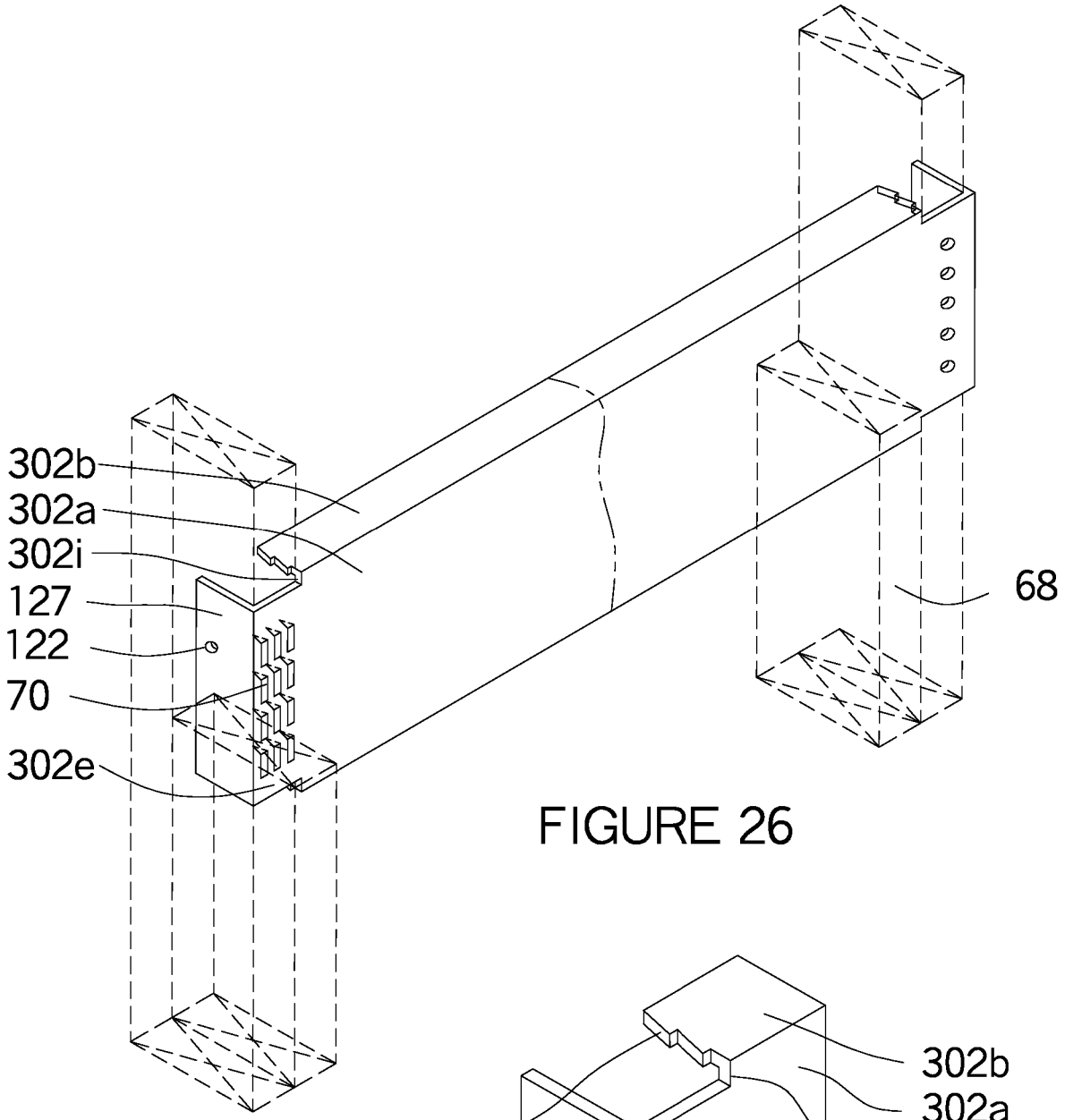
FIG. 26 shows the spacer brace as a beam connecting between support members with cripple type support member defining the window or door opening.
Figure 27:
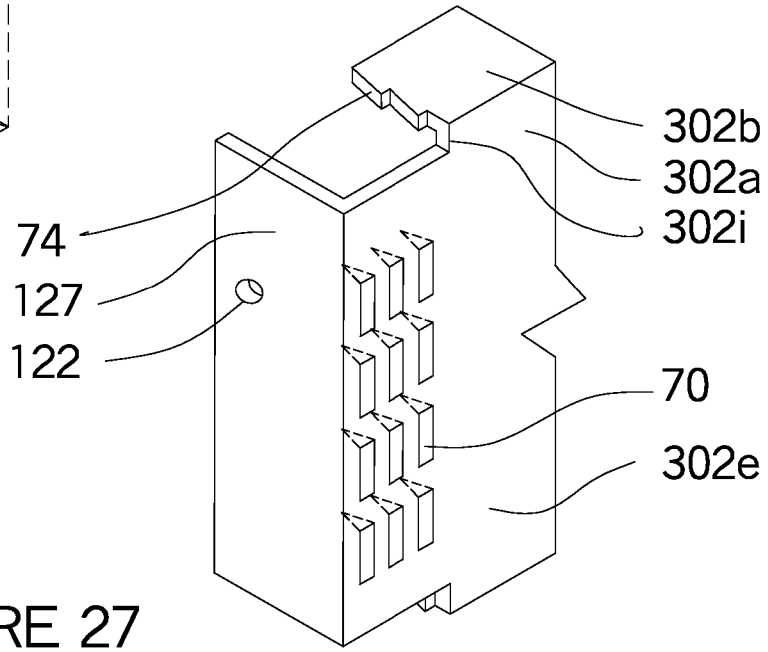
FIG. 27 shows an enlargement of the punched hole teeth at the extension and the jagged edges at the flange ends.

FIG. 26-27 shows the dorsal of a U-shaped spacer brace 302 vertically oriented and spanning between wood framing members where the wood framing member 68 have a tall member and a short member (typically called a cripple within the construction industry) which usually indicates a wood framed opening for beam. The beam is shown having the dorsal vertically oriented with the ventral side of the web 302*a* and the extension 302*e* abutting the outer surface 68*a* with the hook fingers 127 connected to the inner sides of the wood framing members 68. Both ends of the U-shaped spacer bars 302 are connected to the taller member of the wood framing members 68. The extensions 302*e* on the left side show the punched hole teeth 70 extending from the dorsal side into the wood framing members 68 and the right end shows holes 36 on the extensions 302*e* and hook finger 127. The jagged edges 74 are shown at the ends of the sides abutting the wood framing members 68.

Figure 28:
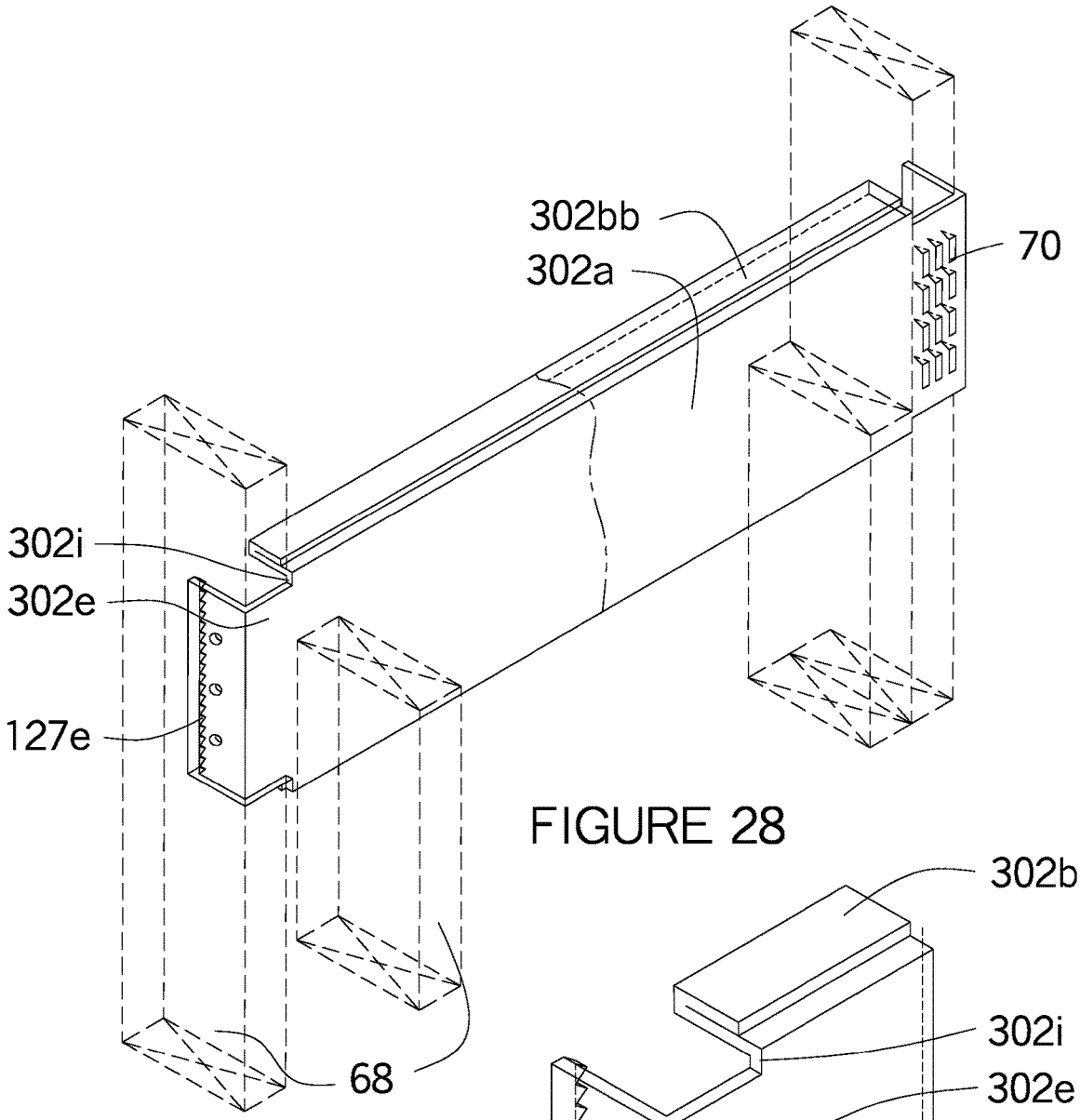
FIG. 28 shows the beam with jagged edges at the end of the finger and the double flange.
Figure 29:
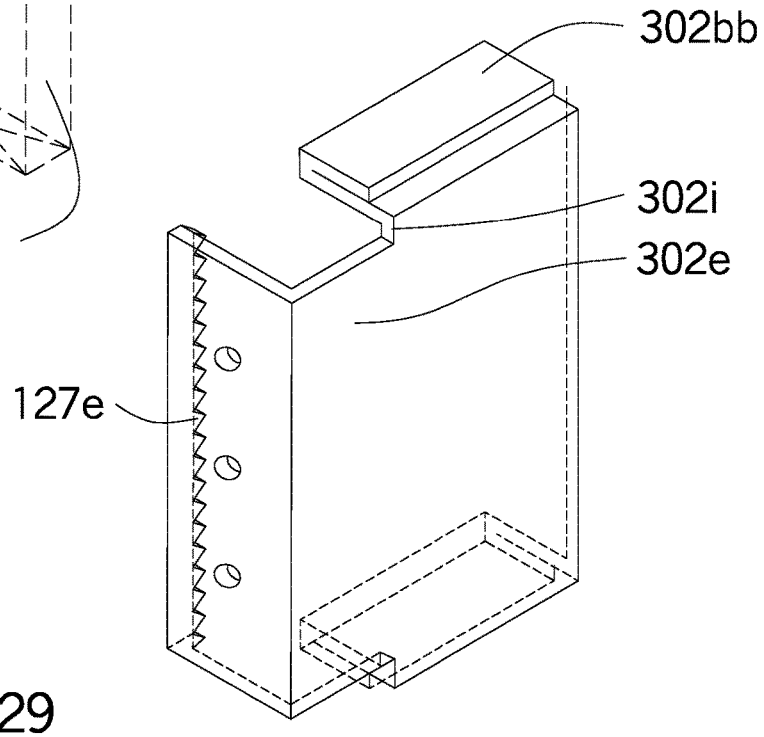
FIG. 29 shows an enlargement of FIG. 28 at the connection of the framing member.

FIG. 28-29 are similar to FIGS. 26 & 27, however the sides have a double flange 302*bb* and the hook finger 127 has an abrasive edge 127*e*.

FIG. 30-31 are similar to FIG. 26 except the vertical oriented support members are C channels 42 having a web 42*a* with extending flanges 42*b* and lips 42*c* extending inward. FIG. 30 shows the hook finger 127 on the right end of the U shaped spacer brace 302 having the first leg 127*a* abut the lip 42*c* then abut against the edge of the lip 42*c* then turn again so the third edge is on the backside of the lip 42 forming a U-shaped that wraps around the lip 42*c* of the C channel 42. To install the U-shape spacer brace 302, one aligns the right end of the U-shape at the hook finger 127 to be parallel to the lip 42*c*. Once the U-shape of the hook finger 127 is engaged at the lip 42*c*, the U shaped spacer brace 302 is rotated 90 degrees toward the vertical oriented support members on the opposite end of the metal framed opening for the beam. The extension 302*e* and hook finger 127 are then connected by fasteners to the opposing metal support members. FIG. 31 shows the enlargement of the U-shape configuration of the hook finger 127.

FIG. 32-33 are similar to FIGS. 30 & 31 as the right end of the U-shaped spacer brace 302 has the U-shape at the hook finger 127, however the U-shaped spacer brace 302 rotates 90 degrees the left side has the flanges 302*b* abut the lip 42*c* with the extension 302*e* fitting over the flange 302*b* and the first side 127*a* of the hook finger 127 extends over the web 42*a* and the second side 127*b* extends into the hole 36 in the web 42*a* of the C channel 42 being the support member for the metal framed beam opening. FIG. 33 shows an enlargement of right end of the hook finger 127 attached to the extension 303*e* of a C shaped spacer brace 304 and shows flaps 76 turned ventral inward from the flanges 303*b* that would rest against the web 42*a* if they were shown in FIG. 32.

Figure 34:
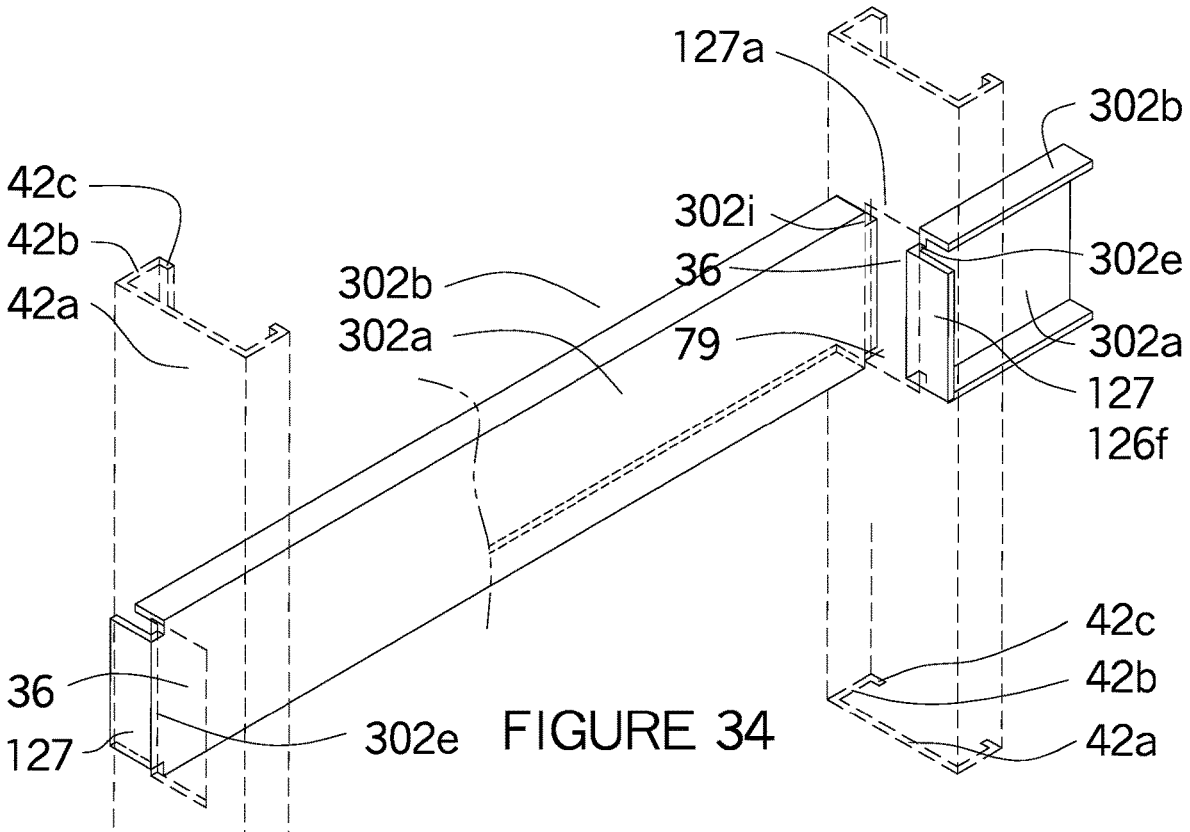
FIG. 34 shows an isometric view of two vertically oriented spacer braces installed on opposite sides of the same hole in a vertical oriented support member.

FIG. 34 is an isometric view of two vertically oriented U shaped spacer braces 302 installed horizontally between the holes 36 of adjacent vertical support members so the U shaped spacer braces 302 are installed alternating between the vertical side edges of the holes 36 by allowing each hole 36 to have one U shaped spacer brace 302 spanning between adjacent U shaped spacer braces on the right side on the rear vertical side edge of the hole 36 and between the adjacent U shaped spacer brace on the left side on the front vertical side edge of the hole 36 allowing the U shaped spacer braces 302 to be staggered between the front and rear vertical sides edges of the holes 36. The vertical support member is shown as a C channel 42 having a vertical web 42*a* with flanges 42*b* extending ventrally out from the web 42*a* with lips extending ventrally inward parallel to the web. The U shaped spacer braces 302 have webs 302*a* where the dorsal sides face inward with the ventral sides facing the vertical side edges of the holes 36 and the ventral sides have flanges 302*b* extending from the web 302*a*. One end of the U shaped spacer braces have the ends of the flanges abut the web 42*a* of the vertical oriented support member. The flanges 302*b* and the web 302*a* has an indentation 302*i* with an extension 302*e* that extends over the web 42*a* at the hole 36 so a hook finger 127 can have the first side 127 extend ventrally over the bottom edge of the hole 36. The opposing end of the U shape spacer brace has its flanges 302*b* abut the web 42*a* at the hole 36 of the adjacent support member so the flanges 302*b* engage the web 42*a*. The end of the flanges 302*b* abut the web 42*a* so a hook finger 127 can extend ventrally over the web 42*a* of the adjacent support member also shown in the enlarged FIG. 35. When the hook finger 127 of the opposing end of the U shaped spacer brace 302 is secured, the U shaped spacer brace 302 is rotated toward the hole 36 so the edges of the flanges 302*b* engage the web 42*a* and the hook finger 127 extends over the side edge of the hole 36 securing the U shape spacer brace 302 to the side edge of the hole 36. Another U shaped spacer brace 302 can be installed on the opposite vertical side edge of the hole 36. The top and bottom edges of the hole 36 can also have the U shaped spacer braces 302 have the dorsal sides oriented horizontally through the holes 36 of adjacent support members which was explained above and previously shown in FIGS. 7-11. Fastener 122 can be installed at the hook finger 127, but are optional depending on the structural stress exerted on the holes.

Figure 36:
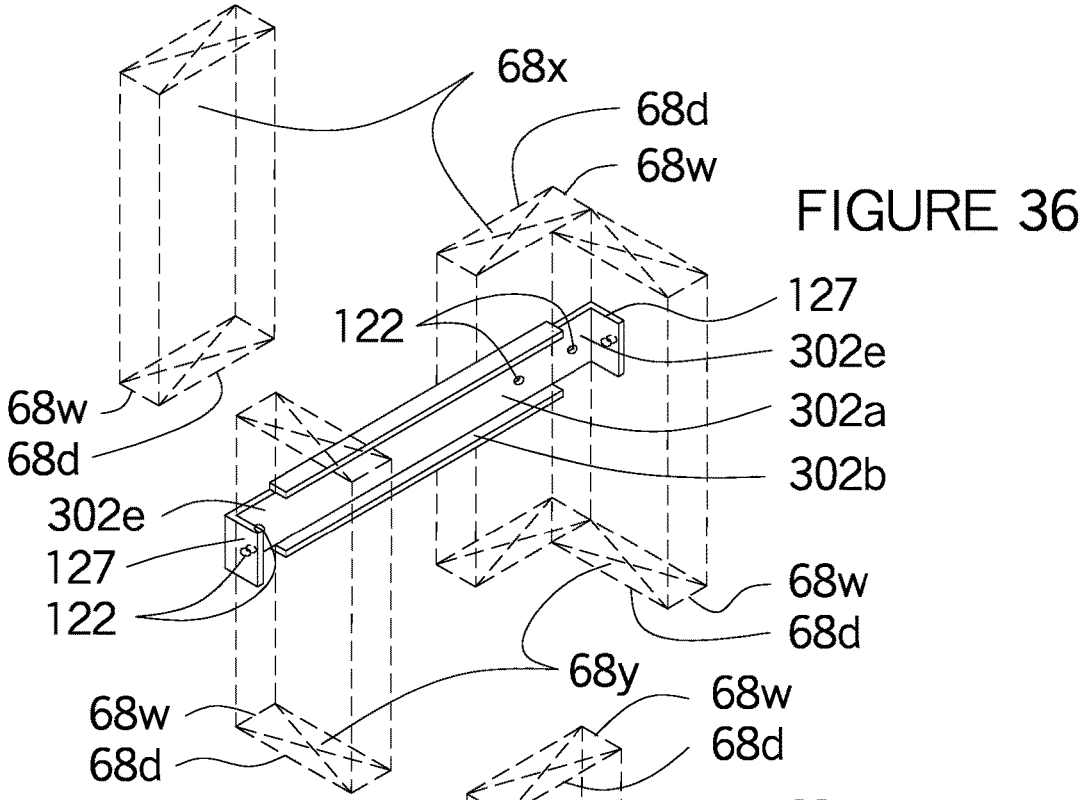
FIG. 36 shows an isometric view of a spacer brace at the intersection of an outside corner using wood support members.

FIG. 36 shows a U shaped spacer brace 302 installed horizontally between the vertical support members shown as wood support members 68 and oriented in a Y direction and referred to as wood studs 68*y*. The U shaped spacer brace 302 has a web 302*a* oriented vertically with the flanges extending ventrally horizontally from the web 302*a*. At both ends the web 302*a* has an extension 302*e* where the ventral side extends over the width side 68*w* of the wood support member 68 of the wood studs 68*y*. The flanges 302*b* of the U shaped spacer brace 302 abut the depth side 68*d* of the wood support member 68 and the hook finger 127 is bent to align with the depth side 68*d* on the opposite side of the support member. Fasteners 122 can be installed on the hook fingers 127 into the depth side 68*d* or at the extensions 302*e* into the width side 68*w* of the wood studs 68*y*. The U shaped spacer brace 302 is shown oriented in a Y direction, however another set of wood studs 68*x* are oriented in an X direction referred to as 68*x*. When constructing a wood framed building, a corner of a building is formed when wood studs 68*x* are oriented in an X direction and another group of wood studs 68*y* are installed in a Y direction. The isometric drawings shows a corner intersection where the depth side 68*d* of the wood studs 68*x* abut the width side 68*w* of the wood studs 68*y*. In this case the U shaped spacer brace 302 has the dorsal side of the web 302 abut the depth side 68*d* of the wood studs 68*x* which allows for a fastener 122 to be connected to the depth side 68*d* of the wood stud 68*w*. Usually drywall (not shown) is attached to the width sides of the wood studs 68*x* and 68*y*. By having the U shaped spacer brace 302 located at the inside corner connecting the wood studs 68*x* and 68*y* drywall can now be connected to the dorsal side of the web 302*a* without having to add another wood stud 68*y* at the inside corner.

Figure 35:
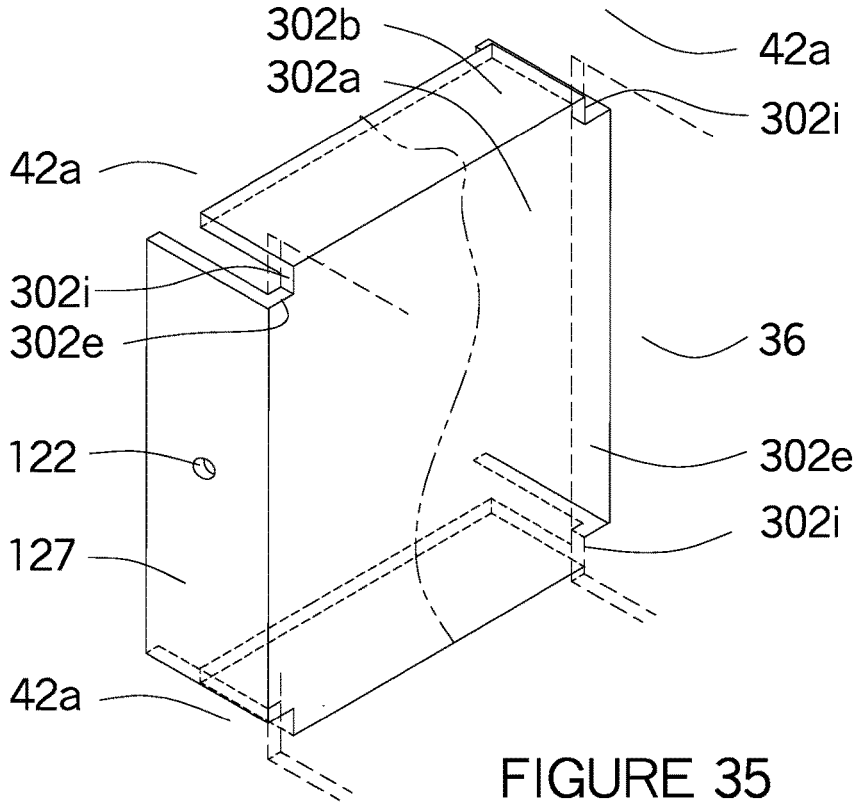
FIG. 35 shows an enlarged view of each end of the spacer brace when intersecting holes as shown in FIG. 34.
Figure 37:
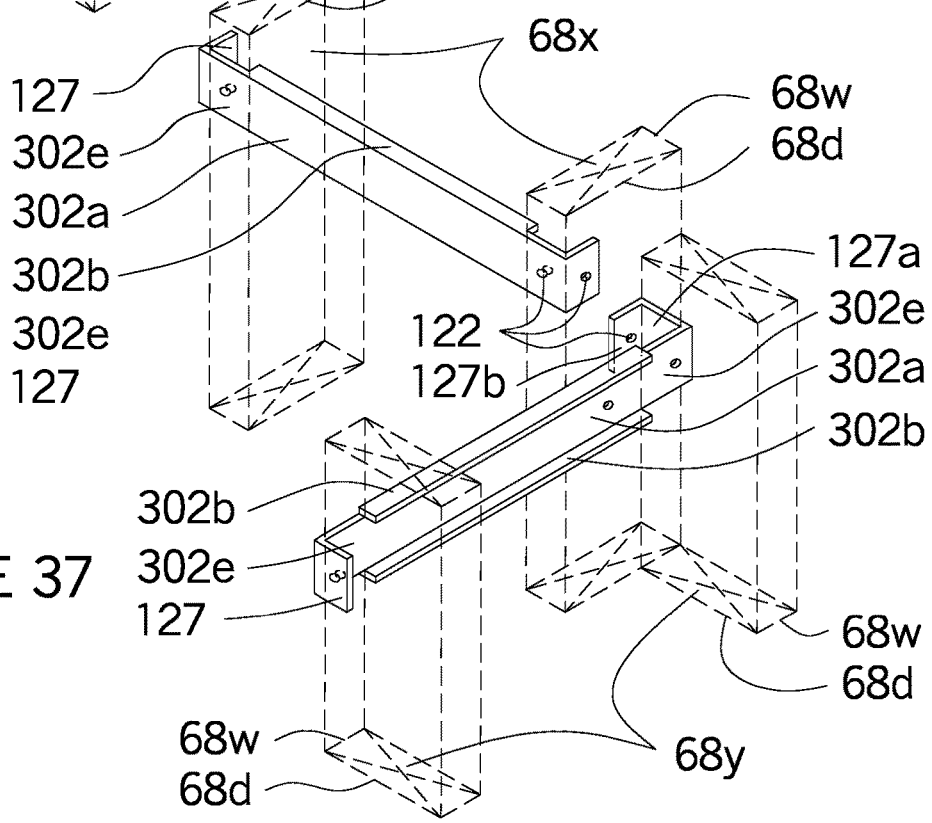
FIG. 37 shows an isometric view of spacer braces connecting wood support members at an outside corner.

FIG. 37 is similar to FIG. 34 as they both an X & Y direction of the wood studs 68*x* & 68*y* and the U shaped spacer brace 302, however in FIG. 35 the U shaped spacer brace 302 is shown installed on the wood studs 68*x* instead of the wood studs 68*y*. In addition, the U shaped spacer brace 302 shown on the right side of the wood studs 68*w* an L-shaped is formed at hook finger 127 where the side 127*a* has the dorsal side extend over the width 68*w* of the wood studs 68*x* and extend partially over the depth 68*d*. The U shaped spacer brace 302 is first installed on the wood studs 68*y* then the wood studs 68*x* is installed into the L-shape of the hook finger 127 and additionally secured by fasteners 122 from the ventral side of the web 302*a* into the depth side 68*d* of the wood stud 68*x* forming a corner connection between the wood studs 68*x* and 68*y*.

Figure 38:
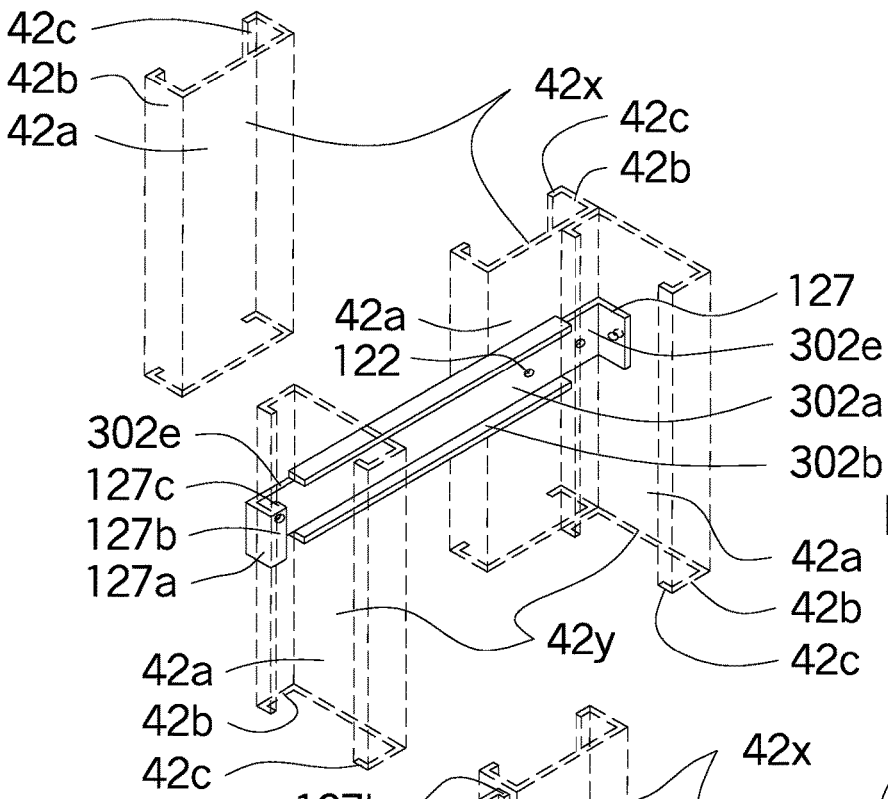
FIG. 38 shows an isometric view of a spacer brace at the intersection of an outside corner using metal support members.

FIG. 38 is similar to FIG. 34 except the wood studs 68*x* and 68*y* are now C channels 42 shown as metal studs 42*x* and 42*y*. The U shaped spacer brace 302 has a vertical oriented web 302*a* with flanges 302*b* extending ventrally horizontally so the end edges of the flanges 302*b* abut the web 42*a* of one metal stud 42*y* and the opposite end edges abut the lip 42*c* of the adjacent metal stud 42*y*. The right side has an extension 302*e* extend from the web 302*a* with the ventral side abutting the flange 42*b* and a hook finger 127 bent ventrally horizontally abutting the web 42*a* of the metal stud 42*y* at the corner intersection. The opposite end of the U shaped spacer brace 302 the web 302*a* is extended across the flange 42*b* at the extension 302*e* and then bent ventrally forming first side 127*a* against the lip 42*c* and then second side 127*b* is bent around the edge of the lip 42*c* forming an L-shape. The L-shape is usually installed at the edge of the lip 42*c* first, and rotated around so the extensions 302*e* engage both flanges 42*b* of both metal studs 42*y* and the web 42*a* of the metal stud 42*y* at the corner. The web 302*a* is connected by fasteners 122 to the web 42*a* of the metal studs 42*x*.

Figure 39:
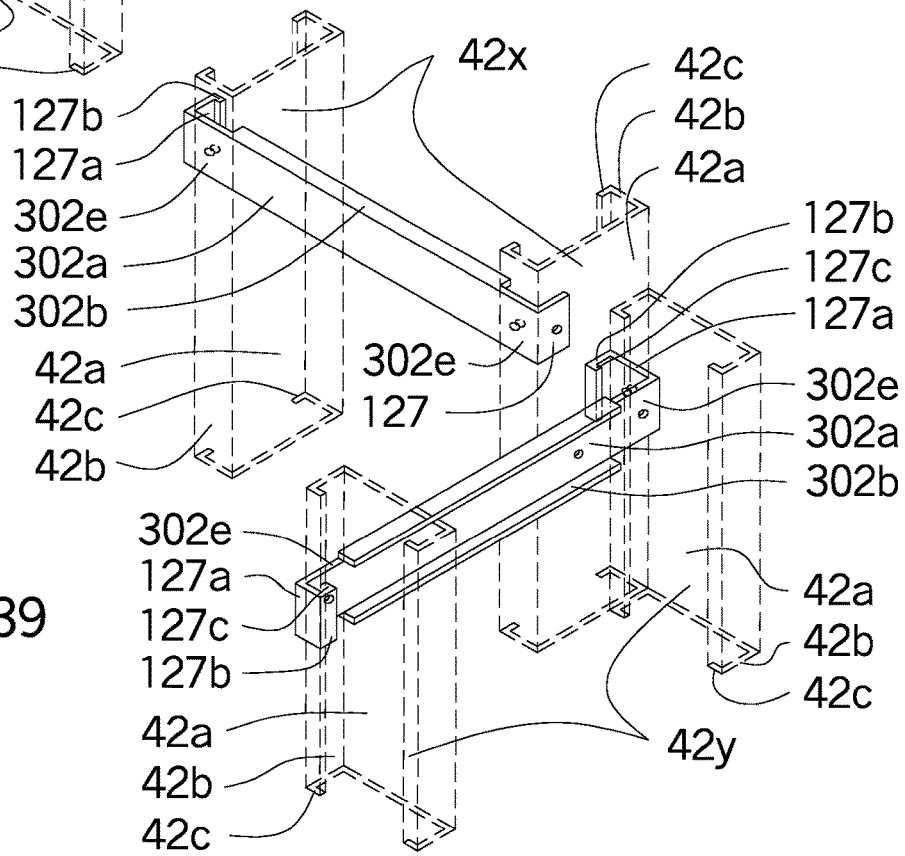
FIG. 39 shows an isometric view of spacer braces connection metal support members at an outside corner where the end of the spacer braces have a tongue side and a receiver side for connecting spacer braces in tandem.

FIG. 39 is similar to FIGS. 35 and 36 except that the wood studs 68*x* & 68*y* are shown as metal studs 42*x* & 42*y* and one end has a hook finger 127 that is L-shaped. The U shaped spacer brace 302 shown attached on the metal studs 42*y* has both ends shown as hook fingers 127 with a U-shape. The U shape spacer brace 302 has a vertical oriented dorsal where the ventral side of the extensions 302*e* abut the flanges 42*b* of the metal studs 42*y* and the flanges 302*b* abut the web 42*a* and lip 42*c* of the metal studs 42*y*. The left side shows the first side 127*a* abut the lip 42*c* and the second and third side 127*b* & 127*c* wrap around the lip 42*c*. The opposite side has the first side bent outward on the dorsal side to abut the flange 42*b* of the metal stud 42*x* then the second and third side 127 & 127 wrap around the lip 42*c* of the metal stud 42*x*. The web 302*a* has fasteners 122 that connected to the web 42*a* of the metal stud 42*x*. The U shaped spacer brace 302 is first attached to the metal studs 42*y*, then the metal stud 42*x* can be twisted into place by rotating the lip 42*c* of the metal stud 42*x* around second and third sides 127*b* & 127*c* of the hook finger 127.

Figure 40:
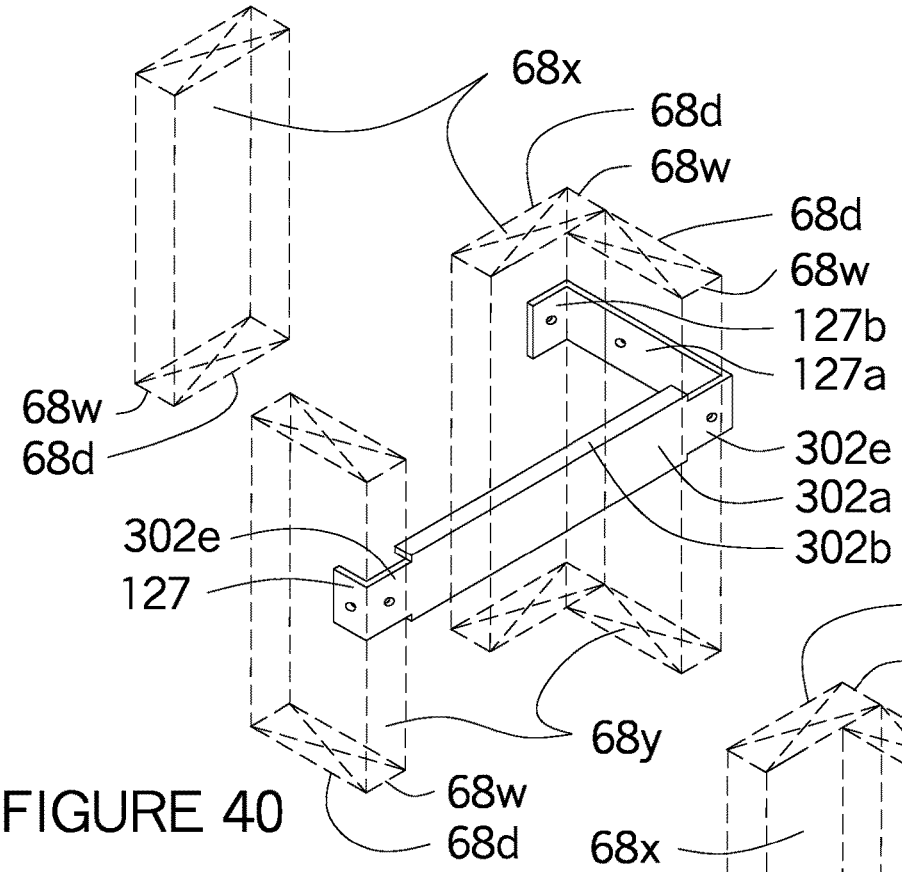
FIG. 40 shows an isometric view of an outside corner having a vertically oriented spacer brace located on the outer edges connecting the wood support members from two intersecting wall panel sections.

FIG. 40 shows the U shaped spacer brace 302 wrapped around the outside perimeter of the wood studs 68*y* oriented in the Y direction and the adjoining wood stud 68*x* oriented in the X direction. The U shaped spacer brace 302 has the web 302*a* oriented vertically with the flanges 302*b* extending ventrally horizontally so the flanges 302*b* can abut the depth sides 68*d* of the wood studs 68*y*. The web 302*a* on the left side has an extension 302*e* extend over the width side 68*w* on the ventral side and the hook finger 127 attaching to the depth side 68*d*. The opposite end has the extension 302*e* protruding over the width side 68*w* with the hook finger 127 bent ventrally forming an L-shape where the first side 127*a* abuts the depth side 68*d* of the wood stud 68*y* and continue over the width side 68*w* of the wood stud 68*x* and the second side abutting the depth side 68*d* of the wood stud 68*x*. The U shaped spacer brace 302 connects two different oriented wood studs 68*x* & 68*y* together on the outside edges versus the inside edges as shown in the previous figures.

Figure 41:
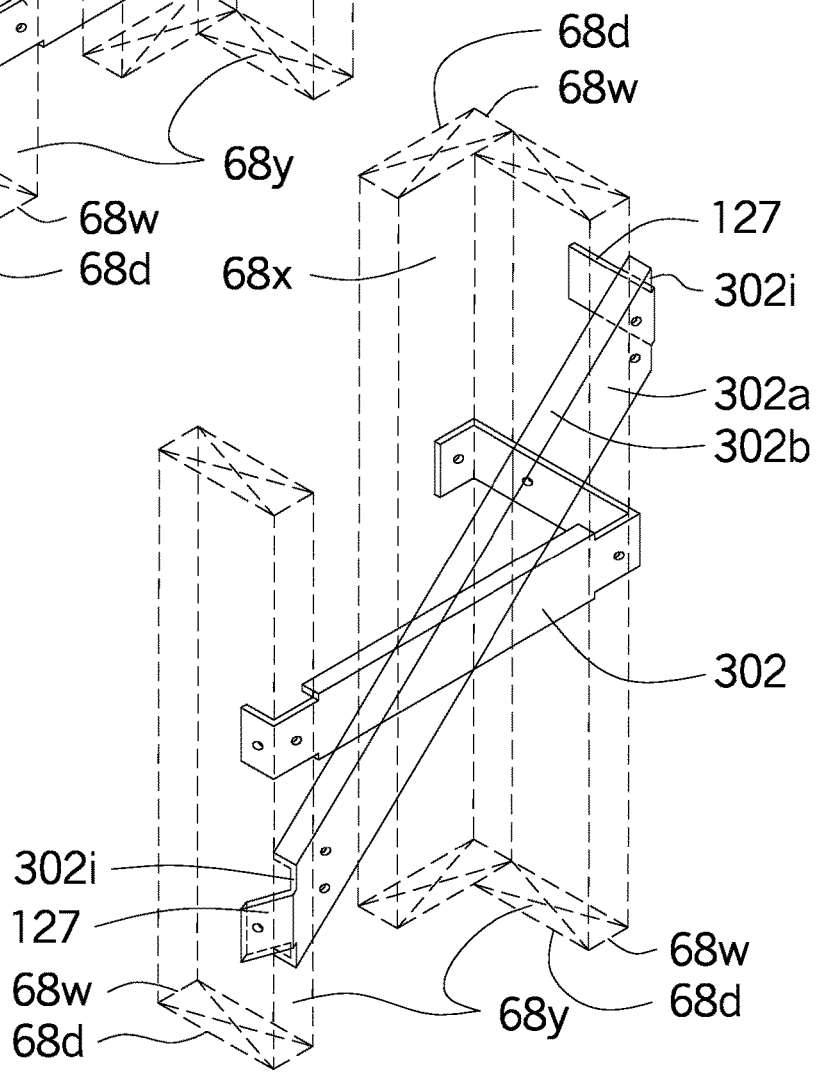
FIG. 41 shows the same isometric view as FIG. 36, however a diagonal spacer brace is installed on the outside side edges of the wood support members where the spacer brace has its dorsal oriented vertically and the ventral flanges are full depth.

FIG. 41 shows the same U shaped spacer brace 302 wrapped horizontally around the wood studs 68*x* & 68*y* at an outside corner. FIG. 39 also shows a diagonal U shaped spacer brace 302 with a vertical oriented dorsal installed over a horizontal U shaped spacer brace 302. The diagonally installed U shaped spacer brace 302 shows a vertical dorsal with the flanges 302*b* extending horizontally on the ventral side spanning between two wood studs 68*y* with the longitudinal edges resting on the width sides 68*w* of the wood studs 68*y*. The ends of the flanges 302*b* and an indentation 302*i* occurs at the corners of the wood studs 68*y* so hook fingers 127 can extend onto the depth side 68*w* of the wood studs 68*y*. The left hook finger 127 is shown at an angle, however in reality the side edges of the hook finger 127 is parallel to corner made by the intersecting sides of the web 302*a* and flanges 302*b*. Since the U shaped spacer brace 302 is installed at a diagonal the bent finger 127 is bent at an angle. On the other hand, the hook finger 127 on the right side has the edges cut at an angle, so when the hook finger 127 is bent the hook finger 127 will appear perpendicular to the vertical orientation of the wood studs 68*y*.

Figure 42:
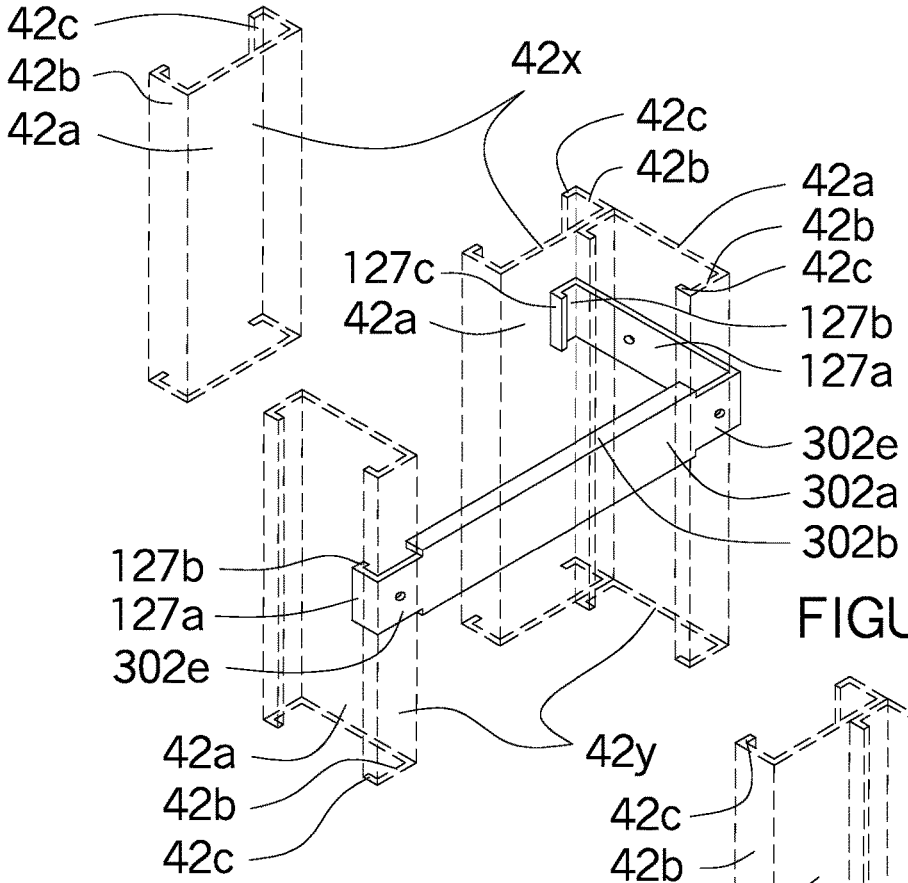
FIG. 42 shows the same isometric view as FIG. 36 except the spacer brace has an L-shaped hook finger connecting the lip of an adjacent wall panel and a C-shaped hook finger attaching the lip of different oriented metal framing members of another wall panel.
Figure 43:
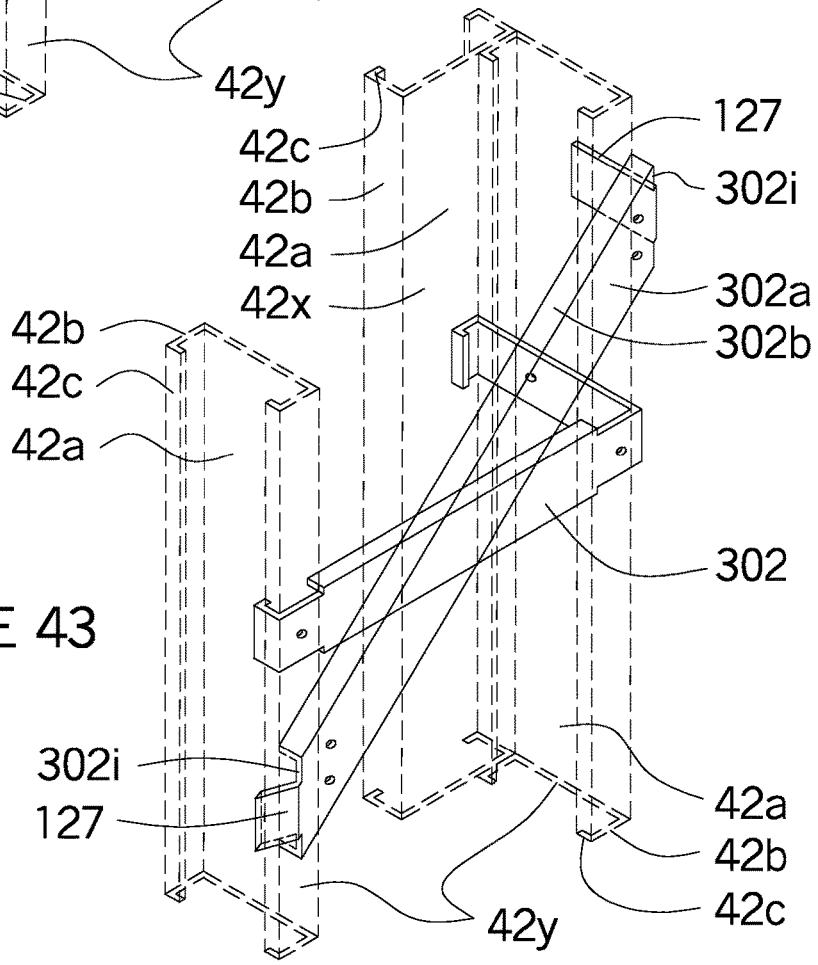
FIG. 43 shows the same isometric view as FIG. 38, however a diagonal spacer brace is installed on the outside side edges of the metal support member where the spacer brace has its dorsal oriented vertically and the ventral flanges are full depth.

FIG. 42-43 are similar to FIGS. 38 & 39 except metal studs 42*x* and 42*y* are used. The same hook fingers 127 being L-shaped or U-shaped that were described in FIG. 37 have been used in these figures as well as the diagonally installed U shaped spacer brace 302 as used in FIG. 39.

Figure 44:
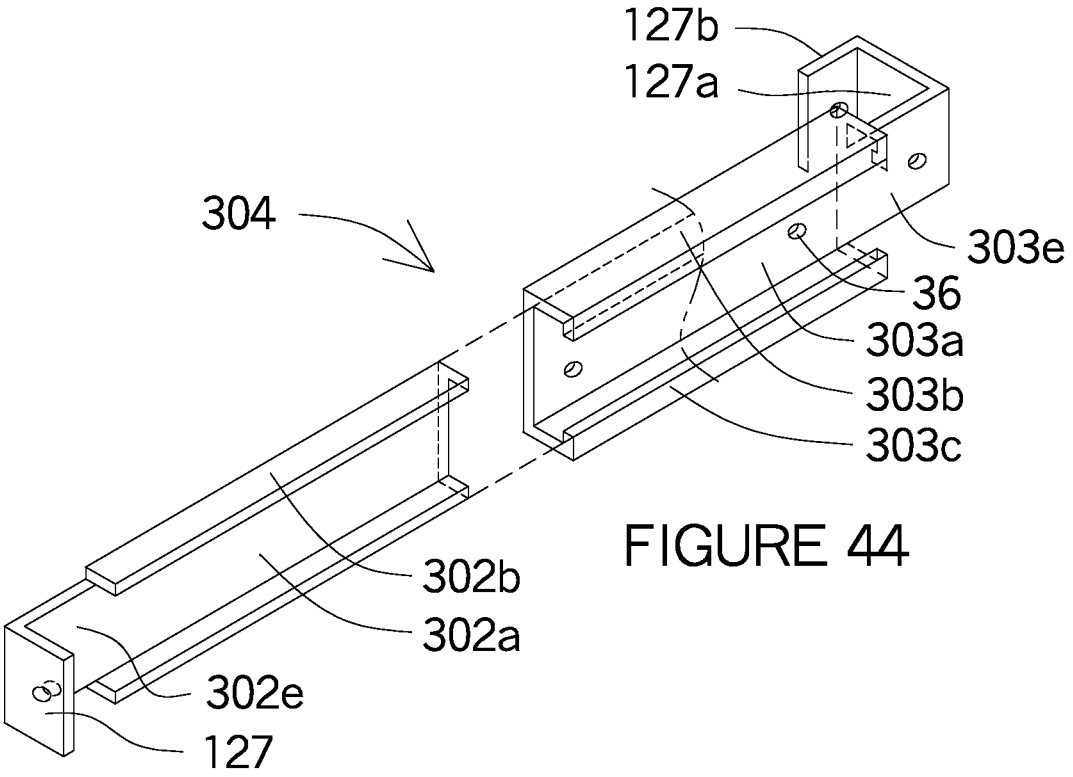
FIG. 44 shows an isometric view of a spacer brace that is shown in FIG. 35, however the spacer brace has a U-shape channel where the dorsal fits into the ventral side of a C-shape channel that is slightly larger for the smaller U-shape channel to fit into. One end of the spacer brace has a finger and the oppose end has a U-shape hook that fits around an adjacent wall panel.
Figure 45:
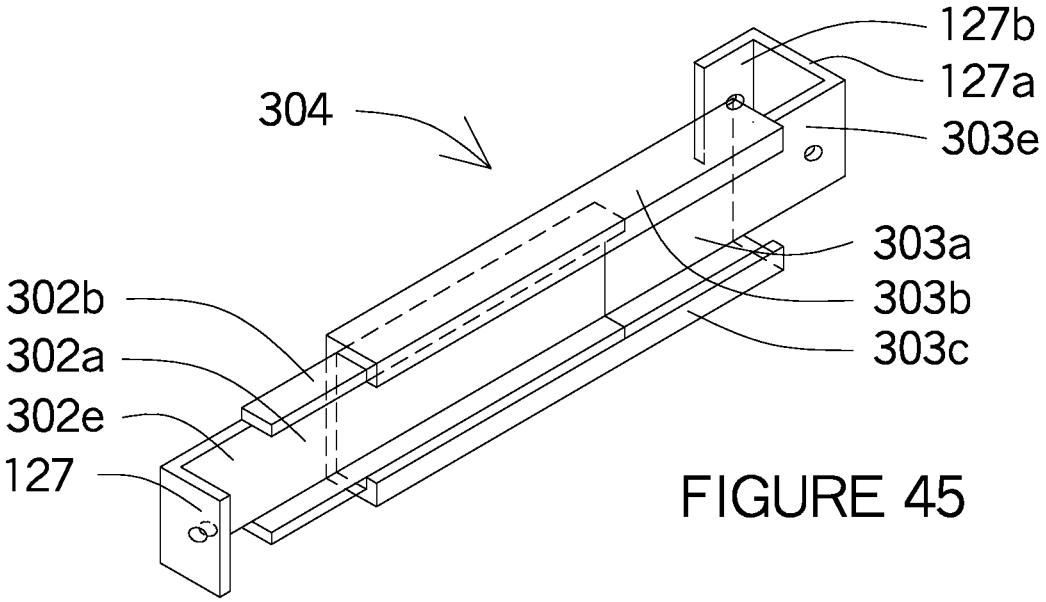
FIG. 45 shows an isometric view of the telescoping spacer brace fitting together as shown in FIG. 40.

FIGS. 44-45 are the same adjustable spacer brace 304 shown in FIG. 42 except the left end shows the hook finger 127 as just single sided and here the adjustable spacer brace 304 shows two separate component that slide between each other. The left side of the adjustable spacer brace 304 shows a U shaped spacer brace 302 having a vertically oriented web 302*a* with flanges 302*b* extending horizontally from the ventral side along with an extension 302*e* and hook finger 127 bent ventrally at one end. The right side shows a C shaped channel 303 having a vertically oriented web 303*a* with two flanges 303*b* extending horizontally on the ventral side with lips 303*c* bent inward toward each other having a hook finger 127 extend from the web 303. The U shaped spacer brace 302 fits between the flanges 303*b* and the web 303*a* & lips 303*c* of the C shaped spacer brace 303 with enough clearance so that the U shaped spacer brace 302 can move freely within the ventral sides of the C shaped spacer brace 303. The left end shows the extension 302*e* with a hook finger 127 extending ventrally while the opposite end of the adjustable spacer brace 304 shows the C shaped spacer brace 303 with the extension 303*e* extending from the web 303*a* and the hook finger 127 bent outwardly on the dorsal side having the first side 127*a* perpendicular to the dorsal and the second side 127*b* bent back again on the dorsal side forming an L-shape at the hook finger 127. Holes 36 are located on the dorsal side of the C shaped spacer brace 303 so fasteners (not shown) or other engagement means can be used to secure the adjustable spacer brace 304 together.

Figure 46:
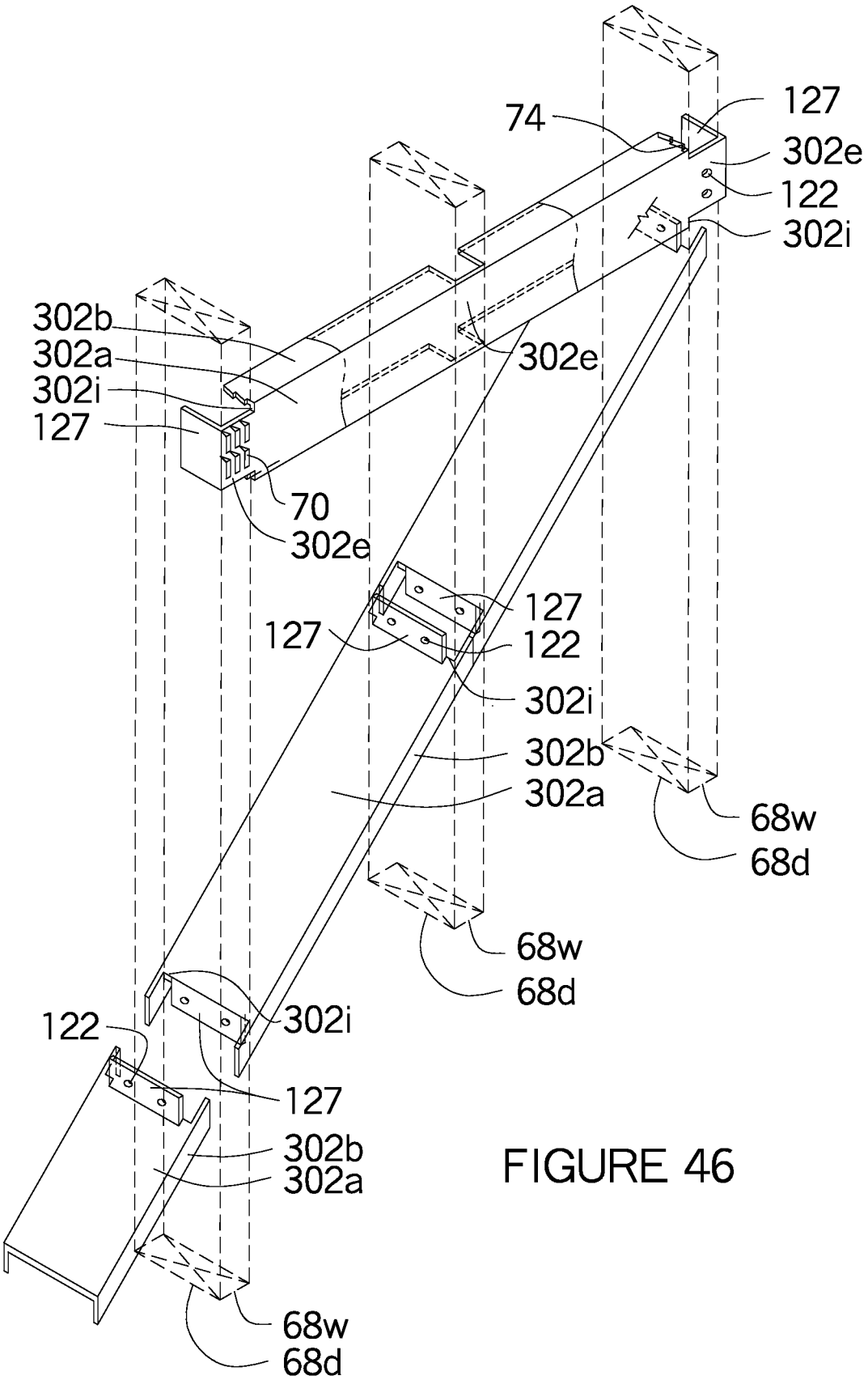
FIG. 46 shows an isometric view of a partial wall using wood support members with a spacer brace connecting three wood support members with notched flanges and the ends having fingers that wrapped around the side of the wood support members. Another spacer brace below is the same as above except the web of the spacer brace is oriented horizontally and the hook fingers are connected between the wood support members.

FIG. 46 shows an isometric view of three wood studs 68*y*, however here the U shaped spacer braces 302 has the web 302*a* oriented horizontally, but are installed at a diagonal between the wood studs 68*y*. The U shaped spacer braces 302 are shown with the dorsal side up and the flanges 302*b* extending downward from the ventral side. The ends of each U shaped spacer brace 302 has an indentation 302*i* with a hook finger 127 extending from the web 302*a* extending either upward or downward so fasteners 122 can be installed through the hook fingers 127 into the depth side 68*d* of the wood studs 68*y*. The flanges 302*b* have jagged edges 74 at the longitudinal ends of the flanges 302*b* and the web 302*a* has punch hole teeth 70 extending into the wood support member. The upper U shaped spacer brace 302 is installed horizontally between the three support members where the web 302*a* is oriented vertically with the ventral side extending toward the wood studs 68*y*. The middle intermediate support member has an extension 302*e* extend over the width side 68*w* of the U shaped spacer brace 302 with the flanges 302*b* having its edges against the depth side 68*w* of the wood stud 68*y*. The intermediate cut out is shown the cut out having the web extensions at the bottom edge of the web. The flanges 302*b* edges are shown without the jagged edges 74 and the web 302*a* without the punched hole teeth 70, but can be added when using wood support members. On the other hand the flange ends can have flaps extending away from said spacer brace having holes for fasteners as shown in FIG. 16 for metal support member. At each end the flanges 302*b* abut the depth side 68*d* of the wood stud 68*y* and the ventral side of the extension 302*e* extends over width side 68*w* with the hook finger 127 extending ventrally against the depth side 68*d* of the wood stud 68*y*.

Figure 47:
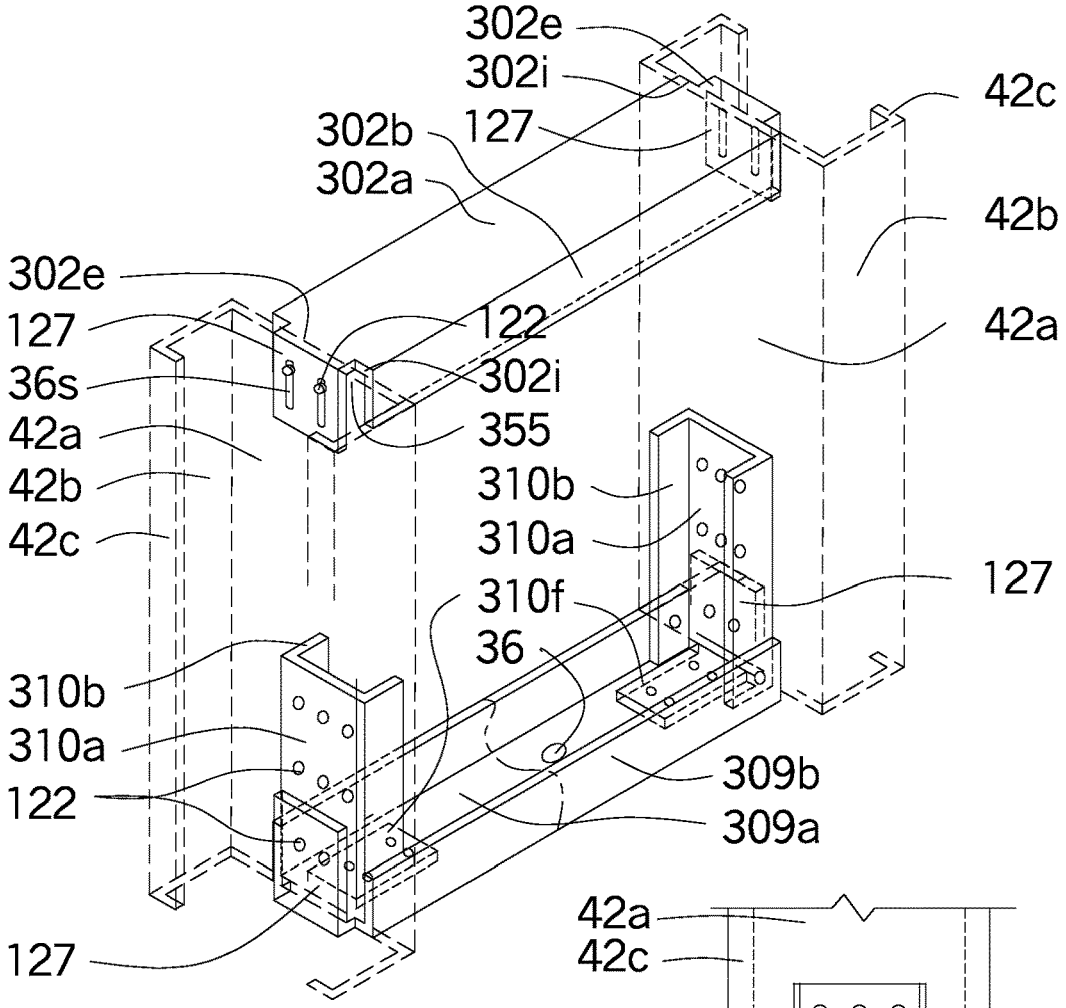
FIG. 47-49 shows an isometric, section and plan view of a spacer brace and the hold-down connecting adjacent metal support members at the floor.
Figure 48:
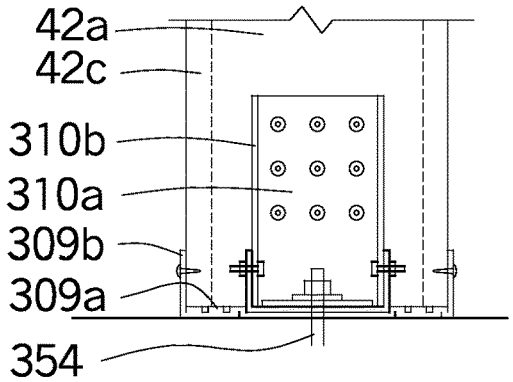
Figure 49:
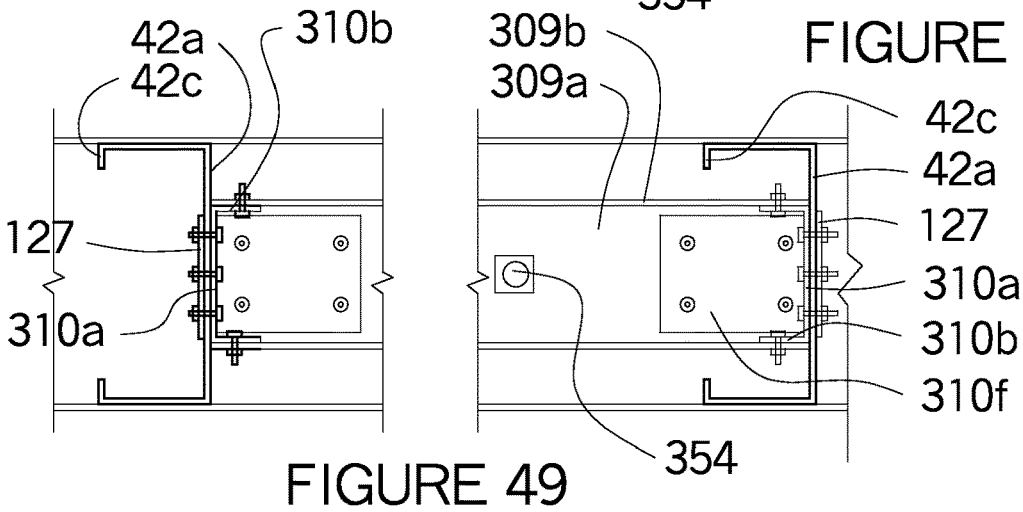

In FIGS. 47-49 at the base of the support member is a horizontally oriented hold-down spacer brace 309 attached to the concrete floor 39' along with the hold-down bracket 310. The hold-down spacer brace 309 sometimes referred to as a base plate is the same as a U shaped spacer brace 302 as previously explained except the dorsal side is attached to the concrete floor 39' and has a hole 36 in the web for an anchor bolt 354 to be secured to the web 302*a*. The hold-down spacer brace 309 and the hook fingers 127 are attached to the web 42*a* of the C channel as shown in FIGS. 45-47. A base plate can be installed the full width of the support member as shown in FIG. 46 or two angles can be installed on both sides of the hold-down spacer brace 309 where each angle (not shown) would replace a flange 302*b* and about one-half the width of the web 302*a* if so desired. The hold-down spacer brace 309 spans between adjacent support member where the flanges 309*b* extends ventrally upward from the web 309*a* and abut the web 42*a* of the support members where the web 309*a* has an indentation 309*i* at the web 42*a* and an extension 309*e* from the web 309*a* passes under the web 42*a* of the C channel 42 where the hook finger 127 extends ventrally upward. The opposite side of the webs 42*a* where the edges of the flanges 309*b* abut the opposing side of the web 42*a* a hold-down spacer bracket 310 is installed between the flanges 309*b*. The web 310*a* of the hold-down spacer bracket 310 is installed against the web 42*a* of the C channel 42 having flanges 310*b* extend ventrally outward and connected to the flanges 309*b* of the hold-down spacer brace 309. An end plate 310*f* extends ventrally from the web 310*a* parallel to the web 309*a* of the hold-down spacer braces 309 where the web 309*a* & the end plate 310*f* are connected together. At the top of the support members the U shaped spacer brace 302 has the ventral side of the web 42*a* facing the support member with the flanges 42*b* abutting the web 42*a* with an extension 302*e* extending over the web 42*a* with the hook finger 127 extending downward over the web 42*a*. Slot holes 36*s* are shown in the hook finger 127 for fasteners 122 to be connected to the web 42*a*. The fasteners 122 are designed to secure the C channel 42 to the U shaped spacer brace 302, however when the U shaped spacer brace 302 is secured to a ceiling/floor above the support member is expected to move when weight or people or furniture (meaning live load & dead load) is applied to the structural member above that structural member will move. The C channel 42 are not installed tight to the U shaped spacer brace 302 so the fastener 122 can connect to the support member through the slot hole 36*s* for the C channel 42 is allowed to move. FIG. 47 shows an isometric view of the slot hole 36*s* at the top of the support member.

Figure 50:
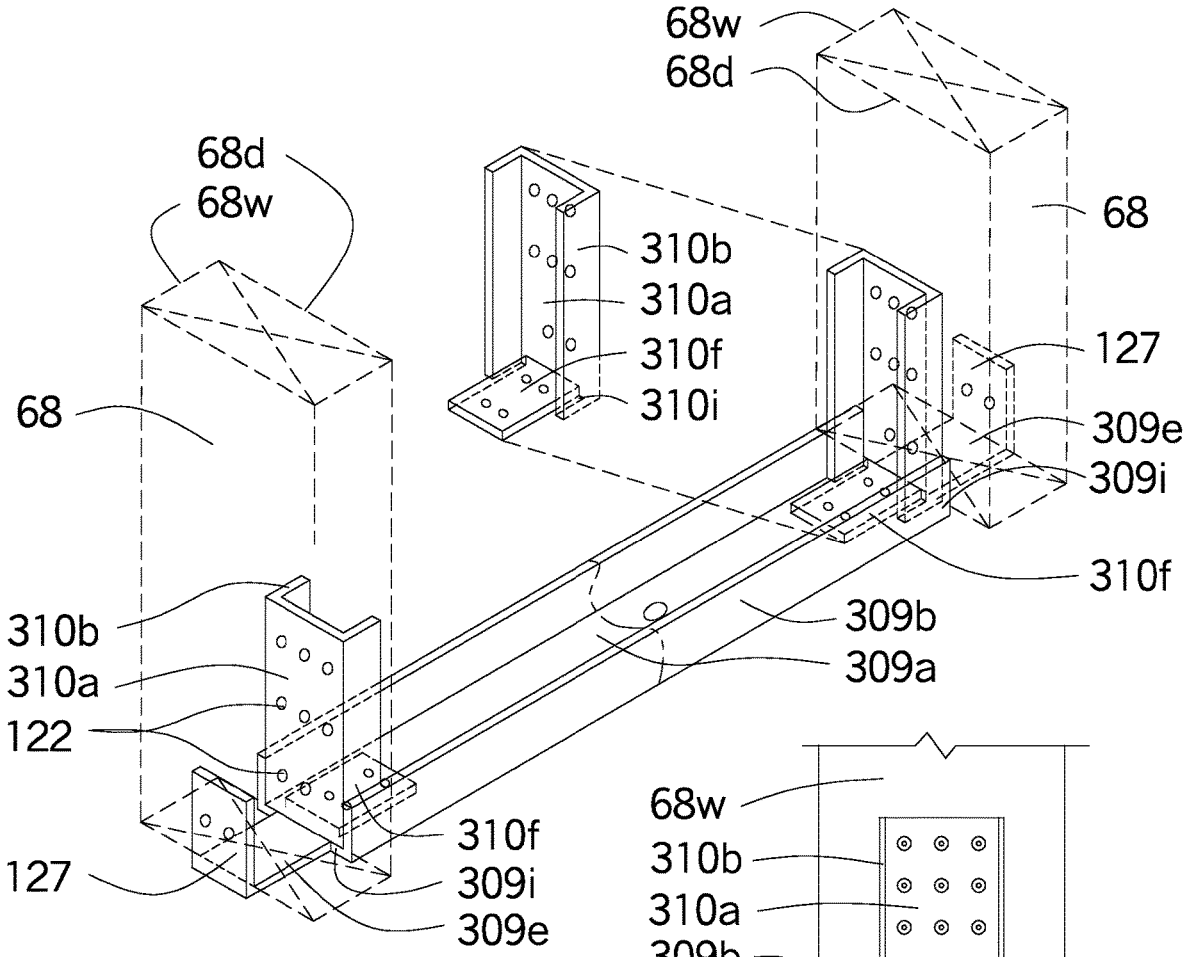
FIG. 50-52 shows an isometric, section and plan view of a spacer brace and the hold-down connecting adjacent wood support members at the floor.
Figure 51:
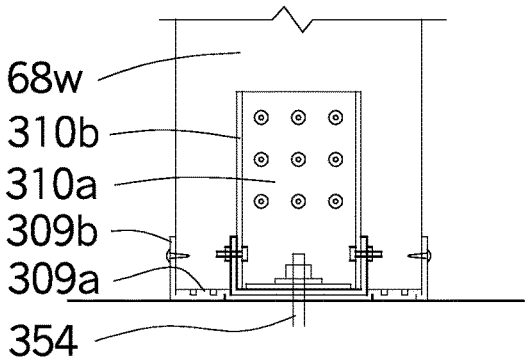
Figure 52:
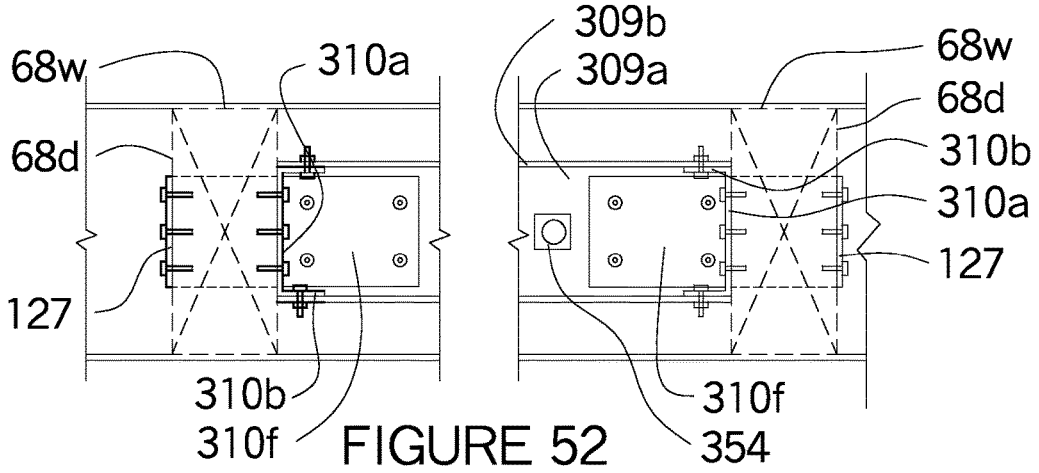

FIGS. 50-52 are similar to FIGS. 47-49 except wood support members 168 are used in lieu of the C channel 42 as the support members. The depth sides 68*d* of the wood support members 68 fit between the vertical edges of the flanges 309 of the hold-down spacer brace 309 and the opposite depth side 68*d* fits against the hook finger 127 of the hold-down spacer brace 309. The end of the wood support member 68 rest on the extensions 309*e* at both ends of the hold-down spacer brace 309 with the extensions 309*e* being the same length as the width side 68*w* of the wood support member 68. The web 309*a* of the hold-down spacer brace 309 is attached to the depth sides 68*d* of the wood support members 68. By having the hook fingers 127 and the hold-down brace 309 attach to the wood support members 68 with fasteners 122 through the depth sides 68*d*, the wood support members 68 are now connected to the wood support members 68 against the wood grain of the support members making the connection stronger than typical wood framing construction practices. The web 310*a* of the hold-down spacer bracket 310 can also be attached to the depth sides 68*d* of the wood support members 68 similar to the connection in FIGS. 47-49.

Figure 53:
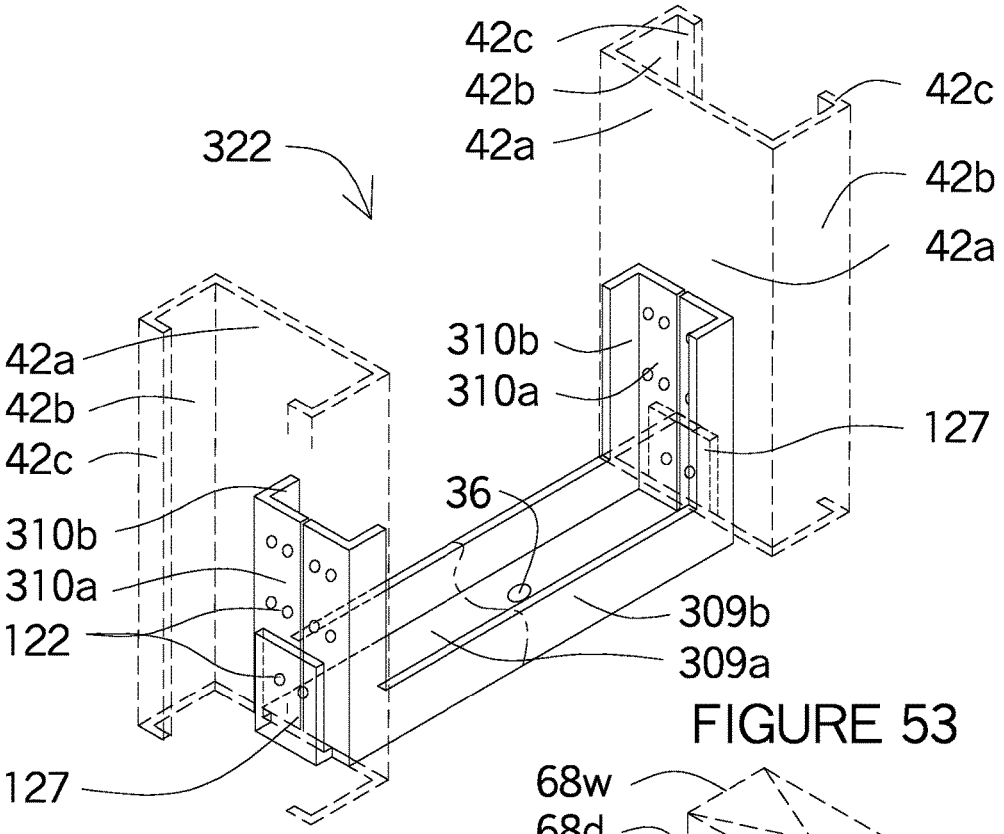
FIG. 53 shows an isometric view of a one piece hold-down spacer brace-bracket between metal framing with the hook finger connecting the opposite side of the support member.
Figure 54:
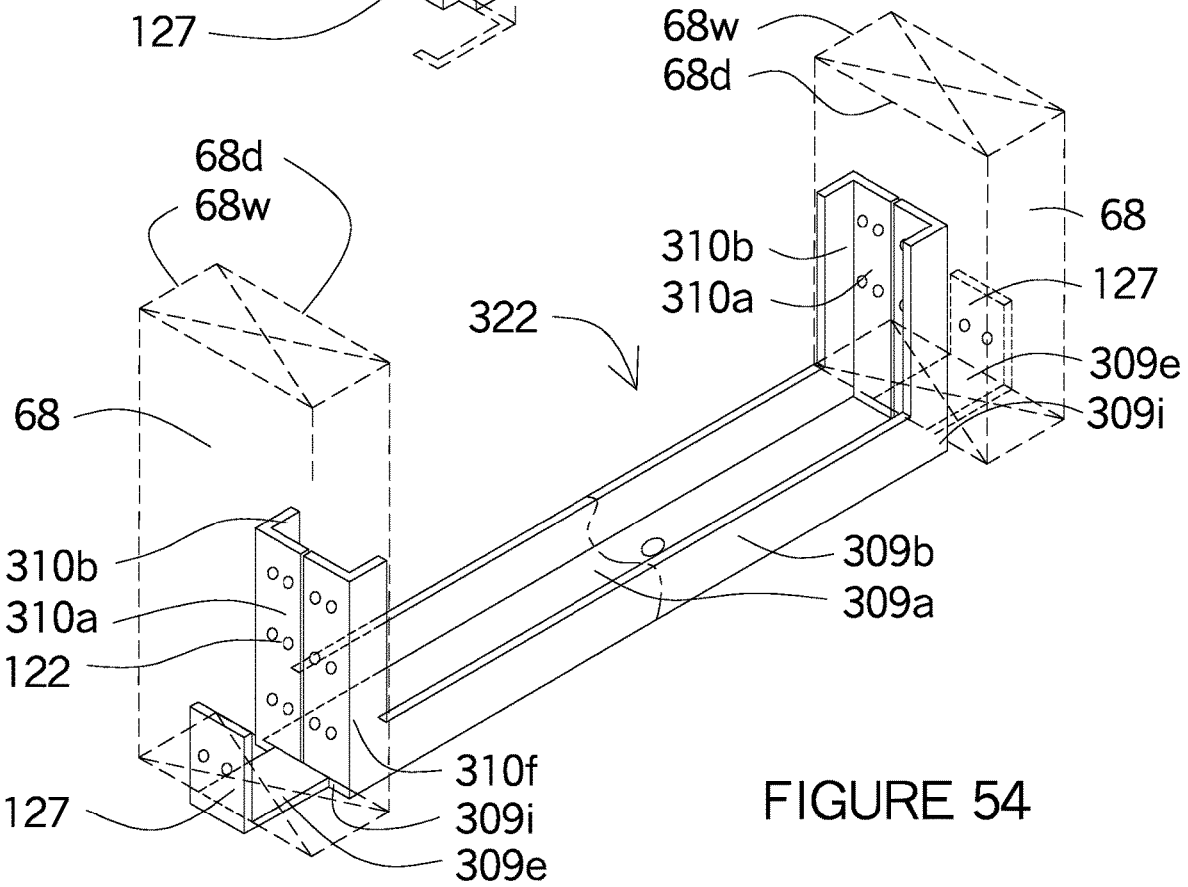
FIG. 54 shows an isometric view of a one piece hold-down spacer brace-bracket between wood framing with the hook finger connecting the opposite side of the support member.
Figure 55:
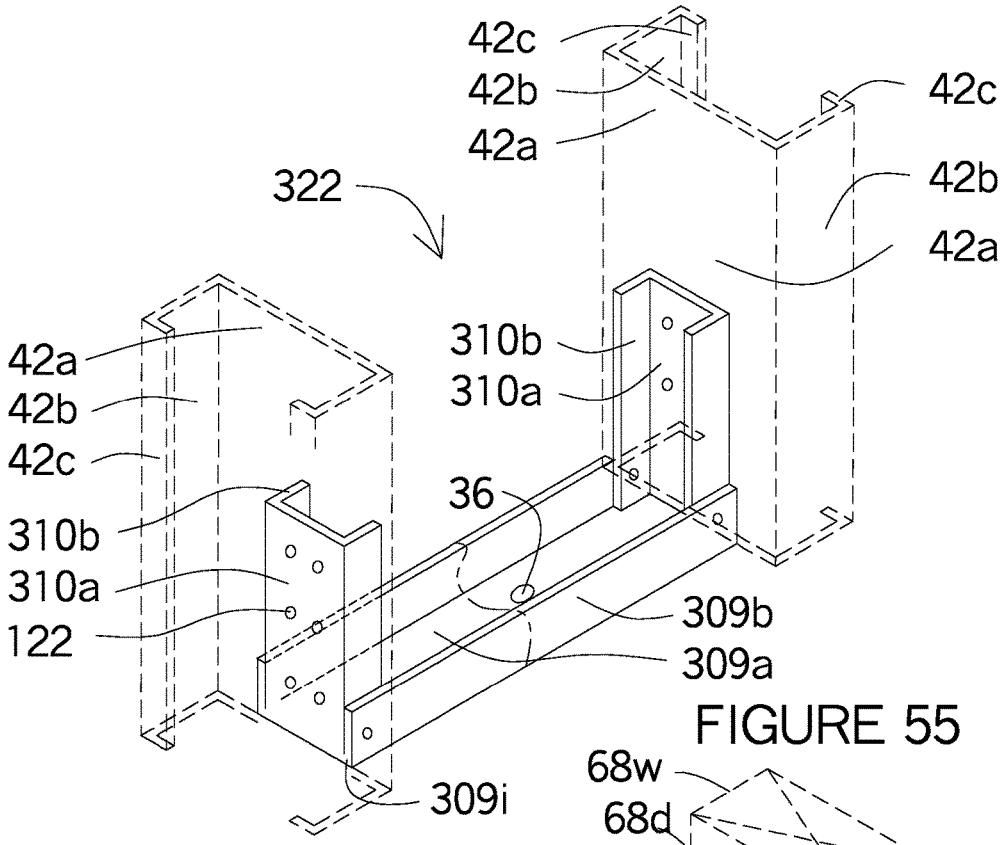
FIG. 55 shows an isometric view of a one piece hold-down spacer brace-bracket between metal framing without the hook finger.
Figure 57:
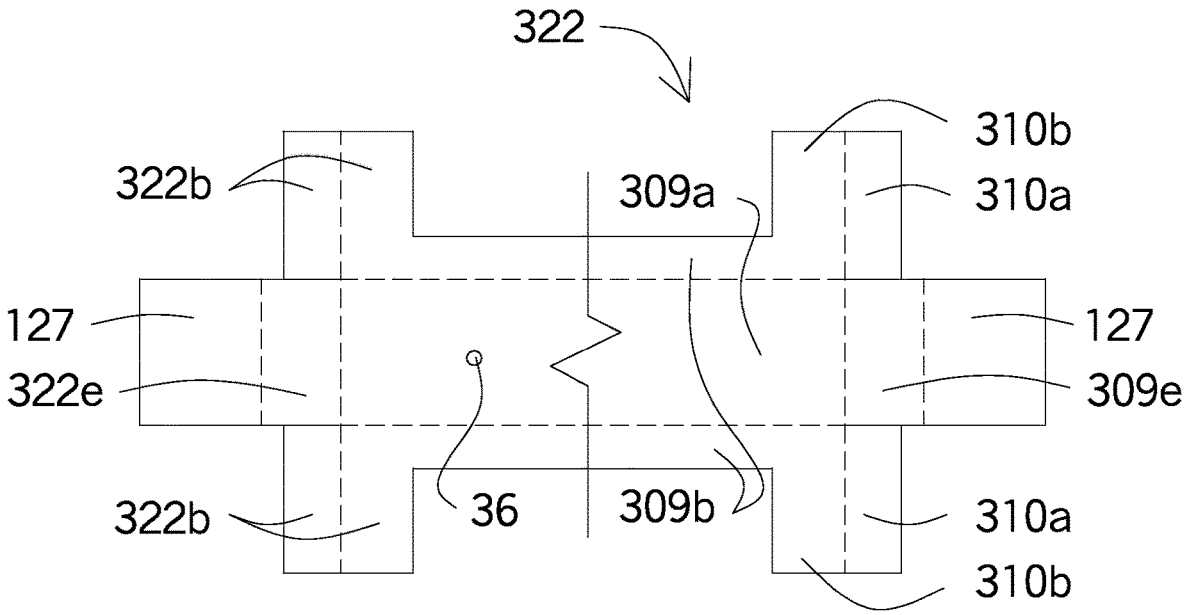
FIG. 57 shows a fold out profile of a one piece hold-down spacer brace-bracket shown in FIGS. 53 & 54.

FIGS. 53-54 shows a one piece hold down spacer brace-bracket 322 consisting as one rather than the hold-down spacer brace 309 and the hold-down bracket 310 shown in FIGS. 47-52. The end of the one piece spacer brace-bracket 322 is best described as a cross shape when the outer edge profile is cut prior to being bent into shape and shown in FIG. 57 where the left side is numbered relative to the one piece spacer brace-bracket 322 and the right side is number relative to a hold-down spacer brace 309 and the hold-down bracket 310. The bottom stem of the cross consists of a web 322*a* and the flanges 322*b*. The arms of the cross shape are an extension of the flanges 322*b* equal to the length of the arms or when compared to the hold-down bracket 310 the arms are the combination of the web 310*a* and the flanges 310*b* as shown in FIG. 55. The top of the cross shape is the extension 322*e* and the hook finger 127. The solid lines in FIG. 57 are a cut surface and the dotted lines are where a bend occurs separating say a web 322*a* and the flange 322*b*. FIGS. 53 & 54 are the same one piece hold down spacer brace-bracket 322 except the extension 322*e* has different length. That is the width of the web 42*a* is the thickness of the metal material and the width 68*w* of the wood framing member 68 is the thickness of a wood framing support member. In both FIGS. 52 & 54 the edges of the flanges 522*b* abut against the support member and the extension 322*e* passed under the thickness of the support member and the hook finger engages the opposite side of the support members and is connected to adjacent support member by the web 322*a* and flanges of the U shaped spacer braces so the opposite end can abut the adjacent support member in the same fashion with the ends of the flanges 322*b* abut the web 42*a* of a C channel 42 or the depth 68*d* of the support member 68 so the extension 322*e* can pass under the support member to the opposite side of the support member.

Figure 56:
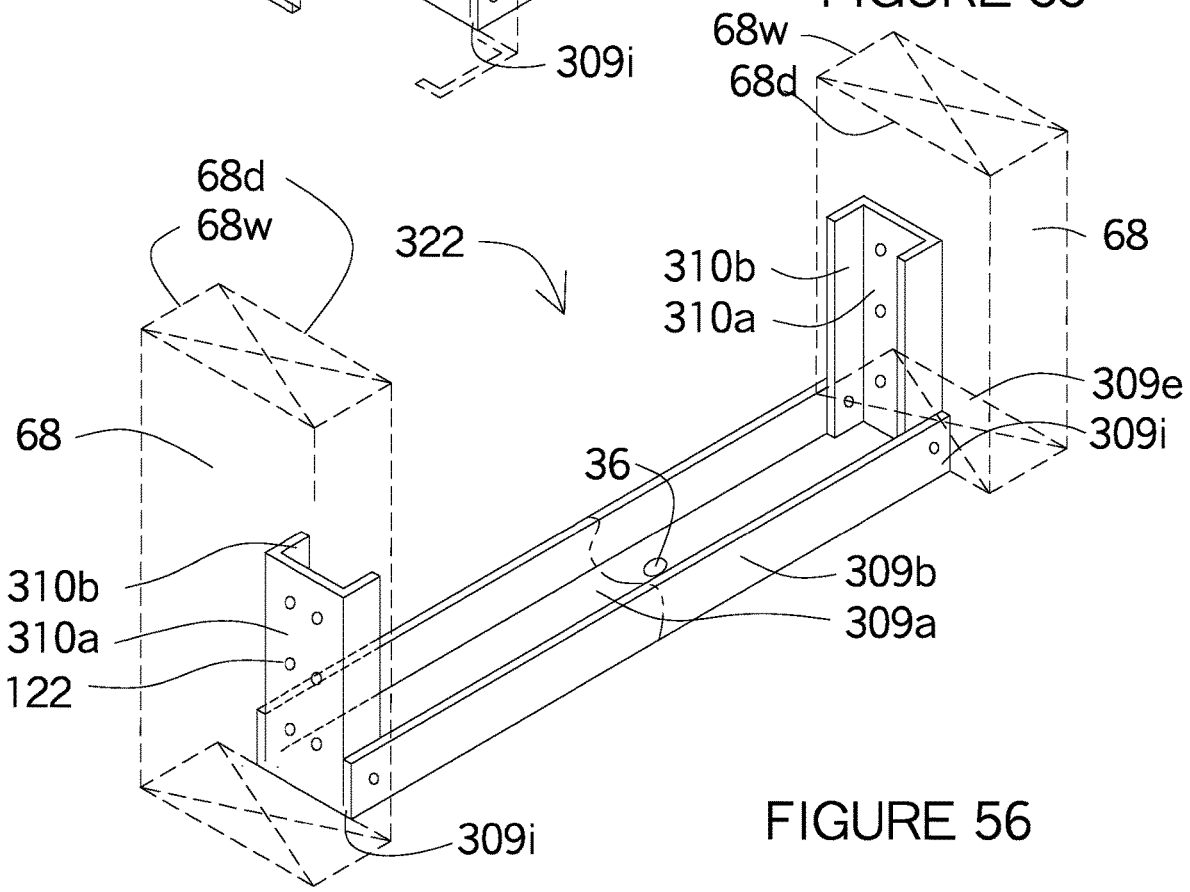
FIG. 56 shows an isometric view of a one piece hold-down spacer brace-bracket between wood framing without the hook finger.
Figure 58:
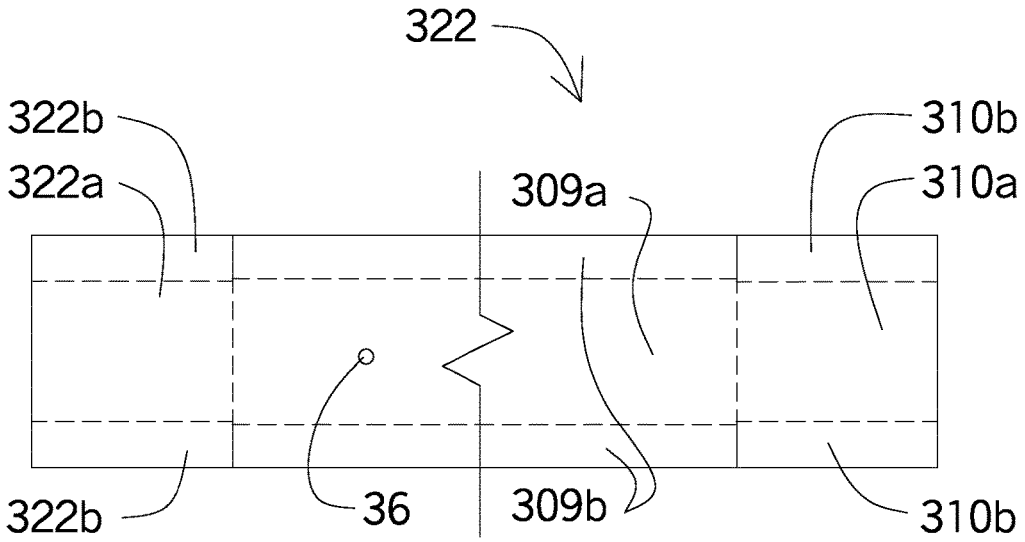
FIG. 58 shows a fold out profile of a one piece hold-down spacer brace-bracket shown in FIGS. 55 & 56.

FIGS. 55-56 show a different one-piece hold-down spacer brace-bracket 322 than in FIGS. 53-54 by eliminating the finger 127 and the extension 322*e* at both ends of the one-piece hold-down spacer brace-bracket 322. The bracket portion is different as previously explained, now the web 322*a* and flanges 322*b* are extended into the area previously occupied by the hook finger 127 and the extension 322*e* as shown in FIG. 53-54. The outer edge profile drawing in FIG. 57-58 shows the figure numbers referring to the one piece hold-down spacer brace-bracket 322 on the left side of the figure and the right side, for explanation purposes, the figure numbers refer to a hold-down spacer brace 309 and the hold-down bracket 310. In FIG. 58 the outer edge profile is a simple rectangular shape where the middle portion reflects the hold down spacer brace 309 with its web 309*a* and the flanges 309*b* and the outside reflects the hold-down bracket 310 where the web 310*a* aligns with the web 309*a* and the flanges 309*b* align with the flanges 310*b* forming a simple rectilinear shape. The flanges 310*b* are bent in tighter so the flanges 310*b* can fit inside the flanges 309*b*. Even though the one piece hold-down spacer brace-bracket 322 is described as two different pieces, the brace-bracket is made of one piece, that is the web 322*a* is the same as web 309*a* and is continued as web 310*a* while the flanges 322*b* is the same as the flanges 302*b* and 310*b*, however the metal was cut so the flange 310*b* could overlap the flange 309*b*. As shown previously the solid line is referring to a cut when explained in FIG. 56 while the dotted line is referring to a bend when forming the one piece hold-down spacer brace-bracket 322.

The present invention of the unique spacer braces are so versatile that the spacer brace allows for a much easier and quicker installation of metal or wood framing wall, constructing wood or metal truss joists, installing horizontal and diagonal lateral bracing between wood or metal floor joists, installing hold-down spacer bracing at floors between wood or metal framing, installing horizontal and diagonal braces between wood or metal support members either between holes or at the flanges. The spacer braces are additionally secured to the support members when the hook fingers have U-shape of C-shape ends.

It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications.

CONCLUSION

The spacer brace spanning between wood or metal support members are a quick and easy solution to brace horizontal and vertical support member from bending by installing a spacer brace between the support members. The rigidity and strength of the U shaped spacer brace has been increased by adding lips or extended flanges to the distal ends of the flanges of the spacer brace. The lips increase the horizontal rigidity to spacer brace while the extend flanges being vertical or the extended flanges being wider the flanges increase the rigid of the spacer brace especially great for earthquake rigid structures. In addition the flanges can be angular to also increase any rotation of the spacer brace due to hurricanes and earthquakes. The spacer braces have ridges at the ends of the flanges at the cutouts as well as the end of the hook finger has teeth to engage the support member as well as providing punched out ridges that can engage wooden support members or having abrasive means provide friction between the spacer brace and the support member.

In addition the LeBlang spacer brace is shown to extend through the aperture of the support member which none of the Cited Patents can do. The hook finger at the first end and the second end extend through the aperture of the support member to secure adjacent spacing-bracing member from moving. The hook finger with the ends of the finger having teeth that engage the support member, plus the hook finger can wrap around the aperture hole in the support member to add additional support. When the spacer brace is installed at the end of the support members at the top of the structural metal framing, the slot hole allows in the web finger of the spacer brace to move vertically as the fastener in the slot hole is installed loose so the support member can move vertically while the spacer brace at the top of the wall is secured to a ceiling member securing the spacer brace to a structural framing member as the structural framing member will move due to the live load (people, furniture) will move as people or furniture will move from the floor load above (second floor).

The LeBlang spacer brace can also be attached to the floor or foundation allowing the finger end to be attached to the support members. The hold-down spacer brace uses an anchor bolt to secure the spacer brace to the floor. Each end has the flanges abut the first side of the support member with the web extending under the support member being part of the hook finger so the web can be connected to the support member, but the finger end is connecting to the opposing end of the flange connection. The connection is using one spacer brace and at least one anchor bolt to connect the hook finger to two adjacent support members. The additional flanges, lips and double flanges all add addition strength to the spacer brace. The hook finger when attaching to wood or metal support members the hook finger is attached to the side of the support member. Typically in wood framing uses fasteners at the longitudinal ends of the wood support member which happens to be the end grain and the least resistant to connect to the wood support members.

The hook finger ends of the spacer brace can wrap around the aperture in the support member or wrap around an intersecting wall have a similar construction forming a U-shape or L-shape configuration of the finger of the hook finger. The hook finger can overlap another spacer brace if at least one spacer brace is install at a vertical angle so the hook finger can overlap another hook finger. The angled spacer brace has angled flange ends at the cutouts or notches are used to form trusses or diagonal framing for wind bracing. The diagonal flange ends created more friction with the support members and the diagonal flanges or flanges with lips create more friction at the cutouts or lip flange notches when connecting spacer braces to support members. In addition when two spacer braces intersect at the same hole in the same support member from the opposite direction or from the same direction, then the hook finger would attach to an opposing edge of the hole perimeter at the support member. On the other hand, two spacer braces can intersect the same hole when one spacer brace has the hook finger attach to the bottom edge of the hole and the top edge of the hole opposing end has the hook fingers attached to the top edge of the perimeter of the hole in the adjacent spacer brace. The spacer braces connect to both wood support members or metal support members by using cutouts or notches interchangeably to describing a separation or opening made to the spacer brace can have a notches at in both longitudinal flange ends that allow additional support members intersect the spacer brace when used at the floor, ceiling or horizontally.

FIGURE NUMBER GLOSSARY OF TABLE OF CONTENTS

36 hole: 36*be*—hole bottom edge, 36*se*—hole side edge, 36*te*—hole top edge, 36*s*—slot hole, 36*tr*—triangular shaped hole, 36*r*—hole rim.

39' concrete floor.

C channel 42*a*—web, 42*b*—flange, 42*c*—lip, 42*x* metal stud-X direction, 42*y* metal stud Y direction.

68 wood framing member 68*d*—depth, 68*w*—width, 68*x*—Wood stud-X direction, 68*y*—Wood stud-Y direction.

70 punched hole teeth: 70*t*—teeth, 70*h*—punched hole.

74 jagged edges.

76 flap: 76*f*—flange flap, 76*s*—support flap, 76*b*—bent flap.

122 fasteners.

125 dimples.

126 notches: 126*nt*—notched tab.

127 hook finger: 127*a*—first side, 127*b*—second side, 127*c*—third side, 127*f*—flare, 127*e*—abrasive edge.

128 hook tongue: 128*a*—first side, 128*b*—second side, 128*w* wide hook tongue, 128*f*—flare, 128*tf*—tongue flap, 128*tt*—tongue tab.

155 U shaped channel: 155*a*—web, 155*b*—flange.

301 reverse lip spacer brace: 301*a*—web, 301*b*—flange, 301*c*—lip, 301*i*—indentation.

302 U shaped spacer brace: 302*a* web, 302*b* flange, 302*bb*—double flange, 302*sb*—sharp budge, 302*e*—extension (general), 302*r* (ribs) to 320—ridges.

303 C shaped spacer brace: 303*a*—web, 303*b*—flange, 303*c*—lip, 303*e*—extension.

304 adjustable spacer brace.

305 I shaped spacer brace: 305*a*—web, 305*b*—flange, 305*bb*—double flange, 305*e*—extension, 305*i*—indentation.

322 one piece hold-down spacer brace-bracket: 322*a*—web, 322*b*—web, 322*e*—extension.

354 anchor bolt

The invention claimed is:

1. A structural framing system having a spacing-bracing member connecting support members comprising:

a first support member having a first support side and a second support side opposite said first support side;

a second support member having a third support side and a fourth support side opposite said third support side;

a spacing-bracing member having a web lying in a plane, said web having a first side, a second side, a first longitudinal side edge and a second longitudinal side edge; a first longitudinal flange connected to said first longitudinal side edge and a second longitudinal flange connected to said second longitudinal side edge forming an elongated body having a U-shaped cross-section; the first and second longitudinal flanges having ends with abrasive edges, the first longitudinal flange having a first cutout at an edge of said first longitudinal flange and extending into said web on a first end of the spacing bracing member, the second longitudinal flange having a second cutout at an edge of said second longitudinal flange and extending into said web on a first end of the spacing bracing member; the first longitudinal flange having a third cutout opposite the first cutout and extending into the web; the second longitudinal flange having a second cutout opposite the fourth cutout and extending into said web; said first, second, third, or fourth cutouts having first and second side edges with at least one obtuse or acute angle; said first and second cutouts forming a first web finger at a first end of the spacing-bracing member and said second and third cutouts forming a second web finger at a second end of the spacing-bracing member;

said spacing-bracing member extending between over, under, or through said first support side to said second support side of the first support member and connected to the third support side and extending over, under, or through to a fourth support side of the second support member; said first and second longitudinal flanges and said web spanning between said second support side at said first support member and said third support side of said second support member, said abrasive edges of the first and second longitudinal flanges engage said second support side of said first support member and said third support side of said second support member.

2. The structural framing system according to claim 1 wherein said spacing-bracing member has a first end attached to said first support member and a second end attached to said second support member;

said first and second support members having top end and bottom ends and an aperture extending through a web; each aperture having a perimeter first side, a perimeter second side opposite said perimeter first side, a third perimeter side opposite a fourth perimeter side located along a bottom edge of the aperture;

said first web finger of said first spacing-bracing member extending through said aperture of said first support member to snuggly engage said fourth perimeter side or at both said perimeter first side and said perimeter third side allowing said web extension to snuggly fit between said perimeter first side and said perimeter third side;

said second web finger of said spacing-bracing member extending through said aperture of said second support member to snuggly engage said fourth perimeter side or at both said perimeter first side and said perimeter third side.

3. The structural framing system according to claim 1 wherein said first and second longitudinal flanges and said first and second web fingers of said longitudinal spacing-bracing member have ridges and grooves.

4. The structural framing system according to claim 2, wherein said first and second web fingers form C or L-shaped hook configurations, said first and second web fingers extending through said apertures of said first and second support members.

5. The structural framing system according to claim 1, wherein said first and second longitudinal flanges have at least one intermediate cutout with teeth.

6. The structural framing system according to claim 2, wherein said first and second web fingers have vertical slot holes to accommodate fasteners to connect and allow vertical movement of first and second support members.

7. The structural framing system according to claim 2, wherein said abrasive edges of said first and second longitudinal flanges comprise jagged edges or teeth to engage said first support member and said second support member; and wherein said web of said spacing-bracing member having at least one fastener hole.

8. The structural framing system according to claim 2, wherein at said first cutout said first and second longitudinal flanges abut said second side of said first support member and said first web finger abuts the first side of said first support member;

wherein at said second cutout said first and second longitudinal flanges abut said third side of said second support member and said first web finger abuts the fourth side of said second support member;

and wherein said first and second web finger have a web extensions to accommodate first and second support members of varying sizes.

9. The structural framing system according to claim 2, wherein at least one of said first and second longitudinal flanges has a lip extending toward said web.

10. The structural framing system according to claim 2, wherein at said first cutout a first flap extends away from said first longitudinal flange;

and wherein at said second cutout a second flap extends away from said second longitudinal flange.

11. The structural framing system according to claim 2, wherein said first web finger of said first spacing-bracing member passes through said aperture of said first support member to engage said first perimeter side and said second perimeter side;

and said first web finger of a second spacing-bracing member passes through said aperture of said first support member and overlaps the first web member of the first spacing bracing member.

12. The structural framing system according to claim 2, wherein at least one of said first web finger and said second web finger of has a U-shaped hook.

13. The structural framing system according to claim 4, wherein said first longitudinal flange and said second longitudinal flange have teeth; and where a distal edge of said first and second web fingers have C-shaped hooks have teeth.

14. The structural framing system according to claim 4, wherein first longitudinal flange and said second longitudinal flange extend outward from the web at an angle.

15. The structural framing system according to claim 4, wherein angular lips with lip notches extend from a distal edge of said first longitudinal flange and said second longitudinal flange, and said angular lips extending either outward away from said first and second longitudinal flanges or inward toward said first and second longitudinal flanges.

16. The structural framing system according to claim 4, wherein first and second longitudinal flanges of extend above and below said web.

* * * * *